US010930451B2

(12) United States Patent
Wang et al.

(10) Patent No.: US 10,930,451 B2
(45) Date of Patent: Feb. 23, 2021

(54) KEYSWITCH WITH ADJUSTABLE TACTILE FEEDBACK

(71) Applicant: Darfon Electronics Corp., Taoyuan (TW)

(72) Inventors: Yung-Chih Wang, Taoyuan (TW); Chia-Hung Liu, Taoyuan (TW); Yu-Chun Hsieh, Taoyuan (TW); Chen Yang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/448,282

(22) Filed: Jun. 21, 2019

(65) Prior Publication Data

US 2019/0393003 A1 Dec. 26, 2019

(30) Foreign Application Priority Data

Jun. 22, 2018 (TW) ..... 10712158.8
Aug. 7, 2018 (TW) ..... 10712749.3

(51) Int. Cl.
*H01H 13/85* (2006.01)
*H01H 13/52* (2006.01)
(Continued)

(52) U.S. Cl.
CPC ..... *H01H 13/85* (2013.01); *H01H 13/023* (2013.01); *H01H 13/04* (2013.01);
(Continued)

(58) Field of Classification Search
CPC .. H01H 13/705; H01H 13/85; H01H 2215/00; H01H 2215/028; G06F 3/0202; G06F 3/0216
See application file for complete search history.

(56) References Cited

U.S. PATENT DOCUMENTS 3,674,970 A * 7/1972 Bedocs ..... H02B 1/048 200/295
4,447,681 A * 5/1984 Desmarais ..... H01H 13/705 200/5 A
(Continued)

FOREIGN PATENT DOCUMENTS

CN 201047939 Y 4/2008
CN 203812764 U 9/2014
(Continued)

OTHER PUBLICATIONS

European Search Report in related application EP 19218006.5 dated Apr. 2, 2020.
(Continued)

*Primary Examiner* — Vanessa Girardi
(74) *Attorney, Agent, or Firm* — Patterson + Sheridan, LLP

(57) ABSTRACT

A keyswitch structure includes a base having a positioning means, an cover combined with the base, a plunger with an cam portion movably coupling with the cover relative to the base, a restoring unit disposed between the base and the plunger to provide a restoring force to enable the plunger to move along a direction away from the base, a tactile feedback member having a positioning portion positioned by the positioning means and an extending arm extending across a moving path of the cam portion, and an adjusting unit being movable to drive the positioning portion to shift, so that the tactile feedback member has a first deformation or a second deformation, and a pressing force required for the cam portion to pass the extending arm when the plunger moves toward the base is changed.

22 Claims, 39 Drawing Sheets

(51) Int. Cl.

| | |
|---|---|
| ***H01H 13/04*** | (2006.01) |
| ***H01H 13/02*** | (2006.01) |
| ***H01H 13/14*** | (2006.01) |

(52) U.S. Cl.
CPC ..... *H01H 13/14* (2013.01); *H01H 13/52* (2013.01); *H01H 2215/028* (2013.01); *H01H 2215/03* (2013.01)

(56) References Cited

U.S. PATENT DOCUMENTS

| | | | | |
|---|---|---|---|---|
| 4,553,009 | A * | 11/1985 | Van Zeeland | H01H 13/705 200/517 |
| 4,939,327 | A * | 7/1990 | Wu | H01H 13/50 200/341 |
| 4,990,731 | A * | 2/1991 | Wu | H01H 13/50 200/345 |
| 5,015,811 | A | 5/1991 | Moriyama et al. | |
| 6,172,868 | B1 | 1/2001 | Oura | |
| 6,236,339 | B1 | 5/2001 | Kamizono | |
| 8,305,241 | B2 | 11/2012 | Wang et al. | |
| 10,079,123 | B2 * | 9/2018 | Yu | H01H 13/7006 |
| 10,102,987 | B1 * | 10/2018 | Alexander | H01H 13/78 |
| 10,128,063 | B2 | 11/2018 | Liao et al. | |
| 10,310,609 | B2 * | 6/2019 | Liu | G06F 3/016 |
| 10,431,402 | B2 * | 10/2019 | Hsieh | H01H 13/04 |
| 2017/0213663 | A1 | 7/2017 | Jhuang | |
| 2018/0006648 | A1 | 1/2018 | Liu | |
| 2018/0074587 | A1 | 3/2018 | Liu | |
| 2018/0137997 | A1 | 5/2018 | Wang et al. | |
| 2019/0164703 | A1 | 5/2019 | Yang et al. | |
| 2019/0393004 | A1 | 12/2019 | Wang et al. | |

FOREIGN PATENT DOCUMENTS

| | | | |
|---|---|---|---|
| CN | 104867771 | A | 8/2015 |
| CN | 104882316 | A | 9/2015 |
| CN | 105206456 | A | 12/2015 |
| CN | 105206457 | A | 12/2015 |
| CN | 205542520 | U | 8/2016 |
| CN | 205789638 | U | 12/2016 |
| CN | 106683930 | A | 5/2017 |
| CN | 206379297 | U | 8/2017 |
| CN | 206774427 | U | 12/2017 |
| CN | 207068731 | U | 3/2018 |
| CN | 108010775 | A | 5/2018 |
| CN | 108269710 | A | 7/2018 |
| CN | 108346539 | A | 7/2018 |
| CN | 207868107 | U | 9/2018 |
| CN | 108922810 | A | 11/2018 |
| CN | 108091514 | B | 6/2019 |
| JP | H 0428123 | A | 1/1992 |
| JP | H111265252 | A | 9/1999 |
| TW | 195991 | | 12/1992 |
| TW | 201705173 | A | 2/2017 |
| TW | I581290 | B | 5/2017 |
| TW | 201727685 | A | 8/2017 |
| TW | I607476 | B | 12/2017 |
| TW | I667676 | B | 8/2019 |
| WO | 2018133440 | | 7/2018 |

OTHER PUBLICATIONS

European Search Report in related application 19190555.3 dated Jan. 21, 2020.
Chinese Office Action in related applicaiton 2020091101963200 dated Sep. 16, 2020.
Chinese Office Action dated Oct. 9, 2020, for Chinese Patent Application No. 201910727509.9.

* cited by examiner

KEYSWITCH WITH ADJUSTABLE TACTILE FEEDBACK

BACKGROUND

1. Field

The disclosure generally relates to a keyswitch structure. Particularly, the disclosure relates to a keyswitch structure with adjustable tactile feedback.

2. Description of the Prior Art

Keyswitches in a conventional keyboard generally provide only one kind of tactile feedback. Users have to select the keyboard with appropriate tactile feedback among keyboards with different kinds of tactile feedback according to personal pressing habits. However, when the user is under different operation situations, such as typing, gaming, it is generally desirable to have different tactile feedbacks, so that keyboards that provide merely a single type of tactile feedback cannot satisfy the user's needs, and the user has to purchase additional keyboards with different tactile feedbacks, resulting in extra cost and storage concerns for keyboards not in use.

SUMMARY

It is an object of the disclosure to provide a keyswitch structure, which can provide multiple kinds of tactile feedback for users to choose, so as to satisfy users' needs.

In an embodiment, the disclosure provides a keyswitch structure including a base having a positioning means, an cover combined with the base, a plunger movably received within the cover and capable of moving relative to the base, the plunger having an cam portion, a restoring unit disposed between the base and the plunger to provide a restoring force to enable the plunger to move along a direction away from the base, a tactile feedback member having a positioning portion positioned by the positioning means and an extending arm extending across a moving path of the cam portion, and an adjusting unit disposed corresponding to the positioning portion, wherein the adjusting unit is movable to drive the positioning portion to shift, so that the tactile feedback member has a first deformation or a second deformation, and a pressing force required for the cam portion to pass the extending arm when the plunger moves toward the base is changed.

In an embodiment, the cam portion includes a bump with a lower surface, an upper surface, and a protrudent point between the lower surface and the upper surface. When the pressing force is exerted to enable the plunger along with the cam portion to move toward the base, the extending arm firstly moves downward along the lower surface to the protrudent point, and then passes the protrudent point to move upward and hit the base or the cover to generate a sound.

In an embodiment, the tactile feedback member is a torsion spring. The positioning portion and the extending arm respectively extend from two opposite ends of the torsion spring. An angle between an extending direction of the positioning portion and an extending direction of the extending arm is equal to or smaller than 120 degrees.

In an embodiment, the restoring unit is a spring. The tactile feedback member is integrally formed with the spring. The positioning portion is connected to the spring and the extending arm.

In another embodiment, the disclosure provides a keyswitch structure including a base having a positioning means, an cover combined with the base, a plunger movably coupling with the cover relative to the base, the plunger having an cam portion, a resilient member including a spring portion, a positioning portion, and an extending arm, the spring portion disposed between the base and the plunger to provide a restoring force to enable the plunger to move along a direction away from the base, the positioning portion connected to the spring portion and the extending arm and positioned by the positioning means, the extending arm extending corresponding to the cam portion, and an adjusting unit including an X-axis adjusting member disposed corresponding to the positioning portion and a Y-axis adjusting member disposed corresponding to the extending arm, wherein the X-axis adjusting member is movable along an X-axis direction to a first position or a second position and drives the positioning portion to shift, so that the positioning portion and the extending arm has a first deformation or a second deformation with respect to the spring portion, and a pressing force required for the cam portion to move relative to the extending arm when the plunger moves toward the base is changed, and wherein the Y-axis adjusting member is movable along a Y-axis direction to drive the extending arm to shift, so that a position of the extending arm relative to a moving path of the cam portion is changed.

In an embodiment, the cam portion is a bump. When the X-axis adjusting member is at the first position or the second position, the pressing force is exerted to enable the plunger along with the cam portion to move toward the base, so that the extending arm moves along the bump and hits the base or the cover to generate a sound.

In an embodiment, the Y-axis adjusting member is movable along the Y-axis direction to drive the extending arm to move to a third position or a fourth position relative to the moving path, so when the plunger moves toward the base, the cam portion moving along the moving path selectively interferes with the extending arm.

In an embodiment, when the extending arm is at the third position and the plunger moves toward the base, the cam portion pushes the extending arm to move along the Y-axis direction away from the moving path to generate a dome-collapse-like tactile feedback.

In an embodiment, when the extending arm is at the fourth position, the extending arm is located outside the moving path, so when the plunger moves toward the base, the cam portion moves along the moving path without interfering with the extending arm.

In another embodiment, the disclosure provides a keyswitch structure including a base having a positioning means, an cover combined with the base, a plunger movably coupling with the cover relative to the base, the plunger having an cam portion, a restoring unit disposed between the base and the plunger to provide a restoring force to enable the plunger to move along a direction away from the base, a tactile feedback member including a positioning portion positioned by the positioning means and an extending arm extending across a moving path of the cam portion, and an adjusting unit disposed corresponding to the extending arm, the adjusting unit being movable in a Y-axis direction to a first position or a second position, wherein when the adjusting unit switches between the first position and the second position, the adjusting unit drives the extending arm to move along the Y-axis direction, so that the tactile feedback member has a first deformation or a second deformation, and wherein the cam portion has a bump with a lower surface, an upper surface, and a protrudent point between the lower surface and the upper surface; when a pressing force is exerted to move the plunger along with the cam portion toward the base, (a) when the tactile feedback member has the first deformation, the extending arm moves along the lower surface for a first distance to the protrudent point, and then passes the protrudent point to move upward away from the bump; (b) when the tactile feedback member has the second deformation, the extending arm moves along the lower surface for a second distance to the protrudent point, and then passes the protrudent point to move upward away from the bump; the first distance is larger than the second distance.

In an embodiment, when the adjusting unit is at the first position and the extending arm reaches the protrudent point, the extending arm has a first sound distance from an impact surface, and then the extending arm hits the impact surface to generate a first sound. When the adjusting unit is at the second position and the extending arm reaches the protrudent point, the extending arm has a second sound distance from the impact surface, and then the extending arm hits the impact surface to generate a second sound. The first sound distance is larger than the second distance, and the first sound is louder than the second sound.

In an embodiment, the adjusting unit is further movable in the Y-axis direction to a fourth position and drives the extending arm to move, so that the tactile feedback member has a fourth deformation. When the adjusting unit is at the fourth position, the extending arm is located outside the moving path of the cam portion, so that plunger moves toward the base along with the cam portion without interfering with the extending arm.

In another embodiment, the disclosure provides a keyswitch structure including a base having a positioning means, an cover combined with the base, a plunger movably coupling with the cover relative to the base, the plunger having an cam portion, a restoring unit disposed between the base and the plunger to provide a restoring force to enable the plunger to move along a direction away from the base, a tactile feedback member having a positioning portion positioned by the positioning means and an extending arm extending corresponding to a moving path of the cam portion, and an adjusting unit disposed corresponding to the tactile feedback member, wherein the adjusting unit is movable to change a position of the extending arm relative to the moving path.

In an embodiment, the adjusting unit is movable to drive the extending arm to move to a first position or a second position relative to the moving path, so when the plunger moves toward the base, the cam portion moving along the moving path selectively interferes with the extending arm.

In an embodiment, when the extending arm is at the first position and the plunger moves toward the base, the cam portion pushes the extending arm to move along a Y-axis direction away from the moving path.

In an embodiment, when the extending arm is at the second position, the plunger is located outside the moving path, so when the plunger moves toward the base, the cam portion moves along the moving path without interfering with the extending arm.

Compared to the prior art, the keyswitch structure of the disclosure can provides different kinds of tactile feedback by controlling the adjusting unit to change the deformation of the tactile feedback member. Moreover, the keyswitch structure of the disclosure can change the position of the adjusting unit to change the position of the extending arm relative to the cam portion, so as to selectively provide different tactile feedbacks, such as different required pressing forces, dome-collapse-like tactile feedback, linear feedback.

DETAILED DESCRIPTION

The disclosure provides a keyswitch structure, particularly a keyswitch structure with adjustable tactile feedback. The keyswitch structure can be applied to independent keyboards or integrated into electronic devices to provide multiple tactile feedbacks, such as different stiffnesses (i.e. different required pressing forces), dome-collapse-like tactile feedback, linear feedback. Hereinafter, the keyswitch structure of the disclosure will be described in detail with reference to the drawings.

Figure 1A:
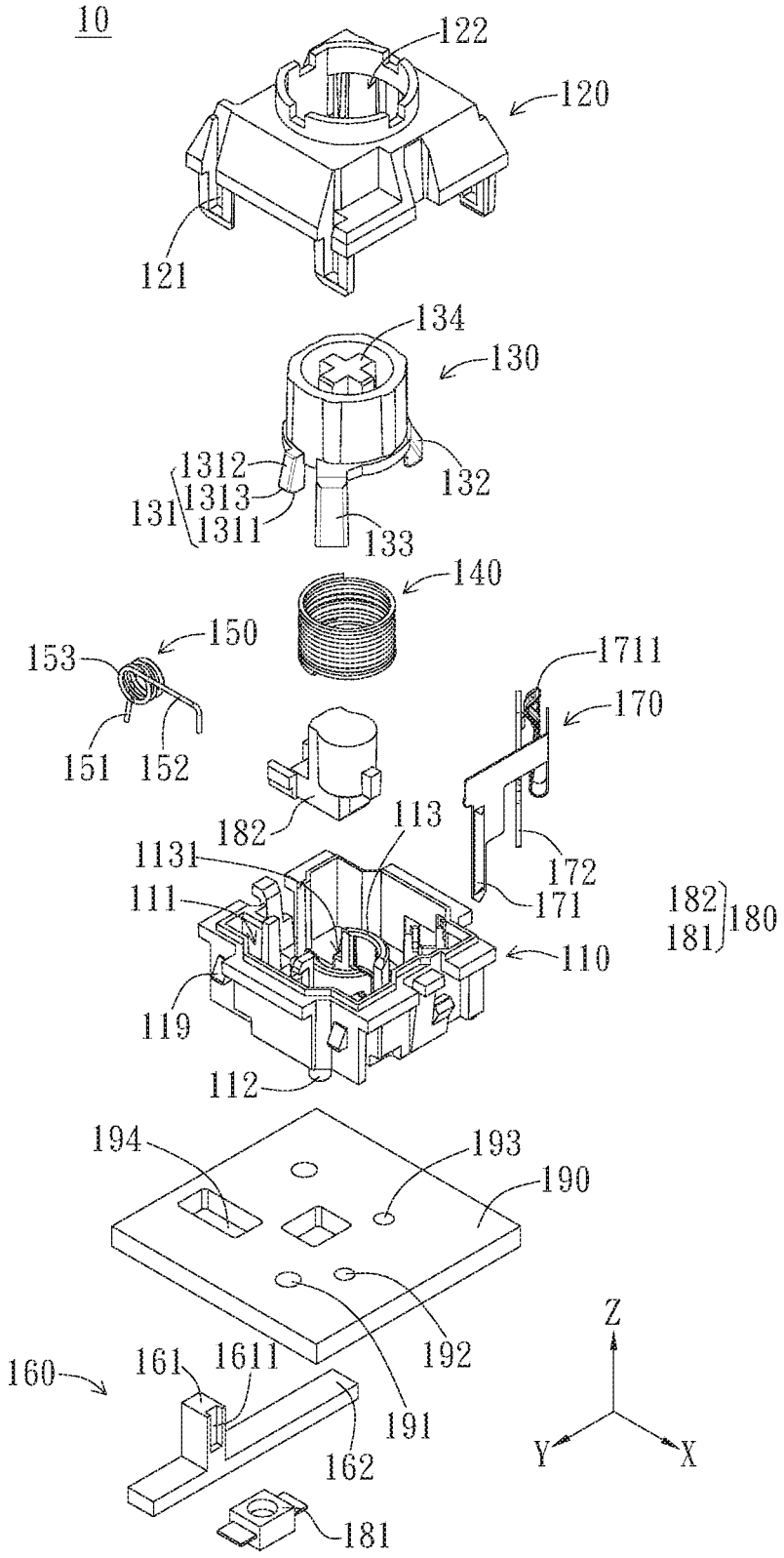
FIGS. 1A and 1B are exploded views of a first embodiment of a keyswitch structure from different viewing angles.
Figure 1B:
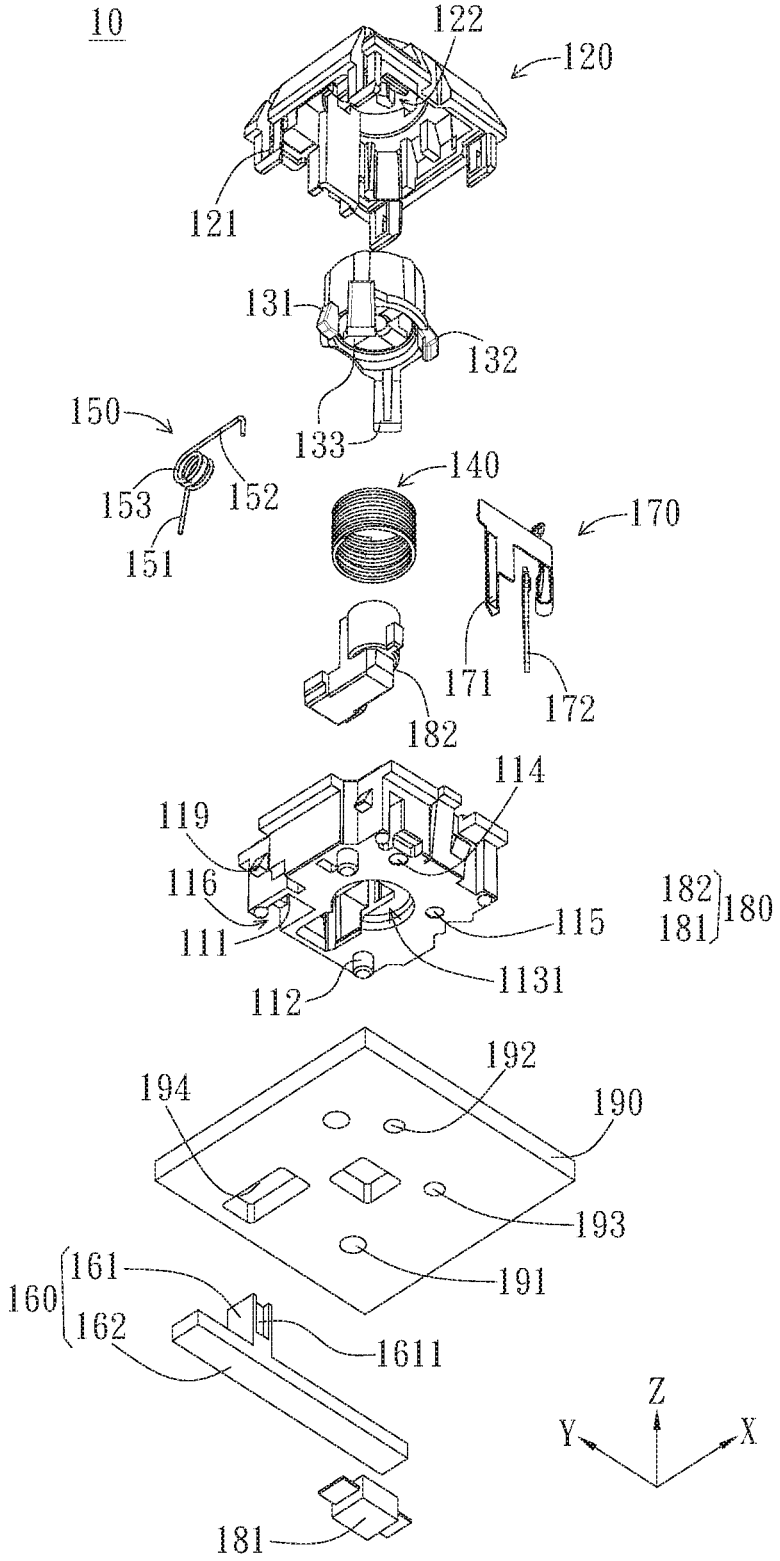
Figure 1C:
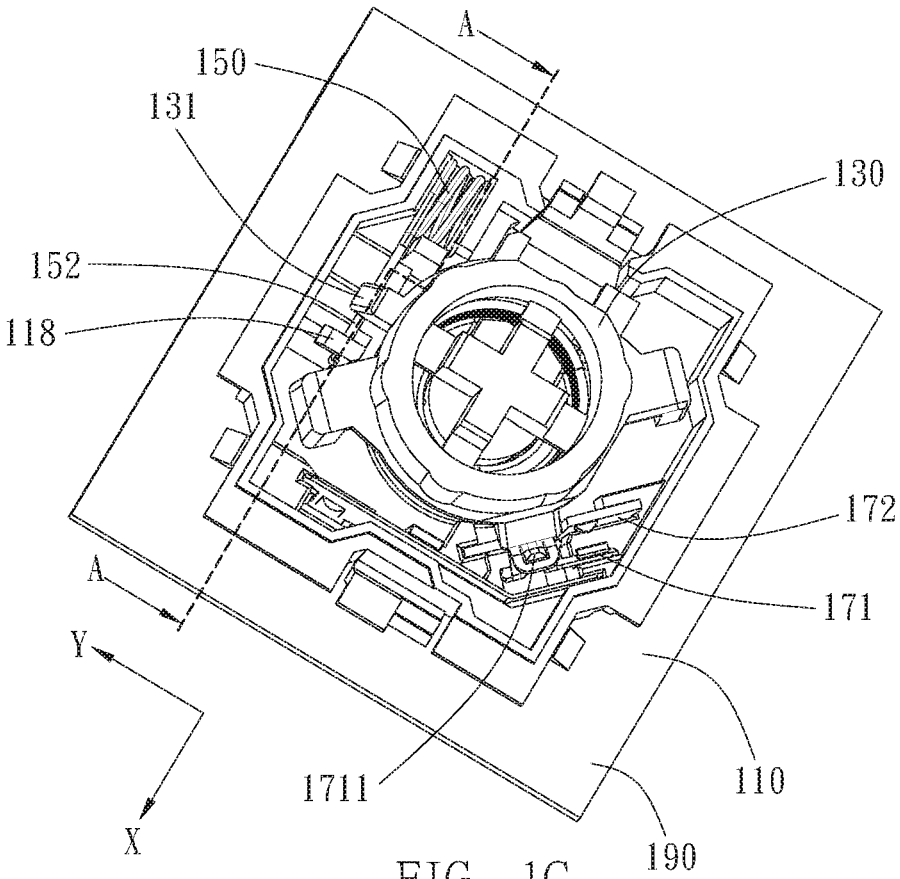
FIG. 1C is an assembly view of FIG. 1A without the cover.

FIGS. 1A and 1B are exploded views of an embodiment of the keyswitch structure of the disclosure from different viewing angles. FIG. 1C is an assembly view of FIG. 1A without the cover. As shown in FIGS. 1A to 1C, in an embodiment, a keyswitch structure 10 includes a base 110, a cover 120, a plunger 130, a restoring unit 140, a tactile feedback member 150, and an adjusting unit 160. The base 110 has a positioning means 111. The cover 120 is combined with the base 110. The plunger 130 is movably received within the cover 120 and capable of moving relative to the base 110. The plunger 130 has a cam portion 131. The restoring unit 140 is disposed between the base 110 and the plunger 130 to provide a restoring force to enable the plunger 130 to move along a direction away from the base 110. The tactile feedback member 150 has a positioning portion 151 and an extending arm 152. The positioning portion 151 is positioned by the positioning means 111, and the extending arm 152 extends across a moving path of the cam portion 131. The adjusting unit 160 is disposed corresponding to the positioning portion 151. The adjusting unit 160 is movable to drive the positioning portion 151 to shift, so that the tactile feedback member 150 has a first deformation or a second deformation, and a pressing force required for the cam portion 131 to pass the extending arm 152 when the plunger 130 moves toward the base 110 is changed.

From another aspect, the adjusting unit 160 is preferably coupled to the positioning portion 151 and selectively positioned at one of the first portion and the second position. When the adjusting unit 160 is positioned at the first position, the positioning portion 151 is driven by the adjusting unit 160 to make the tactile feedback member have the first deformation, so that the extending arm 152 applies a first resistant force against the cam portion 131. When the adjusting unit 160 is positioned at the second position, the positioning portion 151 is driven by the adjusting unit 160 to make the tactile feedback member have the second deformation, so that the extending arm 152 applies a second resistant force against the cam portion 131, and the first resistant force is different from the second resistant force.

The keyswitch structure 10 may further include an electrode module 170, a light source unit 180, a circuit board, a baseplate as appropriate. For example, the electrode module 170 is disposed in the base 110 corresponding to the plunger 130 to function as a switch component. When the plunger 130 moves toward the base 110, the electrode module 170 is triggered to generate a triggering signal. The light source unit 180 includes a light source 181 and a light guide 182 to provide light and enable the keyswitch structure 10 to be a luminous keyswitch.

Specifically, the base 110 can be disposed on the baseplate or the circuit board. In this embodiment, the base 110 is disposed on the circuit board 190 as an example, but not limited thereto. In another embodiment, when the base 110 is disposed on the baseplate, the circuit board can be optionally disposed above or below the baseplate according to practical applications. In an embodiment, the base 110 and the circuit board 190 are preferably positioned by a positioning mechanism. For example, the base 110 can have a positioning post 112, and the circuit board 190 has a corresponding hole 191, so that the base 110 can be positioned on the circuit board 190 by inserting the positioning post 112 into the hole 191, but not limited thereto. In other embodiments, the locations of the positioning post and the hole can be exchanged, or the base 110 can be positioned on the underlying component (e.g. the circuit board 190 or the baseplate) by other suitable manners, such as screwing, adhering, or leaning on.

The base 110 is preferably a base extending toward the X axis, the Y axis, and the Z axis directions, and the cover 120 is formed corresponding to the base 110. The base 110 is preferably combined with the cover 120 to form a housing with an accommodation space for accommodating the restoring unit 140, the tactile feedback member 150, the electrode module 170, and the light source unit 180 therein. For example, the base 110 may have a hook-like portion 119, and the cover 120 has a slot portion 121, so that the base 110 can be combined with the cover 120 along the Z axis direction by engaging the hook-like portion 119 with the slot portion 121.

The cover 120 has an opening 122 with a shape corresponding to the top portion of the plunger 130, so that the plunger 130 can extend from the bottom of the cover 120 to be movably disposed in the opening 122 of the cover 120 with the top portion of the plunger 130 protruding from the opening 122. The plunger 130 preferably has the cam portion 131, an actuating portion 132, a restricting portion 133, and a coupling portion 134. For example, the plunger 130 is preferably a barrel-like object, and the cam portion 131, the actuating portion 132, and the restricting portion 133 are preferably disposed along the periphery of the lower end of the plunger 130. The coupling portion 134 is preferably disposed on the top of the plunger 130.

Specifically, the cam portion 131 includes a bump extending downward. The bump has a lower surface 1311, an upper surface 1312, and a protrudent point 1313 between the lower surface 1311 and the upper surface 1312. For example, the bump can be an angular block, and the lower surface 1311 and the upper surface 1312 are preferably inclined toward each other and connected at the protrudent point 1313. That is, the protrudent point 1313 protrudes outward (e.g. in the Y-axis direction) with respect to the upper surface 1311 and the lower surface 1312. The actuating portion 132 is disposed corresponding to the electrode module 170, and the actuating portion 132 is preferably a block (e.g. angular block) and configured to selectively trigger the electrode module 170 to generate the triggering signal. The restricting portion 133 is preferably a pillar, and two restricting portions 133 radially extend from two opposite sides of the plunger 130, so that the distance between the two pillars is larger than the size of the opening 122 to prevent the plunger 130 from escaping from the cover 120 when the plunger 130 moves relative to the base 110 upwardly. The coupling portion 134 can a cross-shaped protrusion formed on the top of the plunger 130 and is configured to couple a keycap (not shown), but not limited thereto. In other embodiments, the coupling portion 134 can have other configurations (e.g. a coupling hole) to couple the keycap.

Figure 2A:
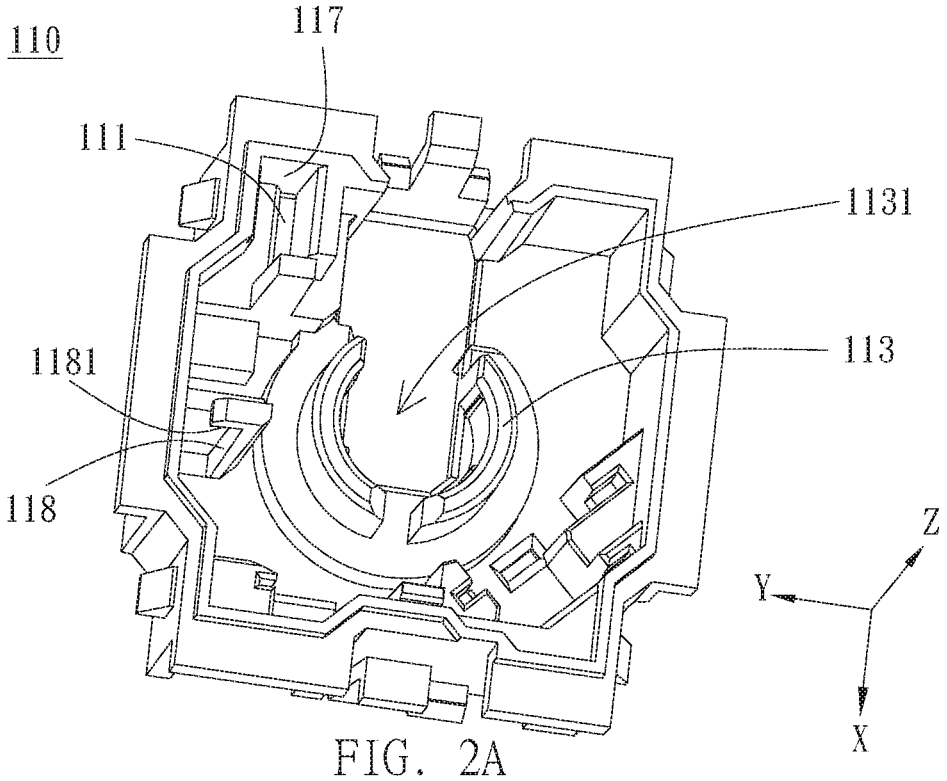
FIGS. 2A to 2C are schematic views of the base of the first embodiment of the keyswitch structure from different viewing angles.
Figure 2B:
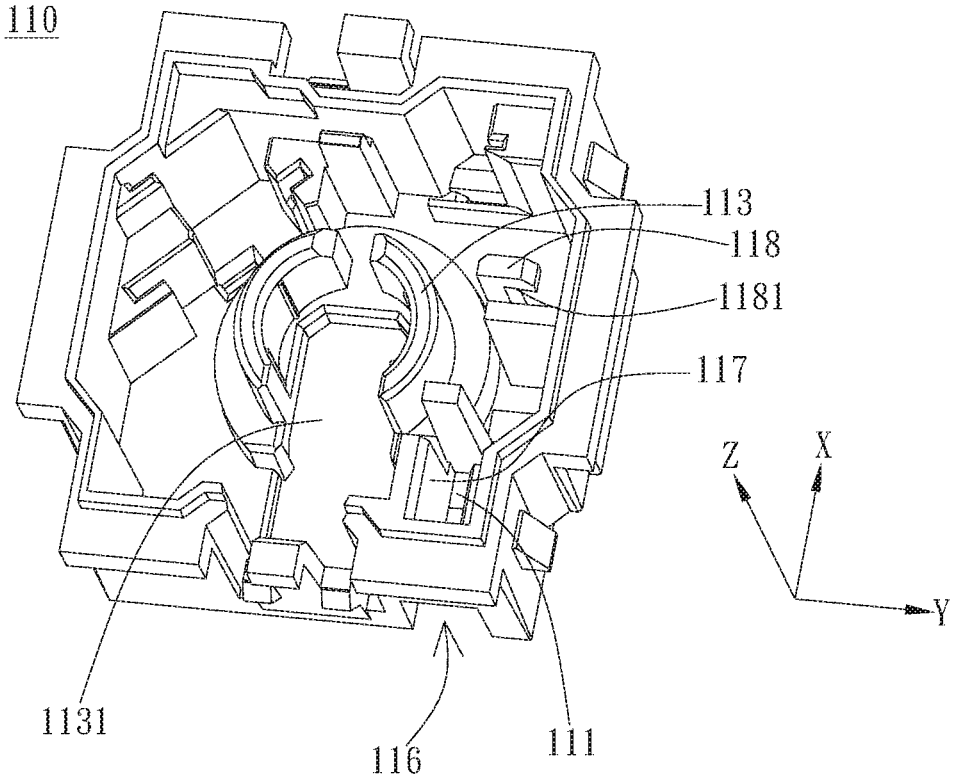
Figure 2C:
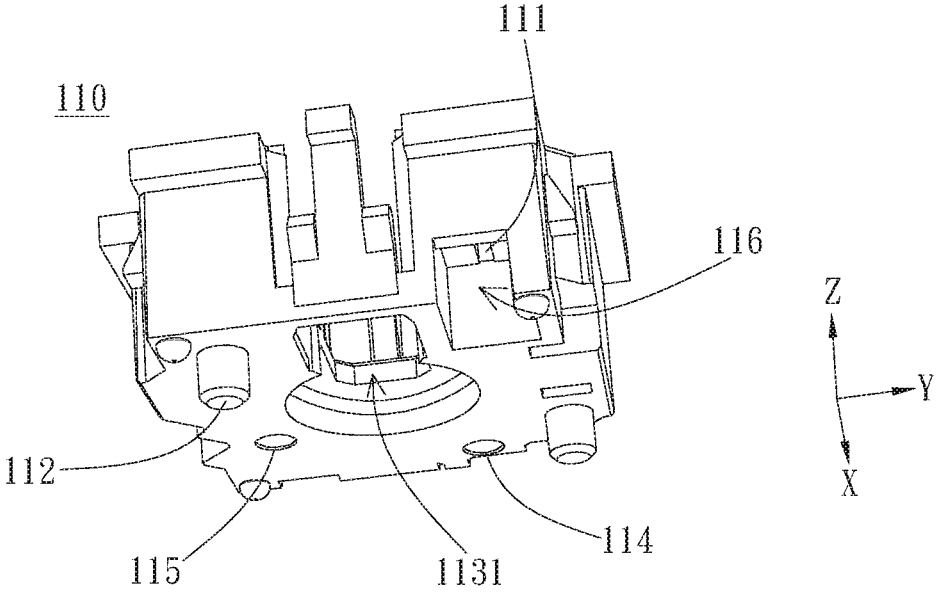

Referring to FIGS. 2A to 2C, the arrangement of components in the base 110 will be described in detail. In this embodiment, the restoring unit 140 is preferably a spring, and the base 110 has a holding portion 113, so the restoring unit 140 can be positioned by the holding portion 113. For example, the holding portion 113 can be a ring-shaped wall extending from the bottom surface of the base 110 toward the cover 120. One and of the spring served as the restoring unit 140 can be sleeved on the ring-shaped wall, and the other end of the spring is against the bottom surface of the plunger 130, so the top portion of the plunger 130 protrudes from the opening 122 of the cover 120. As such, when the keycap is pressed to push the plunger 130 to move toward the base 110, the plunger 130 compresses the spring, and when the pressing force is released, the spring provides the restoring force to enable the plunger 130 to move away from the base 110 to the position before pressing. Moreover, the base 110 preferably has an accommodating portion 1131 corresponding to the light source unit 180. For example, the accommodation portion 1131 can be a space surrounded by the ring-shaped wall to receive the light guide 182 therein. That is, the light guide 182 is positioned in the inner side of the holding portion 113, and the spring is positioned on the outer side of the holding portion 113. The base 110 is preferably formed with an opening at its bottom to communicate with the accommodation portion 1131, so that the light source 181 can be disposed corresponding to the opening under the light guide 182, which is disposed in the accommodation portion 1131, so as to emit light toward the light guide 182. In this embodiment, the light source 181 is preferably a light-emitting diode, but not limited thereto.

In an embodiment, the electrode module 170 includes a first electrode piece 171 and a second electrode piece 172 respectively disposed on the base 110 and electrically connected to the circuit board 190. For example, the base 110 has a first electrode hole 114 and a second electrode hole 115, and the circuit board 190 has a first coupling hole 192 and a second coupling hole 193 corresponding to the first electrode hole 114 and the second electrode hole 115, respectively. Specifically, the first electrode piece 171 and the second electrode piece 172 are preferably inserted into the first electrode hole 114 and the second electrode hole 115 respectively and further protrude out of the base 110 to be electrically connected to the first coupling hole 192 and the second coupling hole 193, but not limited thereto. In other embodiments, the circuit board 190 may not have the coupling holes, and the first electrode piece 171 and the second electrode piece 172 can be electrically connected to surface contact areas of the circuit board 190. In this embodiment, the first electrode piece 171 preferably abuts against the inner wall surface of the base 110, and the second electrode piece 172 is disposed corresponding to the first electrode piece 171. The first electrode piece 171 preferably has a flexible portion 1711 disposed corresponding to the actuating portion 132 of the plunger 130, so in response to the movement of the actuating portion 132, the first electrode piece 171 and the second electrode piece 172 can be selectively contacted to each other and triggered to generate the triggering signal. For example, when the keyswitch structure 10 is at the non-pressed position, the protrudent portion of the actuating portion 132 pushes the flexible portion 1711 outward away from the second electrode piece 172, so the first electrode piece 171 and the second electrode piece 172 are not contacted or conducted, and no triggering signal is generated. When the plunger 130 is pressed and moves toward the base 110, the actuating portion 132 moves downward along with the plunger 130, so the protrudent portion passes over the flexible portion 1711, enabling the flexible portion 1711 to bounce toward the second electrode piece 172. Therefore, the first electrode piece 171 and the second electrode piece 172 are contacted or conducted, and the triggering signal is generated.

It is noted that the electrode module 170 is illustrated as the switch component of the keyswitch structure 10 in the embodiment, but not limited thereto. In another embodiment, the keyswitch structure 10 may have other types of switch component, which selectively generates the triggering signal in response to the movement of the plunger 130. For example, the keyswitch structure 10 can include an emitter and a receiver, which are electrically connected to the circuit board 190 to function as the switch component, i.e. optical switch, so the keyswitch structure 10 can generate the triggering signal by changing the amount of light received by the receiver from the emitter when the plunger 130 moves toward the base 110.

In this embodiment, the tactile feedback member 150 can be implemented as a torsion spring. The positioning portion 151 and the extending arm 152 of the tactile feedback member 150 respectively extend from two opposite ends of the torsion spring. An angle between an extending direction of the positioning portion 151 and an extending direction of the extending arm 152 is preferably equal to or smaller than 120 degrees. For example, the positioning portion 151 and the extending arm 152 are two rods extending from two opposite ends of the spring body 153, and the angle between the extending directions of the two rods is preferably not more than 120 degrees.

As shown in the drawings, the base 110 preferably has a positioning hole or opening to serve as the positioning means 111, which is configured to allow the positioning portion 151 to be inserted therein to position the tactile feedback member 150. In an embodiment, the positioning means 111 is preferably an elongated through hole formed on the bottom of the base 110 along the X-axis direction to allow the positioning portion 151 to shift relative to the positioning means 111. Moreover, corresponding to the positioning means 111, the base 110 preferably further has a receiving portion 116 configured to accommodate the adjusting unit 116. For example, the receiving portion 116 is preferably a notch, which is partially hollowed out from the sidewall adjacent to the positioning means 111 toward the bottom of the base 110. The receiving portion 116 communicates with the positioning means 111, so when the adjusting unit 116 moves in the receiving portion 116, the positioning portion 151 can be pushed to move relative to the positioning means 111, but not limited thereto. In another embodiment, the receiving portion 116 can be an opening, which is formed on the bottom of the base 110 and communicates with the positioning means 111. The base 110 preferably further has an accommodation area 117 configured to accommodate the spring body 153 of the tactile feedback member 150. For example, the accommodation area 117 can be a space defined by a plurality of partition walls to restrict the movement of the tactile feedback member 150. When the adjusting unit 160 pushes the positioning portion 151, the spring body 153 is confined in the accommodation area 117, so the tactile feedback member 150 has a different deformation. The base 110 further includes an impact portion 118, which is configured to be hit by the extending arm 152 to generate a sound. For example, the impact portion 118 can be a wall protruding from the bottom of the base 110 toward the cover 120, and the wall has an impact surface 1181 facing the extending arm 152. When the tactile feedback member 150 is disposed in base 110, the positioning portion 151 is inserted into the positioning means 111, the spring portion 153 is received in the accommodation area 117, and the extending arm 152 extends across the moving path of the cam portion 131 of the plunger 130. That is, the positioning portion 151 is inserted into the positioning means 111 substantially along the Z-axis direction and at least partially located in receiving portion 116, and the extending arm 152 substantially extends along the X-axis direction to pass below the cam portion 131.

In an embodiment, the adjusting unit 160 is preferably disposed corresponding to the tactile feedback member 150. The adjusting unit 160 preferably includes an adjusting bar 161 and a connection portion 162. The connection portion 162 is disposed under the circuit board 190, and the adjusting bar 161 is connected to the connection portion 162 and extends toward the cover 120, e.g. the Z-axis direction. For example, the circuit board 190 has a guiding slot 194 corresponding to the receiving portion 116. The adjusting bar 161 is inserted from bottom of the circuit board 190 into the guiding slot 194 and extends to the receiving portion 116, so the adjusting bar 161 can be coupled to the positioning portion 151, which protrudes from the positioning means 111 to the receiving portion 116. When the adjusting unit 160 moves, the adjusting bar 161 drives the positioning portion 111 to shift, so the tactile feedback member 150 can have a different deformation. In an embodiment, the adjusting bar 161 preferably has a groove 1611. The groove 1611 is preferably disposed along the lengthwise direction of the adjusting bar 161 (e.g. the Z-axis direction) corresponding to the longitudinal direction of the positioning portion 151. For example, the groove 1611 can be an open channel formed on the wall surface of the adjusting bar 161 facing the positioning portion 151 (e.g. parallel to the X-Z plane). Therefore, when the positioning portion 151 is positioned by the positioning means 111, e.g. inserted into the positioning hole, at least a portion of the positioning portion 151 is received in the groove 1611 to enhance the linkage of the adjusting bar 161 and the positioning portion 151, so as to reduce the possibility of the positioning portion 151 escaping from the adjusting bar 161, but not limited thereto. In another embodiment, the groove 1611 can be a hole extending downward from the top surface of the adjusting bar 161 (e.g. parallel to the X-Y plane), so the positioning portion 151 can be inserted into the adjusting bar 161. According to practical applications, the adjusting bar 161 may not have the groove 1611, and the positioning portion 151 is coupled to the adjusting bar 161 by abutting against the wall surface of the adjusting bar 161.

Figure 3A:
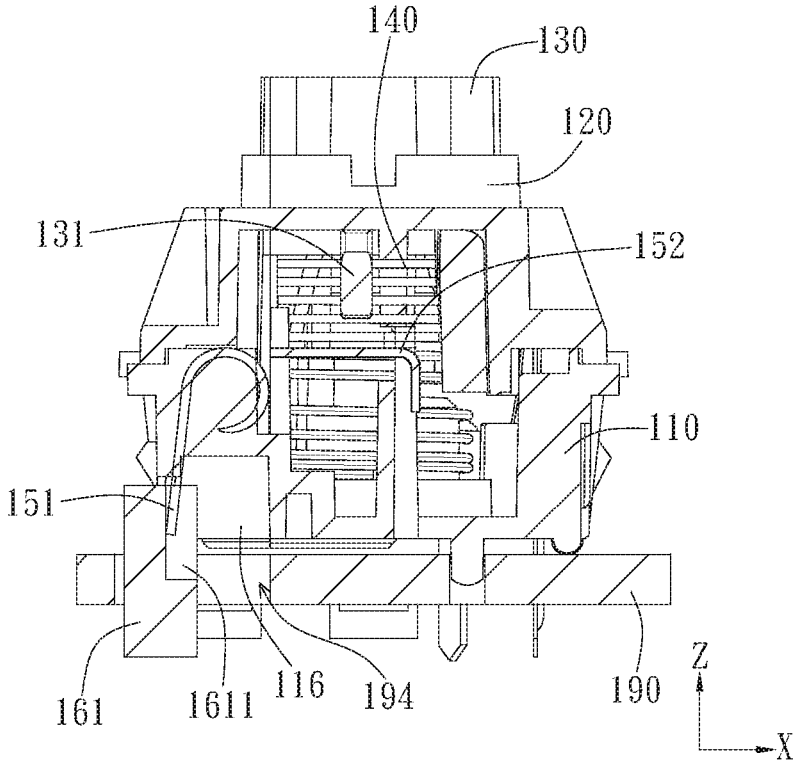
FIGS. 3A and 3B are cross-sectional views of the keyswitch structure of FIG. 1C along the cutting line AA with the adjusting unit at different positions.
Figure 3B:
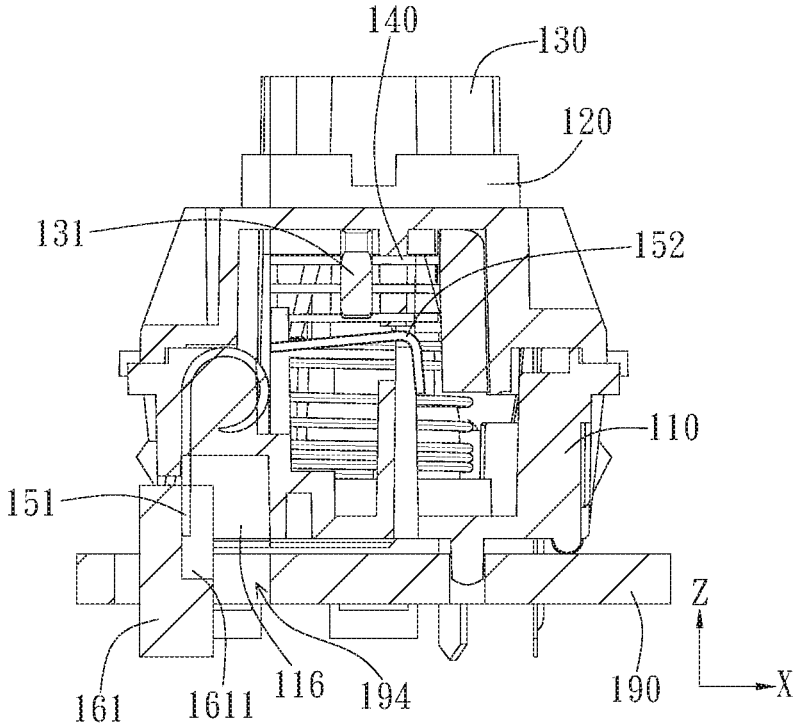

Referring to FIGS. 3A and 3B, the operation of the keyswitch structure 10 adjusting the tactile feedback by using the adjusting unit 160 is illustrated, wherein FIGS. 3A and 3B are cross-sectional views of FIG. 1C along the cutting line AA with the adjusting unit 160 at different positions. As shown in FIG. 3A, when the tactile feedback member 150 is disposed on the base 110, the spring portion 153 is located in the accommodation area 117, the positioning portion 151 is positioned by the positioning means 111, e.g. inserted into the positioning hole, and coupled to the adjusting bar 161, for example at least partially inserted into the groove 1611, and the extending arm 152 extends below the cam portion 131. In this embodiment, the adjusting unit 160 is preferably movable toward the extending direction of the extending arm 152 (e.g. the X-axis direction), so as to change the deformation of the tactile feedback member 150 and in turn to change the default stress of the tactile feedback member 150. As shown in FIG. 3B, when the adjusting unit 161 moves along the X-axis direction, the adjusting bar 161 drives the positioning portion 151 to shift relative to the positioning means 111 along the X-axis direction, so the positioning portion 151 and the extending arm 152 are changed in position relative to the spring portion 153, i.e. the deformation is changed. In other words, the default stress of the spring portion is changed, so that the action of the cam portion 131 and the tactile feedback member 150 is correspondingly changed to provide a different tactile feedback, such as different required pressing forces, dome-collapse-like tactile feedback, or linear feedback. In sum, when the adjusting unit 160 moves by different distances along the X-axis direction, the torsion spring can have different default stresses, or the position of the extending arm 152 relative to the moving path of the cam portion 131 is different, so as to provide different kinds of tactile feedback.

Figure 4A:
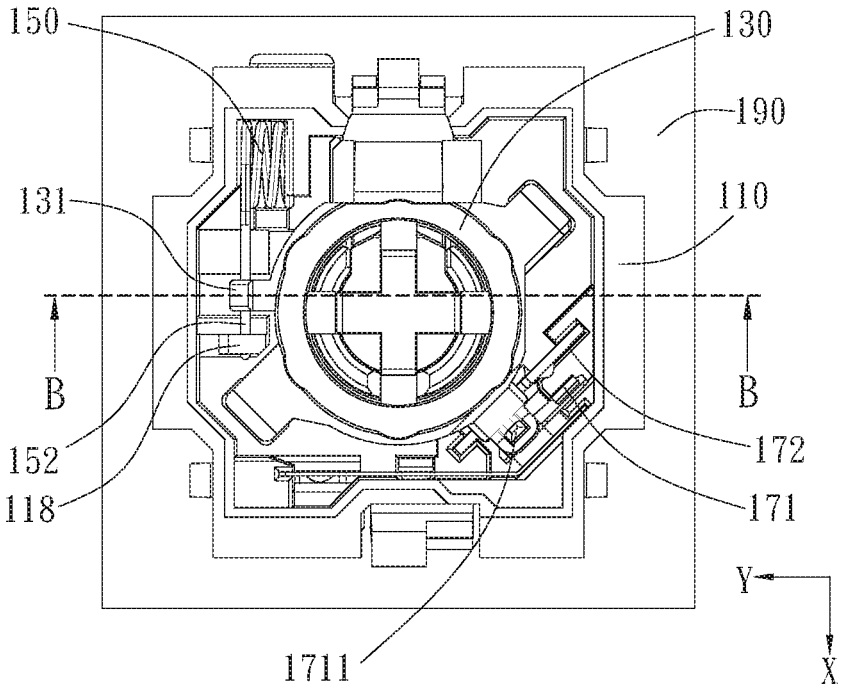
FIGS. 4A and 4B are a top view of the keyswitch structure of FIG. 1A at the first status and a cross-sectional view of the keyswitch structure along the cutting line BB, respectively.
Figure 4B:
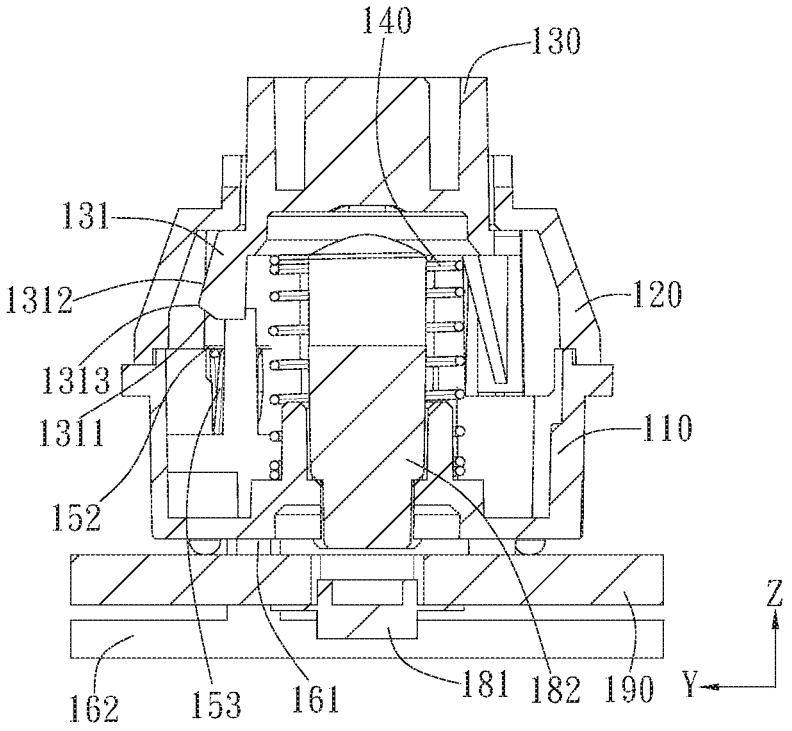

Hereinafter, the moving distance of the adjusting unit 160 along the X-axis direction and the corresponding tactile feedback provided by the keyswitch structure 10 will be described with reference to the drawings. FIGS. 4A and 4B are a top view of the keyswitch structure 10 of FIG. 1A at the first status and a cross-sectional view along the cutting line BB, respectively. As shown in FIGS. 4A and 4B, when the keyswitch structure 10 is at the first status, the adjusting unit 160 is coupled to the positioning portion 151 and is located at a first position in the X-axis direction. In this configuration, the tactile feedback member 150 has a first deformation, and the pressing force required for the cam portion 131 to pass the extending arm 152 is a first pressing force, i.e. the extending arm applies a first resistant force against the cam portion 131. For example, the first position can refer to a position of the adjusting unit 160 when the keyswitch structure 10 is at a default state, so the first pressing force can be the default pressing force. When the adjusting unit 160 is at the first position, the extending arm 152 preferably extends across the moving path of the cam portion 131 when moving downward, i.e. the moving path is parallel to the Z-axis direction, and the extending arm 152 is at a first position relative to the moving path. When the adjusting unit 160 is at the first position, and the first pressing force is exerted to enable the plunger 130 along with the cam portion 131 to move toward the base 110, the extending arm 152 firstly moves downward along the lower surface 1311 to the protrudent point 1313, and then passes the protrudent point 1313 to move upward and hit the base 110 or the cover 120 to generate a sound, such as a first sound. In other words, when the tactile feedback member 150 has the first deformation, and the pressing force exerted to the plunger 130 is large enough, e.g. not less than the first pressing force, to overcome the first resistant force that the extending arm 152 applies against the cam portion 131, the extending arm 152 firstly moves along the lower surface 1311 for a first distance to the protrudent point 1313, and then passes the protrudent point 1313 to move upward away from the bump. It is noted that when the extending arm 152 reaches the protrudent point 1313, the extending arm 152 has a first sound distance from an impact surface of the base 110 or the cover 120, and then the extending arm 152 hits the impact surface to generate the first sound. In this embodiment, the impact surface can be a wall surface of the cover 120 or the base 110 that corresponds to the extending arm 152, such as the impact surface 1181 of the impact wall 118 of the base 110.

Figure 5A:
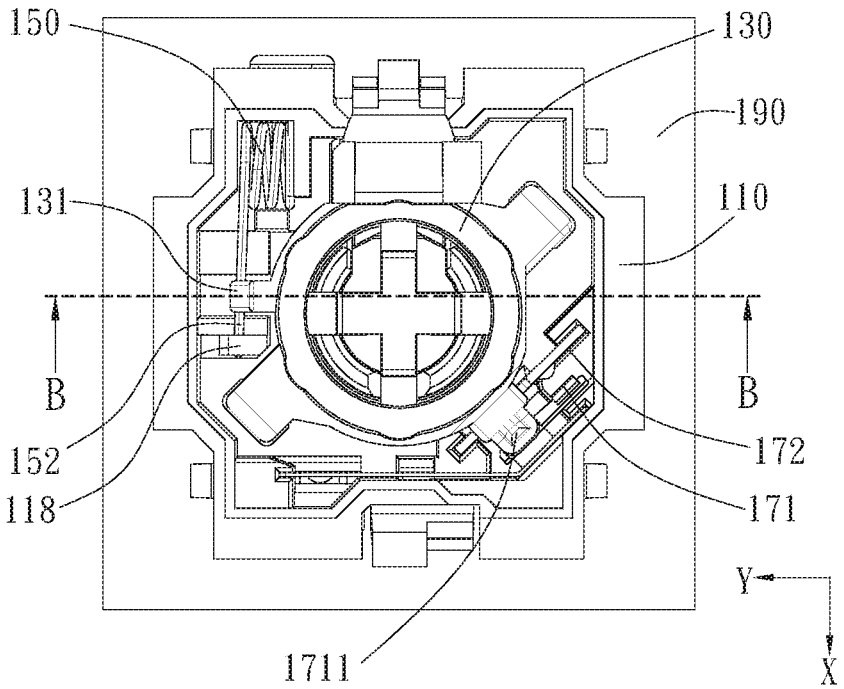
FIGS. 5A and 5B are a top view of the keyswitch structure of FIG. 1A at the second status and a cross-sectional view of the keyswitch structure along the cutting line BB, respectively.
Figure 5B:
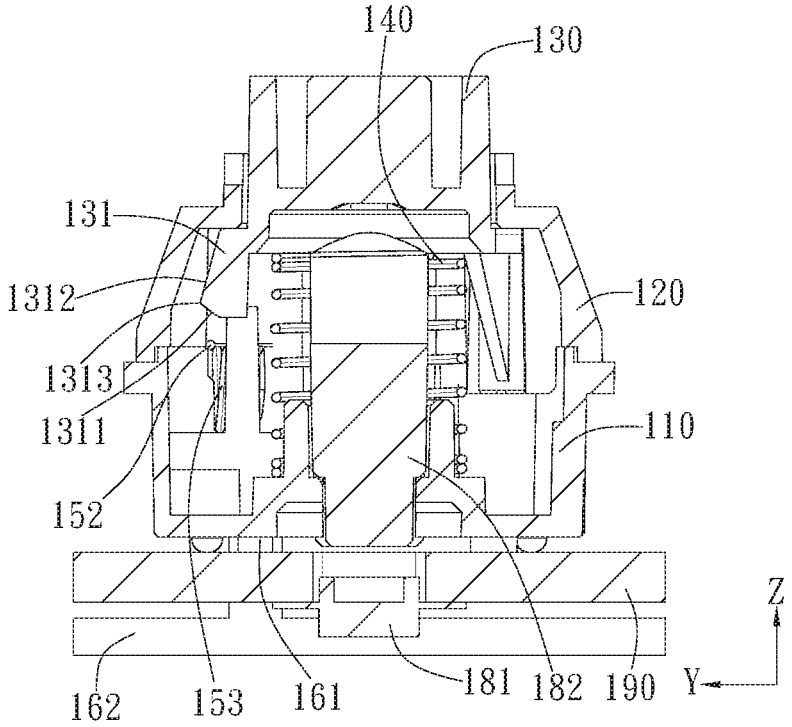

FIGS. 5A and 5B are a top view and a cross-sectional view of the keyswitch structure 10 of FIG. 1A at the second status, respectively. As shown in FIGS. 5A and 5B, when the keyswitch structure 10 is at the second status, the adjusting unit 160 is coupled to the positioning portion 151 and is located at a second position in the X-axis direction. In this configuration, the tactile feedback member 150 has a second deformation, and the pressing force required for the cam portion 131 to pass the extending arm 152 is a second pressing force, i.e. the extending arm 152 applies a second resistant force against the cam portion 131. For example, the second position of the adjusting unit 160 can be closer to the cam portion 131 than the first position. That is, the adjusting bar 161 moves toward the inner side of the base 110 and pushes the positioning portion 151 inwardly in the X-axis direction, so the stress of the tactile feedback member 150 is increased. When the adjusting unit 160 is at the second position, the extending arm 152 preferably extends across the moving path of the cam portion 131 when the cam portion 131 moves downward, and the extending arm 152 is at a second position relative to the moving path. Specifically, the second position of the extending arm 152 is closer to the outer side of the base 110 than the first position of the extending arm 152, i.e. closer to the protrudent point 1313 of the cam portion 131 in the Y-axis direction. When the adjusting unit 160 is at the second position, and the second pressing force is exerted to enable the plunger 130 along with the cam portion 131 to move toward the base 110, the extending arm 152 firstly moves downward along the lower surface 1311 to the protrudent point 1313, and then passes the protrudent point 1313 to move upward and hit the base 110 or the cover 120 to generate a sound, such as a second sound. In other words, when the tactile feedback member 150 has the second deformation, and the pressing force exerted to the plunger 130 is large enough, e.g. not less than the second pressing force, to overcome the second resistant force that the extending arm 152 applies against the cam portion 131, the extending arm 152 firstly moves along the lower surface 1311 for a second distance to the protrudent point 1313, and then passes the protrudent point 1313 to move upward away from the bump. In this embodiment, the second position of the extending arm 152 is closer to the protrudent point 1313 than the first position of the extending arm 152, and accordingly, the first distance is larger than the second distance. It is noted that when the extending arm 152 reaches the protrudent point 1313, the extending arm 152 has a second sound distance from the impact surface, and then the extending arm 152 hits the impact surface to generate the second sound.

Particularly, when the adjusting unit 160 is at the first position or the second position, the default stress of the tactile feedback member 150 is preferably within a range that the cam portion 131 is able to push the extending arm 152 downwardly. Therefore, when a sufficient pressing force, such as the first pressing force or the second pressing force, is exerted to the plunger 130, in response to the downward pushing force of the cam portion 131, the extending arm 152 firstly moves downward along the lower surface 1311 to the protrudent point 1313, and then passes the protrudent point 1313 to move upward because of the rebound force and hit the impact surface of the base 110 or the cover 120 (e.g. the impact surface 1181) to generate the sound. It is noted that the position of the extending arm 152 relative to the moving path when the adjusting unit 160 is at the second position is different from the position of the extending arm 152 relative to the moving path when the adjusting unit 160 is at the first position. That is, the first sound distance between the extending arm 152 and the impact surface 1181 when the adjusting unit 160 is at the first position is different from the second sound distance between the extending arm 152 and the impact surface 1181 when the adjusting unit 160 is at the second position. For example, when the adjusting unit 160 moves from the first position to the second position, the adjusting bar 161 pushes the positioning portion 151 of the tactile feedback member 150 to shift, so the deformation of the tactile feedback member 150 is changed from the first deformation to the second deformation, and the default stress of the tactile feedback member 150 is increased from the first stress to the second stress. As such, the downward moving distance of the extending arm 152 at the first position pushed by the cam portion 131 is larger than that of the extending arm 152 at the second position pushed by the cam portion 131. That is, the first sound distance is larger than the second sound distance, so the first sound is louder than the second sound. In sum, when the default stress caused by the deformation of the tactile feedback member 150 is larger, the displacement of the extending arm 152 relative to the impact surface 1811 is smaller, so the generated sound will be smaller.

Figure 6A:
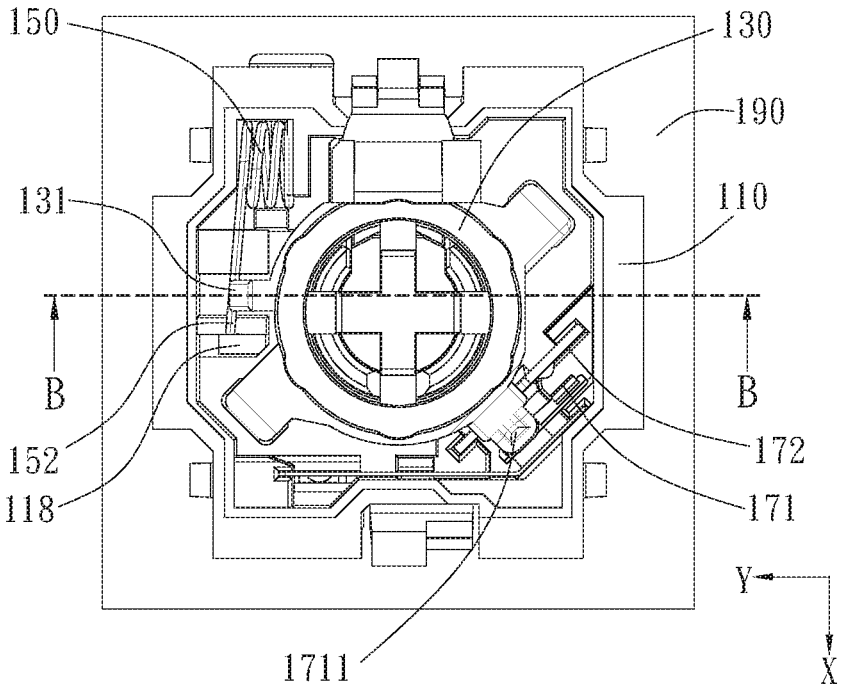
FIGS. 6A and 6B are a top view of the keyswitch structure of FIG. 1A at the third status and a cross-sectional view of the keyswitch structure along the cutting line BB, respectively.
Figure 6B:
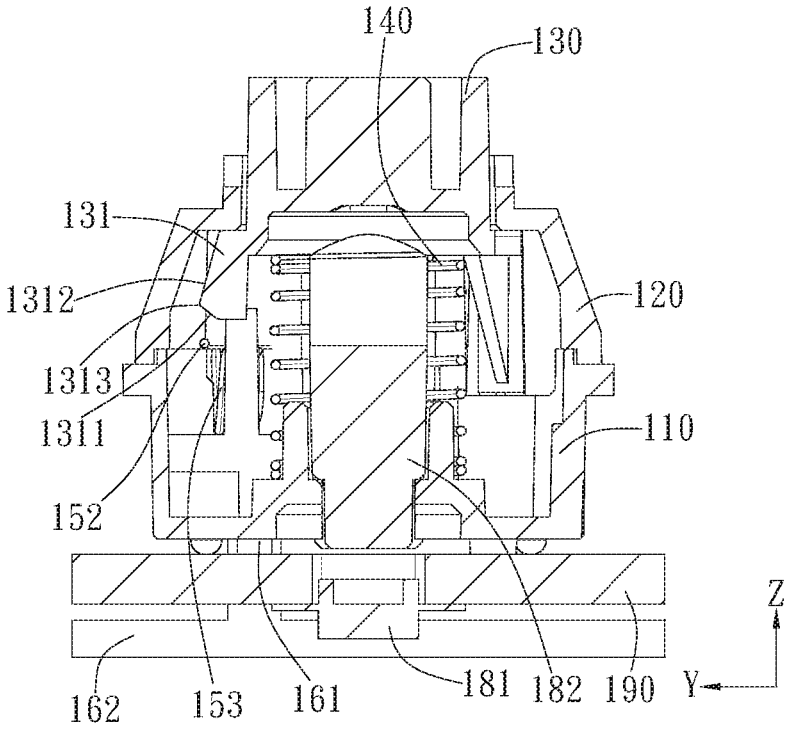

Moreover, when the distance of the adjusting unit 160 moving toward the inner side of the base 110 is larger, the relative displacement of the positioning portion 151 is larger, so the default stress of the torsion spring is larger. When the default stress of the torsion spring is increased to a certain degree, the plunger 130 does not push the extending arm 152 downwardly, but pushes the extending arm 152 laterally to provide a dome-collapse-like tactile feedback. FIGS. 6A and 6B are a top view of the keyswitch structure 10 of FIG. 1A at the third status and a cross-sectional view along the cutting line BB, respectively. As shown in FIGS. 6A and 6B, when the keyswitch structure 10 is at the third status, the adjusting unit 160 is coupled to the positioning portion 151 and is located at a third position in the X-axis direction. In this configuration, the tactile feedback member 150 has a third deformation, and the extending arm 152 is at a third position relative to the moving path of the cam portion 131. Specifically, the third position of the adjusting unit 160 can be closer to the inner side of the base 110 than the second position in the X-axis direction, so the third position of the extending arm 152 preferably substantially corresponds to the protrudent point 1313 of the cam portion 131. That is, the adjusting bar 161 moves farther toward the inner side of the base 110 and pushes the positioning portion 151 farther inwardly in the X-axis direction, so that the stress of the tactile feedback member 150 is further increased, and the cam portion 131 does not push the extending arm 152 downwardly. When the adjusting unit 160 is at the third position and the pressing force is exerted to the plunger 130 to enable the plunger 130 to move toward the base 110, the cam portion 131 pushes the extending arm 152 to move along the Y-axis direction away from the moving path to generate a dome-collapse-like tactile feedback. During the operation, since the cam portion 131 does not push the extending arm 152 downwardly, the extending arm 152 only moves laterally without bouncing upwardly to hit the impact surface 1181, and no impact sound is generated.

Figure 7A:
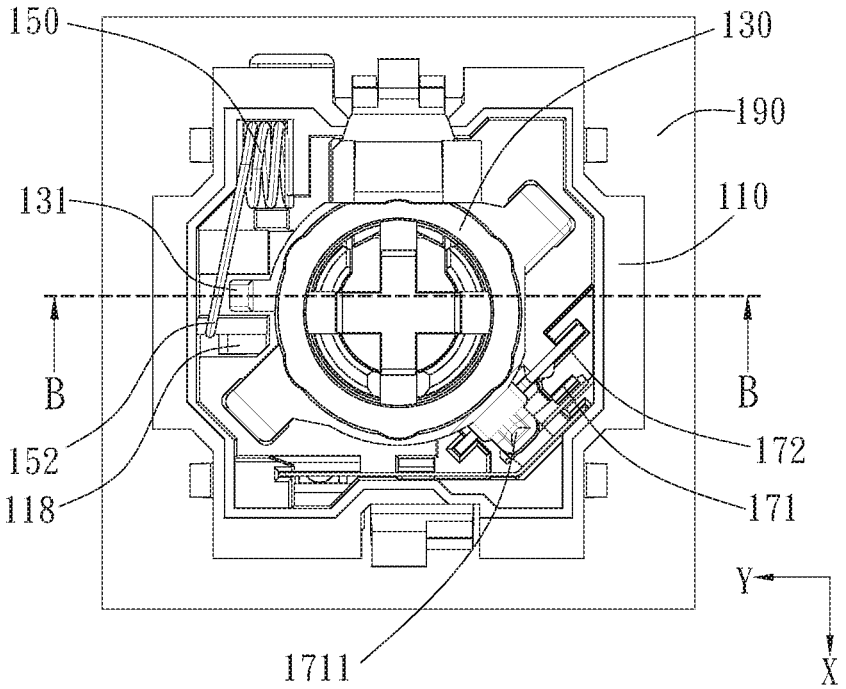
FIGS. 7A and 7B are a top view of the keyswitch structure of FIG. 1A at the fourth status and a cross-sectional view of the keyswitch structure along the cutting line BB, respectively.
Figure 7B:
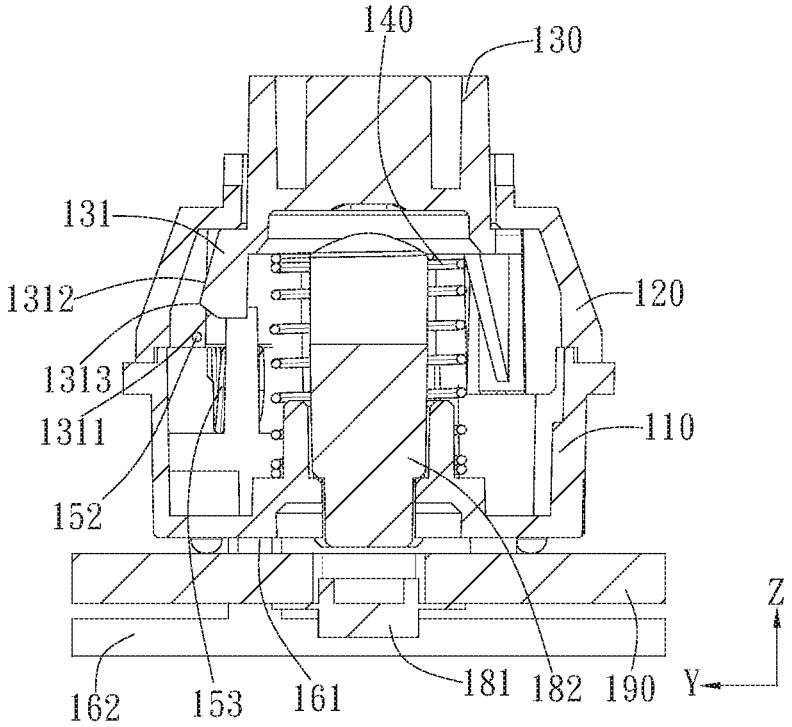

Moreover, when the distance of the adjusting unit 160 moving toward the inner side of the base 110 is large enough to deform the tactile feedback member 150 and shift the position of the extending arm 152 outside the moving path of the cam portion 131, the keyswitch structure 10 can provide a linear feedback. FIGS. 7A and 7B are a top view of the keyswitch structure 10 of FIG. 1A at the fourth status and a cross-sectional view along the cutting line BB, respectively. As shown in FIGS. 7A and 7B, when the keyswitch structure 10 is at the fourth status, the adjusting unit 160 is coupled to the positioning portion 151 and is located at a fourth position in the X-axis direction. In this configuration, the tactile feedback member 150 has a fourth deformation, and the extending arm 152 is located at a fourth position relative to the moving path of the cam portion 131. For example, the fourth position of the adjusting unit 160 can be closer to the inner side of the base 110 than the third position in the X-axis direction. That is, the adjusting bar 161 moves much farther toward the inner side of the base 110 and pushes the positioning portion 151 farther inwardly in the X-axis direction, so the stress of the tactile feedback member 150 is further increased, and the extending arm 152 displaces toward the Y-axis direction to be located outside the moving path of the cam portion 131. Specifically, when the adjusting unit 160 is at the fourth position, the extending arm 152 is located outside the moving path at the fourth position. When the plunger 130 moves toward the base 110, the cam portion 131 moves along the moving path without interfering with the extending arm 152, and a linear feedback is provided.

It is noted that the embodiments of FIGS. 4A to 7B are illustrated according to the positions of the adjusting unit 160 moving sequentially toward the inner side of the base 110 along the X-axis direction, but not limited thereto. In another embodiment, the adjusting unit 160 can move toward the outer side of the base 110 along the X-axis direction to different positions, and the positioning portion 151 can move toward the outer side of the base 110 with the adjusting unit 160 by the elastic restoring force and have deformation varying with the position of the adjusting unit 160 in the X-axis direction to provide a corresponding tactile feedback. Specifically, according to practical applications, the keyswitch structure 10 can selectively provide two or more kinds of tactile feedback by controlling the position of the adjusting unit 160 in the X-axis direction. That is, the adjusting unit 160 can move toward the inner side or the outer side of the base 110 in the X-axis direction to selectively control the adjusting unit 260 located at (1) a position that the deformation (or default stress) of the tactile feedback member 150 can allow the extending arm 152 to generate a displacement in the Z-axis direction and hit the impact surface 1181 to generate a sound when the plunger 130 moves downward, and the cam portion 131 pushes the extending arm 152 downwardly, such as the first position, the second position, or any suitable position before reaching the third position in the X-axis direction, so as to provide tactile feedbacks of different resistant forces with sounds of different volume, (2) a position that the deformation (or default stress) of the tactile feedback member 150 can allow the cam portion 131 to push the extending arm 152 laterally away from the moving path when the plunger 130 moves downward along with the cam portion 131, such as the third position in the X-axis direction, to provide the dome-collapse-like tactile feedback, or (3) a position that the deformation (or default stress) of the tactile feedback member 150 can allow the extending arm 152 to be outside the moving path, so that the cam portion 131 does not interfere with the extending arm 152 when the plunger 130 moves toward the base 110 along with the cam portion 131, such as the fourth direction in the X-axis direction, to provide a soundless linear feedback.

Figure 8A:
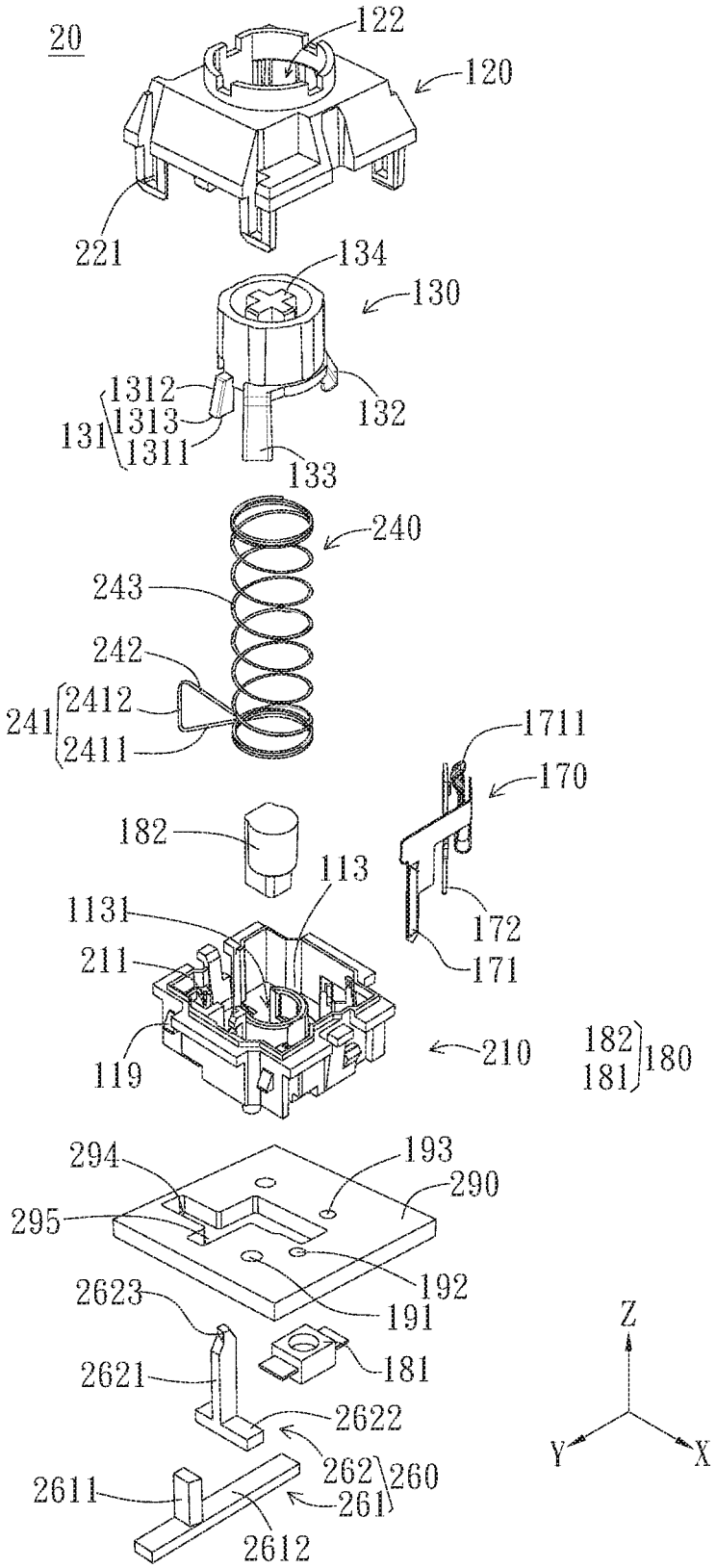
FIGS. 8A and 8B are exploded views of a second embodiment of the keyswitch structure from different viewing angles.
Figure 8B:
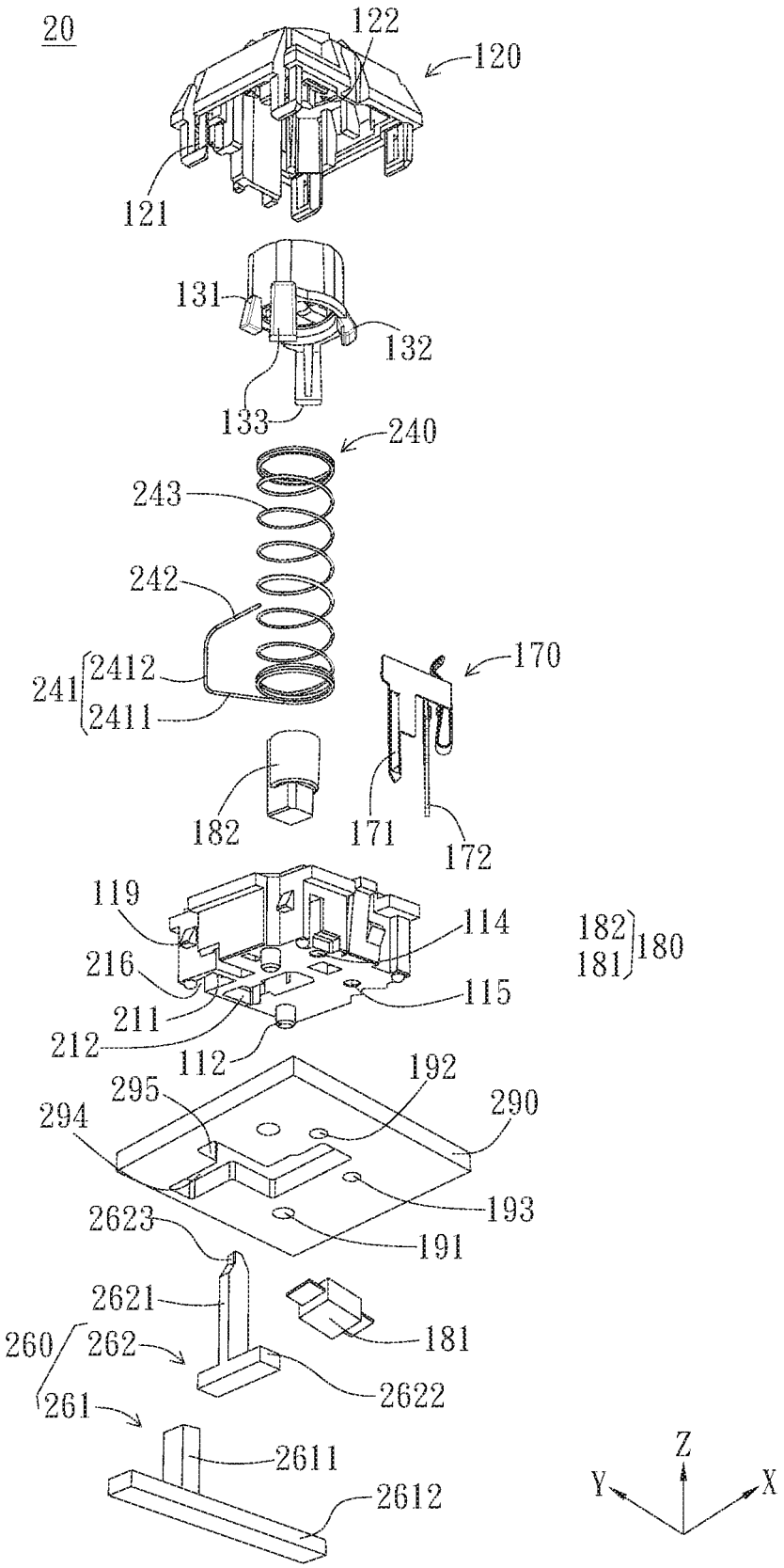
Figure 8C:
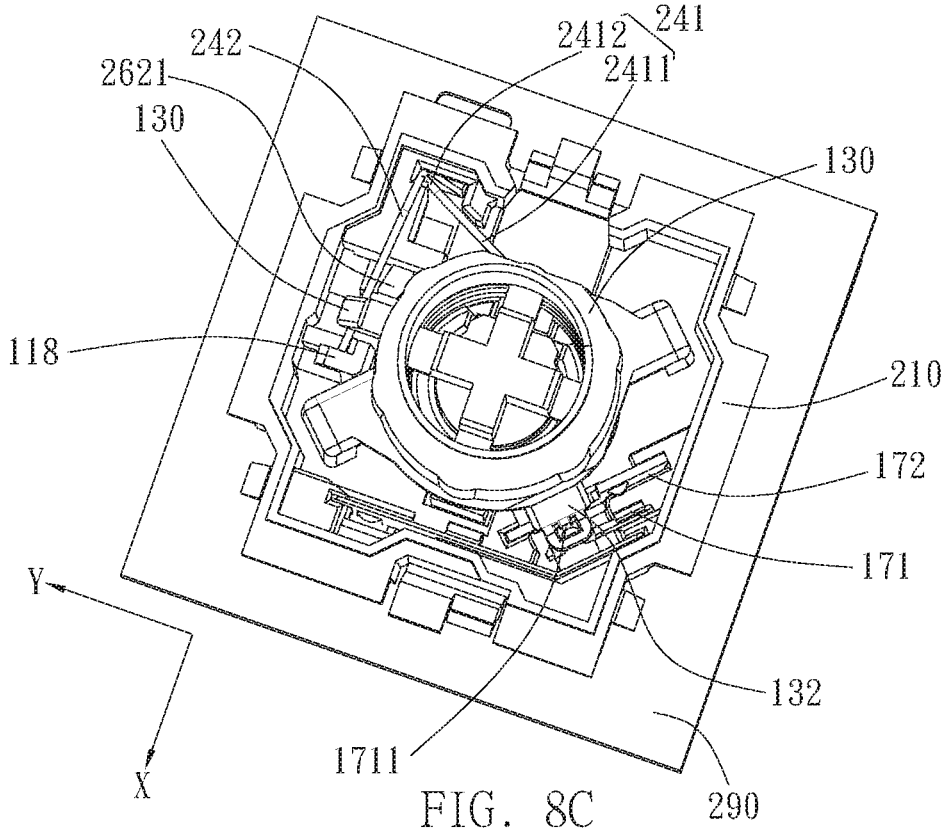
FIG. 8C is an assembly view of FIG. 8A without the cover.
Figure 9A:
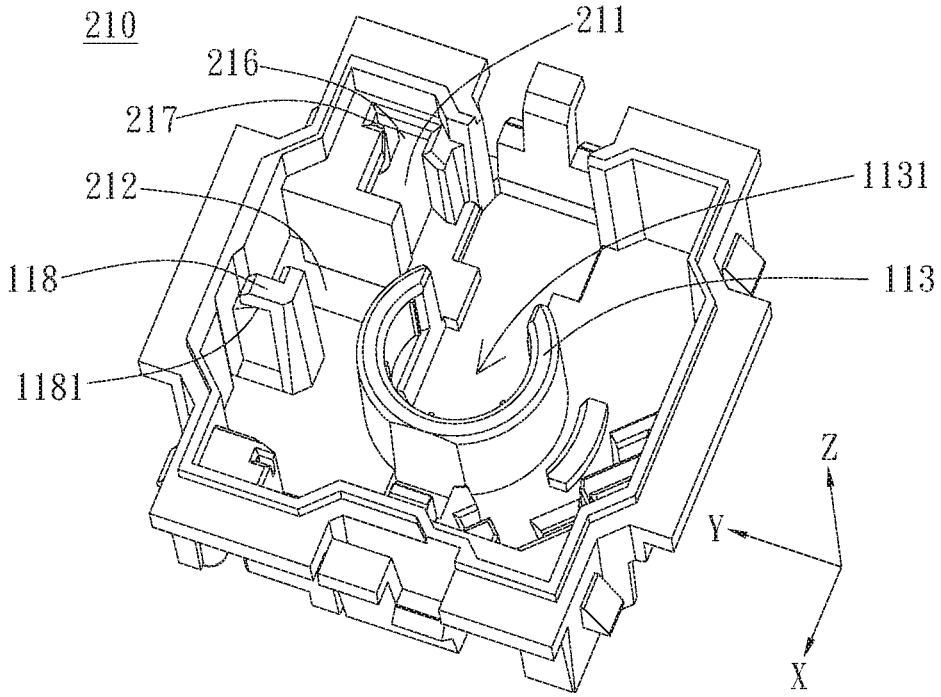
FIGS. 9A to 9C are schematic views of the base of the second embodiment of the keyswitch structure from different viewing angles.
Figure 9B:
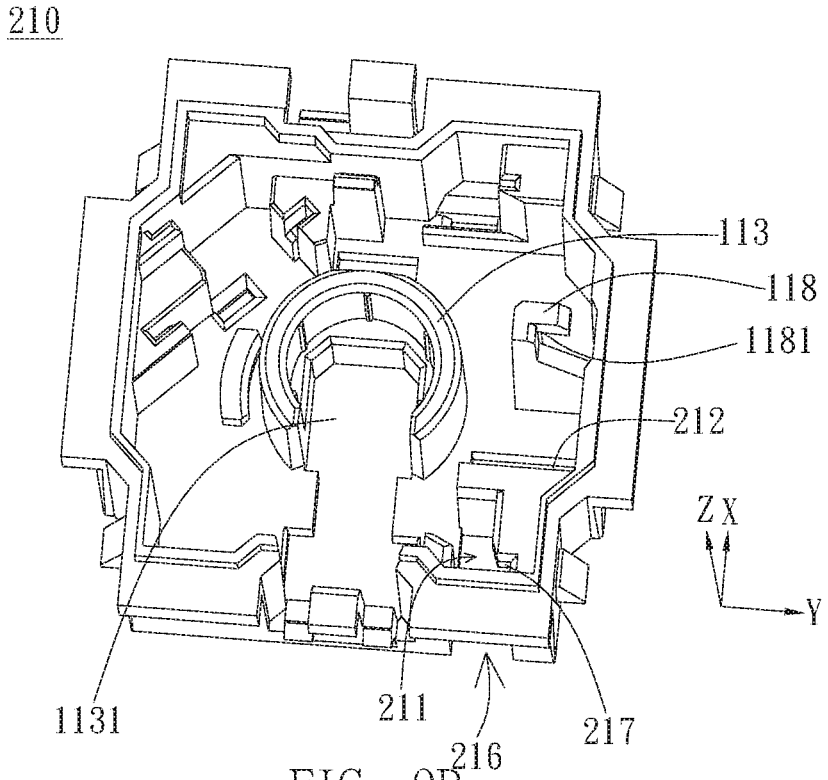
Figure 9C:
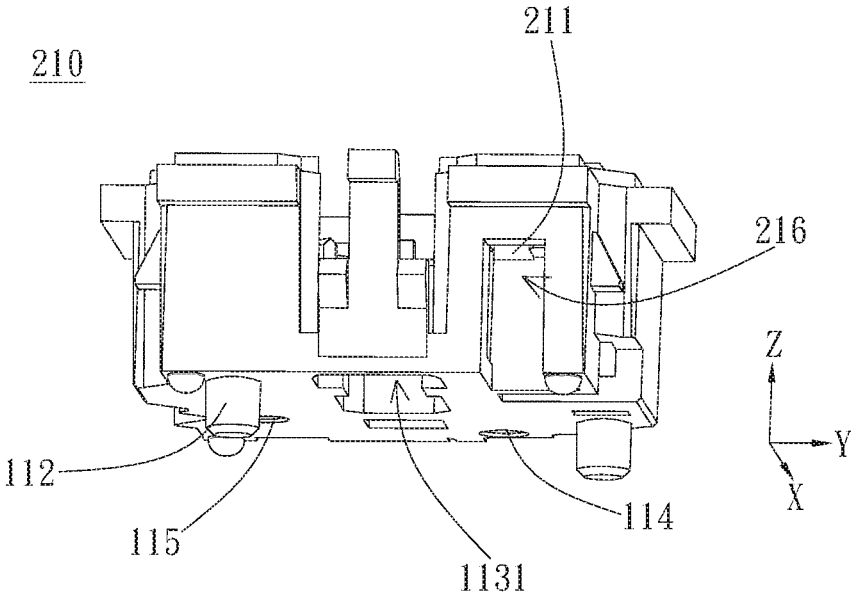

In the above embodiment, the restoring unit and the tactile feedback member are separate components, but not limited thereto. In another embodiment, the restoring unit and the tactile feedback member can be integrated into an integral single component. FIGS. 8A and 8B are exploded views of another embodiment of the keyswitch structure of the disclosure from different viewing angles, and FIG. 8C is an assembly view of FIG. 8A without the cover. As shown in FIGS. 8A to 8C, a keyswitch structure 20 includes a base 210, a cover 120, a plunger 130, a resilient member 240, and an adjusting unit 260. The keyswitch structure 20 may further include an electrode module 170, a light source unit 180, a circuit board (e.g. 290), a baseplate as appropriate. In this embodiment, the cover 120, the plunger 130, the electrode module 170, and the light source unit 180 are identical or similar in structure or connection to the embodiment of FIG. 1A. For example, the cover 120 has a slot portion 121 and an opening 122. The plunger 130 preferably has a cam portion 131, an actuating portion 132, a restricting portion 133, and a coupling portion 134. The electrode module 170 includes a first electrode piece 171 and a second electrode piece 172, and the first electrode piece 171 has a flexible portion 1711. The light source unit 180 includes a light source 181 and a light guide 182. It is noted that the structure and connection of the cover 120, the plunger 130, the electrode module 170, and the light source unit 180 can refer to the related descriptions of the embodiment of FIG. 1A, and will not be elaborated again. In this embodiment, the electrode module 170 can be replaced with other types of switch component, such as optical switch as described above. Moreover, similar to the embodiment of FIG. 1A, the base 210 can have a positioning post 112, a holding portion 113, an accommodating portion 1131, a first electrode hole 114, a second electrode hole 115, an impact portion 118, and a hook-like portion 119 to correspond to the cover 120, the electrode module 170, and the light source 180, and the structure and connection thereof can refer to related descriptions of the embodiment of FIG. 1A. Hereinafter, the differences of the base 210, the resilient member 240, the adjusting unit 260, and the circuit board 190 from the embodiment of FIG. 1A will be illustrated.

In this embodiment, the resilient member 240 includes a spring portion 243, a positioning portion 241, and an extending arm 242. The spring portion 243 is disposed between the base 210 and the plunger 130 to provide a restoring force to enable the plunger 130 to move along a direction away from the base 210. The positioning portion 241 is connected to the spring portion 243 and the extending arm 242. The positioning portion 241 is positioned by the positioning means 211, and the extending arm 242 extends corresponding to the cam portion 131. Moreover, the adjusting unit 260 is preferably disposed corresponding to the tactile feedback member constructed by the positioning portion 241 and the extending arm 242. The adjusting unit 260 includes an X-axis adjusting member 261 and a Y-axis adjusting member 262. The X-axis adjusting member 261 is disposed corresponding to the positioning portion 241, and the Y-axis adjusting member 262 is disposed corresponding to the extending arm 242.

Specifically, the spring portion 243 is similar to the restoring unit 140 of FIG. 1A and can have a spring configuration. The positioning portion 241 and the extending arm 242 are preferably formed by bending a rod body, which extends from one end of the spring portion 243, such as the lower end, so that the positioning portion 241 and the extending arm 242 can function as the tactile feedback member of the keyswitch structure 20. In this embodiment, the positioning portion 241 preferably includes a horizontal section 2411 and a vertical section 2412. The horizontal section 2411 is connected between the vertical section 2412 and the spring portion 243. The horizontal section 2411 preferably extends from the lower end of the spring portion 243 to the positioning means 211 of the base 211. The vertical portion 2412 is bent upward relative to the horizontal section 2411 substantially toward the Z-axis direction, and the extending arm 242 is bent toward the X-axis direction relative to the vertical portion 2412. In this embodiment, the angle between the extending arm 242 and the vertical section 2412 is preferably equal to or less than 120 degrees.

The base 210 has the positioning means 211, a channel portion 212, a receiving portion 216, and a limiting portion 217 corresponding to the resilient member 240 and the adjusting unit 260. In this embodiment, the positioning means 211 is a through hole on the bottom of the base 210, and the receiving portion 216 is preferably a notch, which is partially hollowed out from the sidewall adjacent to the positioning means 211 toward the bottom of the base 210. The receiving portion 216 communicates with the positioning means 211 and configured to allow the positioning portion 241 to shift relative to the positioning means 211 in response to the movement of the adjusting unit 260. The limiting portion 217 preferably corresponds to the upper section of the positioning portion 241, i.e. a portion of the vertical section 2412 that is close to the extending arm 242, and is configured to limit movement of the positioning portion 241. Specifically, when the spring portion 243 is sleeved on the holding portion 113, the horizontal section 2411 of the positioning portion 241 extends to the positioning means 211. A lower portion of the vertical section 2412 is exposed to the receiving portion 216 and corresponds to the X-axis adjusting member 261, and an upper portion of the vertical section 2412 is positioned by the limiting portion 217. The extending arm 242 extends along the X-axis direction below the cam portion 131 and above the channel portion 212. For example, the limiting portion 217 can be a groove formed on the wall of the base 210, or a wall surface against which the connection part of the vertical section 2412 and the extending arm 242 can abut. The channel portion 212 can be a through hole extending along the Y-axis direction. The channel portion 212 is configured to allow the Y-axis adjusting member 262 to move in the channel portion 212, so as to change the position of the extending arm 242 relative to the moving path of the cam portion 131.

In an embodiment, the X-axis adjusting member 261 includes an X-axis adjusting bar 2611 and an X-axis connection portion 2612. The X-axis connection portion 2612 is disposed under the circuit board 290, and the X-axis adjusting bar 2611 is connected to the X-axis connection portion 2612 and extends toward the cover 120, e.g. the Z-axis direction. For example, the circuit board 290 has an X-axis guiding slot 294 corresponding to the receiving portion 216. The X-axis adjusting bar 2611 is inserted from bottom of the circuit board 290 into the X-axis guiding slot 294 and extends into the receiving portion 216, so the X-axis adjusting bar 2611 can be coupled to the positioning portion 241, which protrudes out from the positioning means 211 to the receiving portion 216. For example, the X-axis adjusting bar 2611 is coupled to the lower portion of the vertical section 2412. When the X-axis adjusting unit 261 moves, the X-axis adjusting bar 2611 drives the positioning portion 241 to shift, so as to change the deformation of the positioning portion 241 and the extending arm 242 relative to the spring portion 243, and in turn to change the pressing force required for the cam portion 131 to move relative to the extending arm 242 when the plunger 130 moves toward the base 210. That is, the extending arm 242 applies different resistant force against the cam portion 131.

The Y-axis adjusting member 262 includes a Y-axis adjusting bar 2621 and a Y-axis connection portion 2622. The Y-axis connection portion 2622 is disposed under the circuit board 290, and the Y-axis adjusting bar 2621 is connected to the Y-axis connection portion 2622 and extends toward the cover 120, e.g. the Z-axis direction. For example, the circuit board 290 has a Y-axis guiding slot 295 corresponding to the channel portion 212. The Y-axis adjusting bar 2621 is inserted from bottom of the circuit board 290 into the Y-axis guiding slot 295 and extends into the channel portion 212, so the Y-axis adjusting bar 2621 protrudes from the channel portion 212 to couple with the extending arm 242. When the Y-axis adjusting unit 262 moves, the Y-axis adjusting bar 2621 drives the extending arm 242 to shift along the Y-axis direction, so as to change the position of the extending arm 242 relative to the moving path of the cam portion 131.

In this embodiment, the Y-axis adjusting bar 2621 preferably has a notch 2623. The notch 2623 is preferably recessed from the surface of the Y-axis adjusting bar 2621 that faces the extending arm 242, so as to correspond to the longitudinal direction of the extending arm 242. For example, the notch 2623 can be an L-shaped notch. That is, the Y-axis adjusting bar 2621 preferably has a step on the top surface, so the extending arm 242 can extend across the notch 2623 of the Y-axis adjusting bar 2621 to enhance the linkage of the Y-axis adjusting bar 2621 and the extending arm 242, but not limited thereto. In another embodiment, the Y-axis adjusting bar 2621 may not have the notch 2623, and the extending arm 242 is coupled to the Y-axis adjusting bar 2621 by abutting against the wall surface of the Y-axis adjusting bar 2621. In addition, in another embodiment, the X-axis adjusting bar 2611 may optionally have a design similar to the groove 1611 of the adjusting bar 161 of FIG. 1A, so as to accommodate the lower portion of the vertical section 2412 of the positioning portion 241.

Figure 10A:
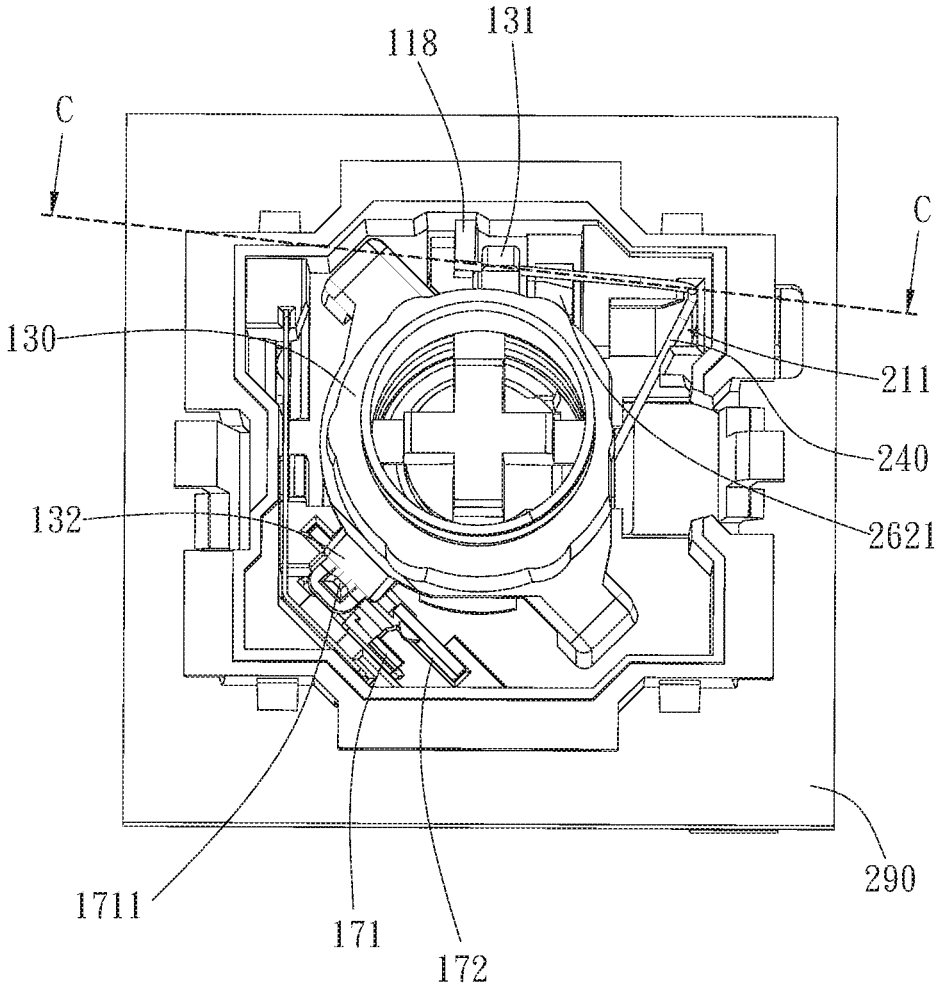
FIG. 10A is a schematic view of the keyswitch structure of FIG. 8A without the cover.
Figure 10B:
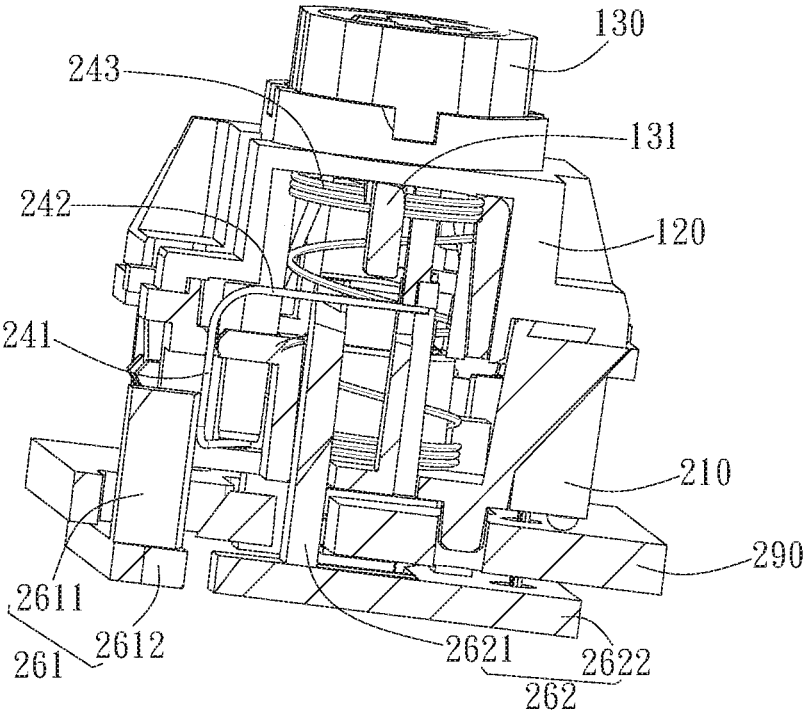
FIGS. 10B and 10C are cross-sectional views of the keyswitch structure of FIG. 10A along the cutting line CC with the X-axis adjusting member at different positions.
Figure 10C:
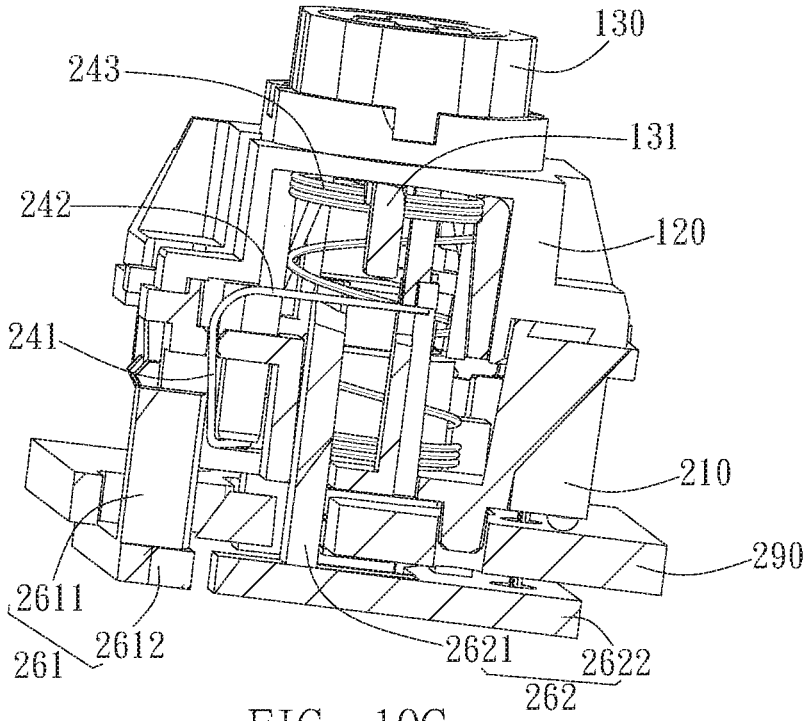

Referring to FIGS. 10A to 10C, the operation of the keyswitch structure 20 adjusting the tactile feedback by using the X-axis adjusting member 261 is illustrated, wherein FIG. 10A is a schematic view of the keyswitch structure of FIG. 8A without the cover, and FIGS. 10B and 10C are cross-sectional views of FIG. 10A along the cutting line CC with the X-axis adjusting member at different positions. As shown in FIG. 10B, when the X-axis adjusting member 261 is at the first position in the X-axis direction, the X-axis adjusting bar 2611 is coupled to the lower portion of the vertical section 2412 of the positioning portion 241, and the positioning portion 241 and the extending arm 242 has a first deformation relative to the spring portion 243. That is, a first stress exists between the positioning portion 241 and the extending arm 242, and the pressing force required for the cam portion 131 to pass the extending arm 242 when the plunger 130 is pressed and moves toward the base 210 is a first pressing force, i.e. the extending arm 242 applies a first resistant force against the cam portion 131. Specifically, when the X-axis adjusting member 261 is at the first position, the extending arm 242 preferably extends across the moving path of the cam portion 131 when moving downward, i.e. the moving path is parallel to the Z-axis direction. When the X-axis adjusting member 261 is at the first position and the first pressing force is exerted to enable the plunger 130 along with the cam portion 131 to move toward the base 210, the extending arm 242 firstly moves downward along the lower surface 1311 to the protrudent point 1313, and then passes the protrudent point 1313 to move upward and hit the base 210 or the cover 120 to generate a sound, such as a first sound. In other words, when the positioning portion 241 and the extending arm 242 have the first deformation (i.e. the tactile feedback member has a first X-axis deformation), and the pressing force exerted to the plunger 130 is large enough, e.g. not less than the first pressing force, to overcome the first resistant force that the extending arm 152 applies against the cam portion 131, the extending arm 242 firstly moves along the lower surface 1311 for a first distance to the protrudent point 1313, and then passes the protrudent point 1313 to move upward away from the bump. It is noted that when the extending arm 242 reaches the protrudent point 1313, the extending arm 242 has a first sound distance from an impact surface of the base 210 or the cover 120, and then the extending arm 242 hits the impact surface to generate the first sound. In this embodiment, the impact surface can be a wall surface of the cover 120 or the base 210 that corresponds to the extending arm 242, such as the impact surface 1181 of the impact wall 118 of the base 210.

As shown in FIG. 10C, when the X-axis adjusting member 261 moves in the X-axis direction, for example, toward the inner side of the base 210 approaching the cam portion 131, the X-axis adjusting bar 2611 pushes the lower end of the positioning portion 241 to shift relative to the positioning means 211 along the X-axis direction, so that the positions of the positioning portion 241 and the extending arm 242 relative to the spring portion 243 are changed, i.e. a different deformation is generated, and the stress is changed. Specifically, when the X-axis adjusting member 261 is at the second position, the X-axis adjusting bar 2611 is coupled to the lower end of the vertical section 2412 of the positioning portion 241, and the positioning portion 241 and the extending arm 242 have a second deformation relative to the spring portion 243. That is, a second stress exists between the positioning portion 241 and the extending arm 242, and the pressing force required for the cam portion 131 to pass the extending arm 242 when the plunger 130 is pressed and moves toward the base 210 is a second pressing force, i.e. the extending arm 242 applies a second resistant force against the cam portion 131. Specifically, when the X-axis adjusting member 261 is at the second position in the X-axis direction, the extending arm 242 preferably extends across the moving path of the cam portion 131 when moving downward, i.e. the moving path is parallel to the Z-axis direction. When the X-axis adjusting member 261 is at the second position and the second pressing force is exerted to enable the plunger 130 along with the cam portion 131 to move toward the base 210, the extending arm 242 firstly moves downward along the lower surface 1311 to the protrudent point 1313, and then passes the protrudent point 1313 to move upward and hit the base 210 or the cover 120 to generate a sound, such as a second sound. In other words, when the positioning portion 241 and the extending arm 242 have the second deformation (i.e. the tactile feedback member has a second X-axis deformation), and the pressing force exerted to the plunger 130 is large enough, e.g. not less than the second pressing force, to overcome the second resistant force that the extending arm 242 applies against the cam portion 131, the extending arm 242 firstly moves along the lower surface 1311 for a second distance to the protrudent point 1313, and then passes the protrudent point 1313 to move upward away from the bump. In this embodiment, the second position of the extending arm 242 is closer to the protrudent point 1313 than the first position, and the first distance is accordingly larger than the second distance. It is noted that when the extending arm 242 reaches the protrudent point 1313, the extending arm 242 has a second sound distance from the impact surface (e.g. 1181) of the base 210 or the cover 120, and then the extending arm 242 hits the impact surface to generate the second sound.

In this embodiment, when the X-axis adjusting member 261 moves in the X-axis direction from the first position to the second position, the positioning portion 241 is shifted by the pushing force of the X-axis adjusting bar 2611, so the first deformation is changed to the second deformation, and the first stress is changed to the second stress. As such, the downward moving distance of the extending arm 242 at the first position pushed by the cam portion 131 is larger than that of the extending arm 242 at the second position pushed by the cam portion 131. That is, the first sound distance is larger than the second sound distance, so the first sound is louder than the second sound. In sum, when the default stress caused by the deformation of the positioning portion 241 and the extending arm 242 is larger, the displacement of the extending arm 242 relative to the impact surface 1811 is smaller, so the generated sound will be smaller.

Figure 11A:
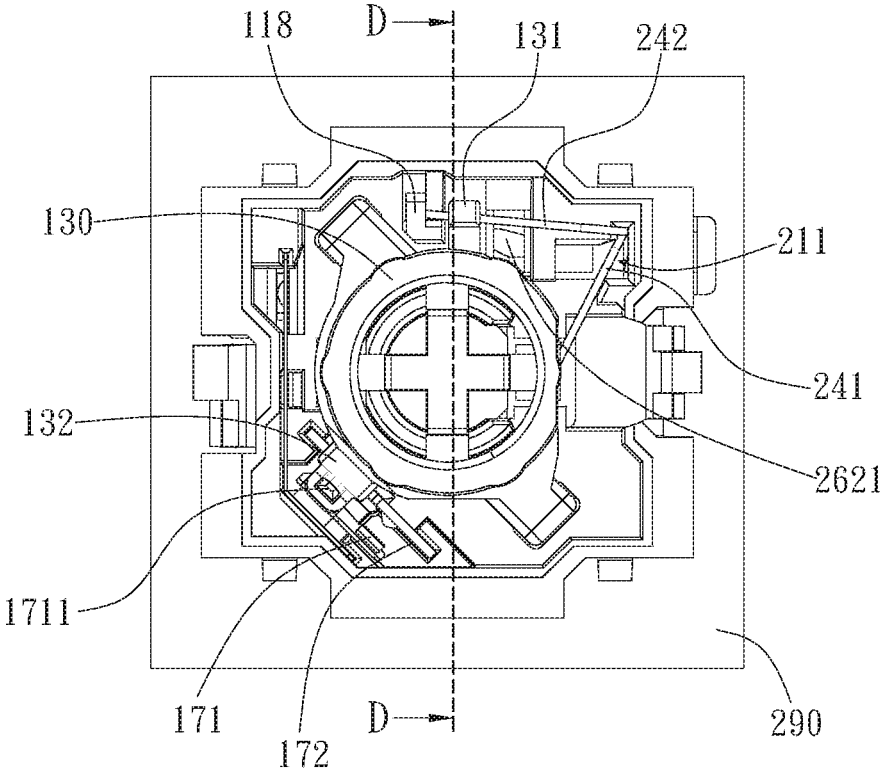
FIGS. 11A and 11B are a top view of the keyswitch structure of FIG. 8A with the Y-axis adjusting member at the first position and a cross-sectional view of the keyswitch structure along the cutting line DD, respectively.
Figure 11B:
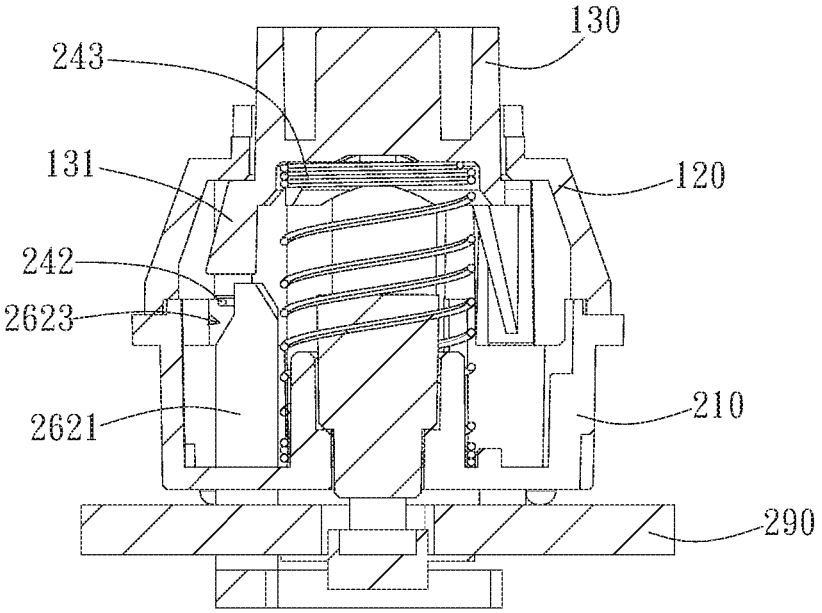

Referring to the drawings, the operation of the keyswitch structure 20 adjusting the tactile feedback by using the Y-axis adjusting member 262 will be illustrated, wherein FIGS. 11A and 11B are a top view of the keyswitch structure 20 of FIG. 8A with the Y-axis adjusting member 262 at the first position and a cross-sectional view along the cutting line DD, respectively. As shown in FIGS. 11A and 11B, when the Y-axis adjusting member 262 is at a first position in the Y-axis direction, the positioning portion 241 and the extending arm 242 have a first deformation relative to the spring portion 241, and the extending arm 242 is located at a first position relative to the cam portion 131 in the Y-axis direction. For example, when the Y-axis adjusting member 262 is at the first position in the Y-axis direction, the extending arm 242 preferably extends across the moving path of the cam portion 131 when moving downward, i.e. the moving path parallel to the Z-axis direction), and the pressing force required for the cam portion 131 to pass the extending arm 242 when the plunger 130 is pressed and moves toward the base 210 is a first pressing force, i.e. the extending arm 242 applies a first resistant force against the cam portion 131. When the Y-axis adjusting member 262 is at the first position and the first pressing force is exerted to enable the plunger 130 along with the cam portion 131 to move toward the base 210, the extending arm 242 firstly moves downward along the lower surface 1311 to the protrudent point 1313, and then passes the protrudent point 1313 to move upward and hit the base 210 or the cover 120 to generate a sound, such as a first sound. In other words, when the positioning portion 241 and the extending arm 242 have the first deformation (i.e. the tactile feedback member has a first Y-axis deformation), and the pressing force exerted to the plunger 130 is large enough, e.g. not less than the first pressing force, to overcome the first resistant force that the extending arm 152 applies against the cam portion 131, the extending arm 242 firstly moves along the lower surface 1311 for a first distance to the protrudent point 1313, and then passes the protrudent point 1313 to move upward away from the bump. It is noted that when the extending arm 242 reaches the protrudent point 1313, the extending arm 242 has a first sound distance from an impact surface of the base 210 or the cover 120, and then the extending arm 242 hits the impact surface to generate the first sound.

Figure 12A:
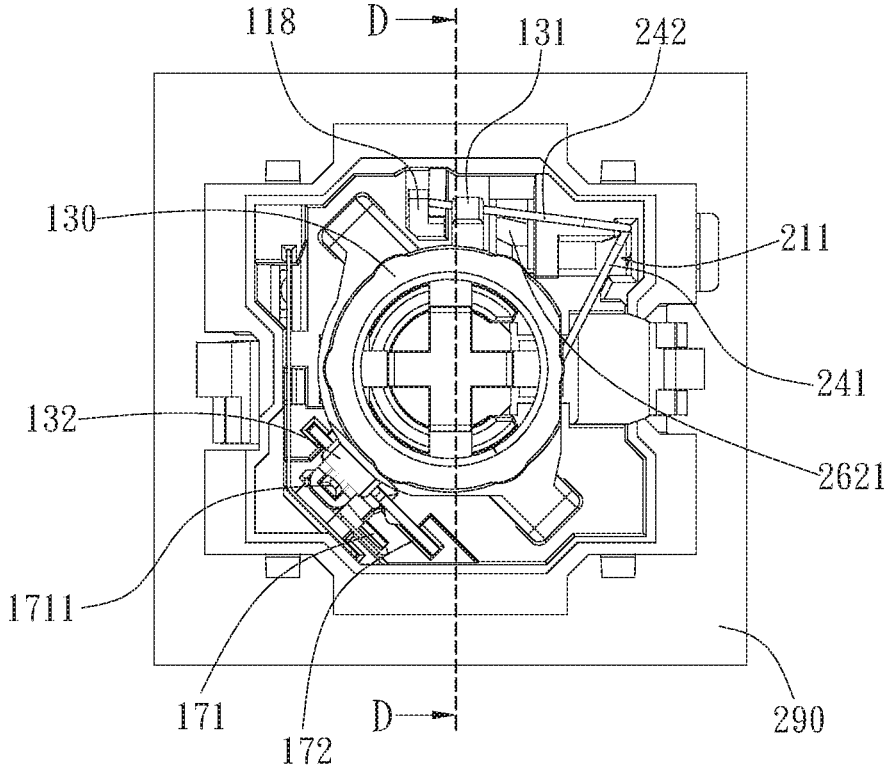
FIGS. 12A and 12B are a top view of the keyswitch structure of FIG. 8A with the Y-axis adjusting member at the second position and a cross-sectional view of the keyswitch structure along the cutting line DD, respectively.
Figure 12B:
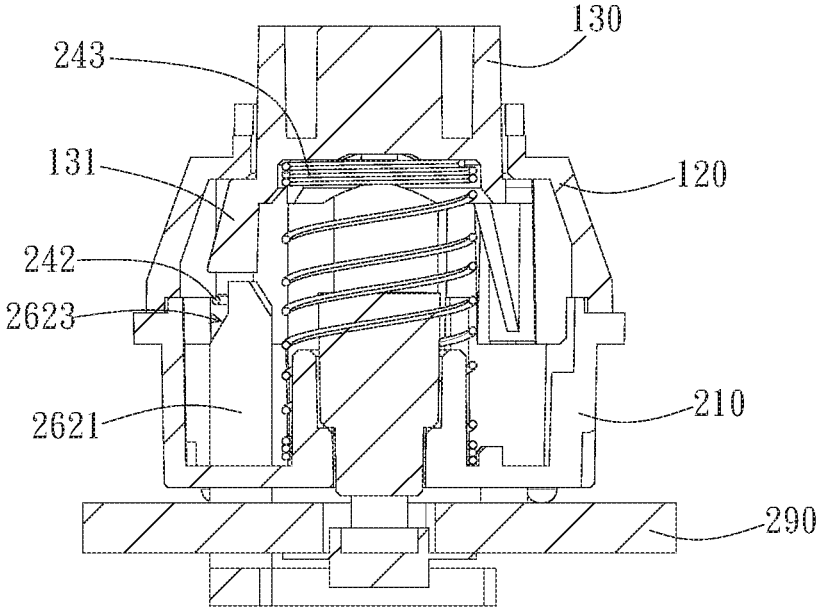

FIGS. 12A and 12B are a top view of the keyswitch structure 20 of FIG. 8A with the Y-axis adjusting member 262 at the second position and a cross-sectional view along the cutting line DD, respectively. As shown in FIGS. 12A and 12B, when the Y-axis adjusting member 262 is at the second position, the positioning portion 241 and the extending arm 242 have a second deformation relative to the spring portion 243, and the extending arm 242 is located at a second position relative to the moving path of the cam portion 131 in the Y-axis direction. For example, when the Y-axis adjusting member 262 is at the second position in the Y-axis direction, the extending arm 242 preferably extends across the moving path of the cam portion 131 when moving downward, i.e. the moving path is parallel to the Z-axis direction, and the pressing force required for the cam portion 131 to pass the extending arm 242 when the plunger 130 is pressed and moves toward the base 210 is a second pressing force, i.e. the extending arm 152 applies a second resistant force against the cam portion 131. In this embodiment, when the Y-axis adjusting member 262 is located at the second position in the Y-axis direction, the second position of the Y-axis adjusting member 262 in the Y-axis direction can be closer to the outer side of the base 210 than the first position, for example closer to the protrudent point 1313 of the cam portion 131. In other words, the Y-axis adjusting bar 2621 pushes the extending arm 242 outwardly in the Y-axis direction toward the outer side of the base 210, so the stress between the extending arm 242 and the positioning portion 241 is increased. When the Y-axis adjusting member 262 is at the second position and the second pressing force is exerted to enable the plunger 130 along with the cam portion 131 to move toward the base 210, the extending arm 242 firstly moves downward along the lower surface 1311 to the protrudent point 1313, and then passes the protrudent point 1313 to move upward and hit the base 210 or the cover 120 to generate a sound, such as a second sound. In other words, when the positioning portion 241 and the extending arm 242 have the second deformation (i.e. the tactile feedback member has a second X-axis deformation), and the pressing force exerted to the plunger 130 is large enough, e.g. not less than the second pressing force, to overcome the second resistant force that the extending arm 152 applies against the cam portion 131, the extending arm 242 firstly moves along the lower surface 1311 for a second distance to the protrudent point 1313, and then passes the protrudent point 1313 to move upward away from the bump. In this embodiment, the second position of the extending arm 242 is closer to the protrudent point 1313 than the first position, and the first distance is accordingly larger than the second distance. It is noted that when the extending arm 242 reaches the protrudent point 1313, the extending arm 242 has a second sound distance from the impact surface (e.g. 1181) of the base 210 or the cover 120, and then the extending arm 242 hits the impact surface to generate the second sound.

Particularly, when the Y-axis adjusting member 262 is located at the first position or the second direction in the Y-axis direction, the stress caused by the deformation of the positioning portion 241 and the extending arm 242 is within in a range that the cam portion 131 can push the extending arm 242 downwardly. Therefore, when a sufficient pressing force, such as the first pressing force or the second pressing force, is exerted to the plunger 130, in response to the downward pushing force of the cam portion 131, the extending arm 242 firstly moves downward along the lower surface 1311 to the protrudent point 1313, and then passes the protrudent point 1313 to move upward because of the rebound force and hit the impact surface of the base 210 or the cover 120 (e.g. the impact surface 1181) to generate the sound. It is noted that when the Y-axis adjusting member 262 moves from the first position to the second position in the Y-axis direction, the Y-axis adjusting bar 2611 pushes the extending arm 242 to shift, and the position of the extending am 242 relative to the moving path of the cam portion 131 is changed, so the first deformation is changed to the second deformation, and the first stress is increased to the second stress. As such, the downward moving distance of the extending arm 242 at the first position pushed by the cam portion 131 is larger than that of the extending arm 242 at the second position pushed by the cam portion 131. That is, the first sound distance is larger than the second sound distance, so the first sound is louder than the second sound. In sum, when the stress caused by the deformation of the positioning portion 241 and the extending arm 242 is larger, the displacement of the extending arm 242 relative to the impact surface 1811 is smaller, so the generated sound will be smaller.

Figure 13A:
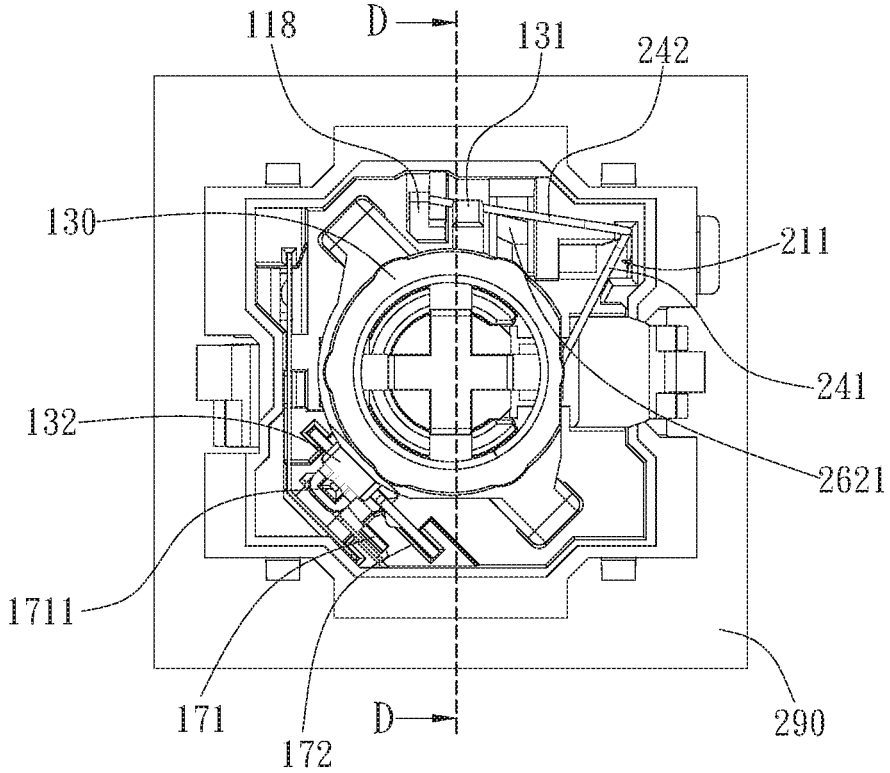
FIGS. 13A and 13B are a top view of the keyswitch structure of FIG. 8A with the Y-axis adjusting member at the third position and a cross-sectional view of the keyswitch structure along the cutting line DD, respectively.
Figure 13B:
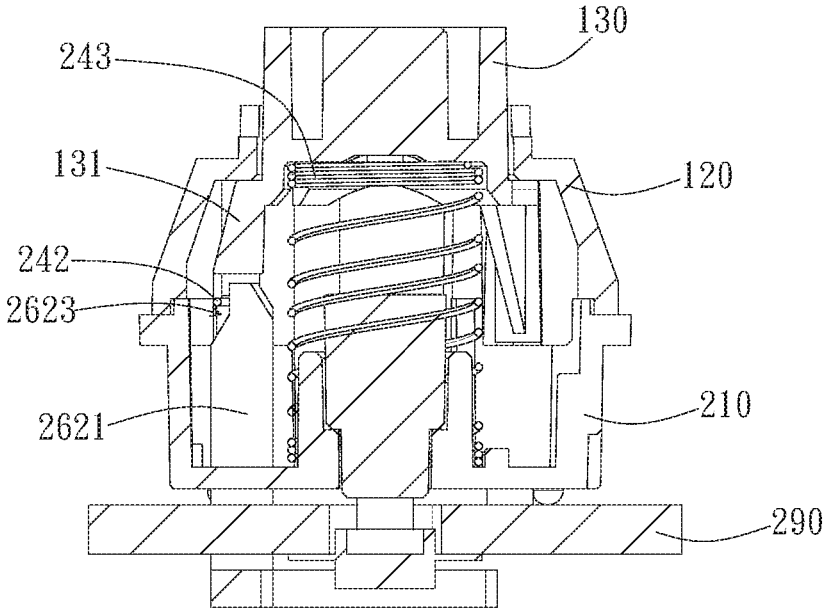

Moreover, when the distance of the Y-axis adjusting member 262 moving toward the outer side of the base 210 is larger, the displacement of the extending arm 242 relative to the moving path of the cam portion 131 is larger. For example, when the extending arm 242 is located at a position relative to the moving path substantially corresponding to the protrudent point 1313 of the cam portion 131, the plunger 130 cannot push the extending arm 242 downwardly, but push the extending arm 242 laterally to provide a dome-collapse-like tactile feedback. FIGS. 13A and 13B are a top view of the keyswitch structure 20 of FIG. 8A with the Y-axis adjusting member 262 at the third position and a cross-sectional view along the cutting line DD, respectively. As shown in FIGS. 13A and 13B, when the Y-axis adjusting member 262 is at the third position in the Y-axis direction, the positioning portion 241 and the extending arm 242 have a third deformation (i.e. the tactile feedback member has a third Y-axis deformation), so the extending arm 242 is at a third position relative to the moving path of the cam portion 131 in the Y-axis direction. Specifically, the third position of the Y-axis adjusting member 262 can be closer to the outer side of the base 210 than the second position, for example, substantially corresponding to the protrudent point 1313 of the cam portion 131. That is, the Y-axis adjusting bar 2611 moves farther toward the outer side of the base 210 and pushes the extending arm 242 farther outwardly, so the stress of the positioning portion 241 and the extending arm 242 is further increased, and the third position of the extending arm 242 preferably substantially corresponds to the protrudent point 1313 of the cam portion 131. When the Y-axis adjusting member 262 is at the third position and the pressing force is exerted to the plunger 130 to enable the plunger 130 to move toward the base 210, the cam portion 131 pushes the extending arm 242 to move along the Y-axis direction away from the moving path outwardly to generate a dome-collapse-like tactile feedback. During the operation, since the cam portion 131 does not push the extending arm 242 downwardly, the extending arm 242 only moves laterally without bouncing upwardly to hit the impact surface 1181, and no impact sound is generated.

Figure 14A:
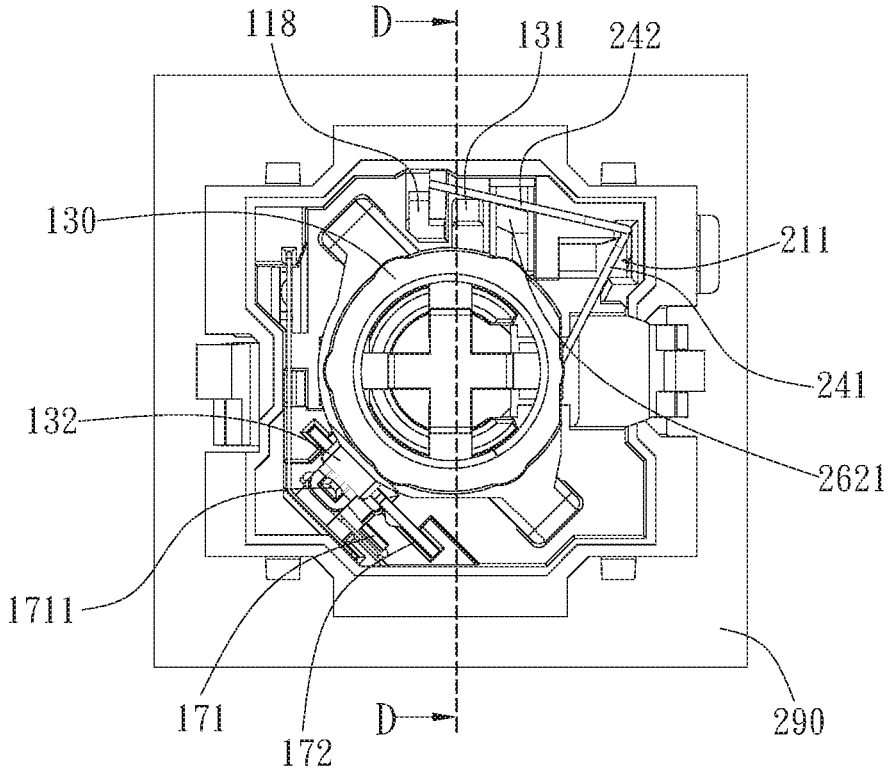
FIGS. 14A and 14B are a top view of the keyswitch structure of FIG. 8A with the Y-axis adjusting member at the fourth position and a cross-sectional view of the keyswitch structure along the cutting line DD, respectively.
Figure 14B:
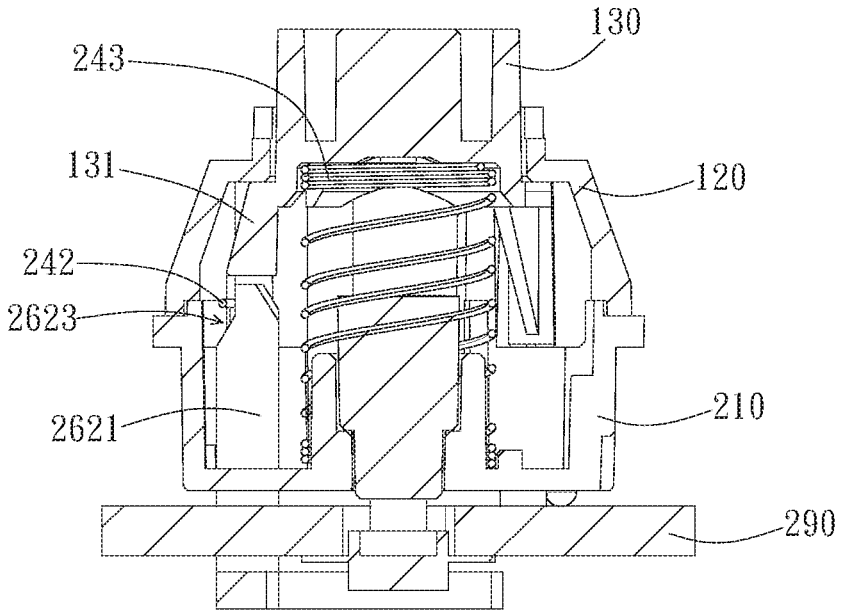

Moreover, when the distance of the Y-axis adjusting member 262 moving toward the outer side of the base 210 is large enough to shift the position of the extending arm 242 outside the moving path of the cam portion 131, the keyswitch structure 20 can provide a linear feedback. FIGS. 14A and 14B are a top view of the keyswitch structure 20 of FIG. 8A with the Y-axis adjusting member 262 at the fourth position and a cross-sectional view along the cutting line DD, respectively. As shown in FIGS. 14A and 14B, when the Y-axis adjusting member 262 is located at the fourth position in the Y-axis direction, the positioning portion 241 and the extending arm 242 have a fourth deformation (i.e. the tactile feedback member has a fourth Y-axis deformation), so the extending arm 242 is located at a fourth position relative to the moving path of the cam portion 131 in the Y-axis direction, i.e. the fourth position of the extending arm 242 is outside the moving path. For example, the fourth position of the Y-axis adjusting member 262 can be closer to the outer side of the base 210 than the third position. That is, the Y-axis adjusting bar 2621 moves much farther toward the outer side of the base 210 and pushes the extending arm 242 farther outwardly, so the stress of the positioning portion 241 and the extending arm 242 is further increased, and the extending arm 242 displaces toward the Y-axis direction to be located outside the moving path of the cam portion 131. Specifically, when the Y-axis adjusting member 262 is at the fourth position, and the pressing force is exerted to enable the plunger 130 along with the cam portion 131 to move downwardly toward the base 210, the cam portion 131 moves along the moving path without interfering with the extending arm 242, and a linear feedback is provided.

It is noted that the embodiments of FIGS. 10B to 10C are illustrated according to the positions of the X-axis adjusting member 261 moving sequentially toward the inner side of the base 210 along the X-axis direction, but not limited thereto. In another embodiment, the X-axis adjusting member 261 can move toward the outer side of the base 210 along the X-axis direction to different positions, and the positioning portion 241 can move toward the outer side of the base 210 with the X-axis adjusting member 261 by the elastic restoring force and have deformation varying with the position of the X-axis adjusting member 261 in the X-axis direction to provide a corresponding tactile feedback. Similarly, the embodiments of FIGS. 11A to 14B are illustrated according to the positions of the Y-axis adjusting member 262 moving sequentially toward the outer side of the base 210 along the Y-axis direction, but not limited thereto. In another embodiment, the Y-axis adjusting member 262 can move toward the inner side of the base 210 along the Y-axis direction to different positions, and the extending arm 242 can move toward the inner side of the base 210 with the Y-axis adjusting member 262 by the elastic restoring force to be located at a desired position relative to the moving path of the cam portion 131 in the Y-axis direction, so as to provide a corresponding tactile feedback. Specifically, according to practical applications, the keyswitch structure 20 can selectively provide two or more kinds of tactile feedback by controlling the position of the X-axis adjusting member 261 in the X-axis direction or the position of the Y-axis adjusting member 262 in the Y-axis direction. That is, the X-axis adjusting member 261 can move toward the inner side or the outer side of the base 210 in the X-axis direction to selectively control the X-axis adjusting member 261 located at (1) a position that the deformation (or default stress) of the positioning portion 241 and the extending arm 242 can allow the extending arm 242 to generate a displacement in the Z-axis direction and hit the impact surface 1181 when the plunger 130 moves downward, and the cam portion 131 pushes the extending arm 242 downwardly, such as the first position or the second position in the X-axis direction, so as to provide tactile feedbacks of different pressing forces with sounds of different volume. Moreover, the Y-axis adjusting member 262 can move toward the outer side or the inner side of the base 210 in the Y-axis direction to selectively control the Y-axis adjusting member 262 located at (1) a position that the extending arm 242 extends across the moving path of the cam portion 131, and the deform (or default stress) of the positioning portion 241 and the extending arm 242 can allow the extending arm 242 to generate a displacement in the Z-axis direction and hit the impact surface 1181 when the plunger 130 moves downward, and the cam portion 131 pushes the extending arm 242 downwardly, such as the first position, the second position, or any suitable position before reaching the third position in the Y-axis direction, so as to provide tactile feedbacks of different pressing forces with sounds of different volume, (2) a position that the extending arm 242 substantially corresponds to the protrudent point 1313 of the cam portion, and the deformation (or default stress) of the positioning portion 241 and the extending arm 242 can allow the cam portion 131 to push the extending arm 242 laterally away from the moving path when the plunger 130 moves downward along with the cam portion 131, such as the third position in the Y-axis direction, to provide the dome-collapse-like tactile feedback, or (3) a position that the extending arm 242 is located outside the moving path of the cam portion 131, so that the cam portion 131 does not interfere with the extending arm 242 when the plunger 130 moves toward the base 210 along with the cam portion 131, such as the fourth direction in the Y-axis direction, to provide a soundless linear feedback.

It is noted that the keyswitch structure 20 can provide a desired tactile feedback by adjusting merely one of the X-axis adjusting member 261 and the Y-axis adjusting member 262, or by adjusting the X-axis adjusting member 261 and the Y-axis adjusting member 262. In other words, in another embodiment, the keyswitch structure 20 can include only one of the X-axis adjusting member 261 and the Y-axis adjusting member 262, not limited to the embodiment of including both of the X-axis adjusting member 261 and the Y-axis adjusting member 262. Moreover, the first position or the second position of the extending arm 242 when the adjustment is achieved by adjusting the X-axis adjusting member 261 can be the same as or different from the first position or the second position of the extending arm 242 when the adjustment is achieved by adjusting the Y-axis adjusting member 262. As such, the pressing force required for the cam portion 131 to pass the extending arm 242 when the X-axis adjusting member 261 is located at the first position or the second position can be the same as or different from the pressing force required for the cam portion 131 to pass the extending arm 242 when the Y-axis adjusting member 262 is located at the first position or the second position.

Figure 15A:
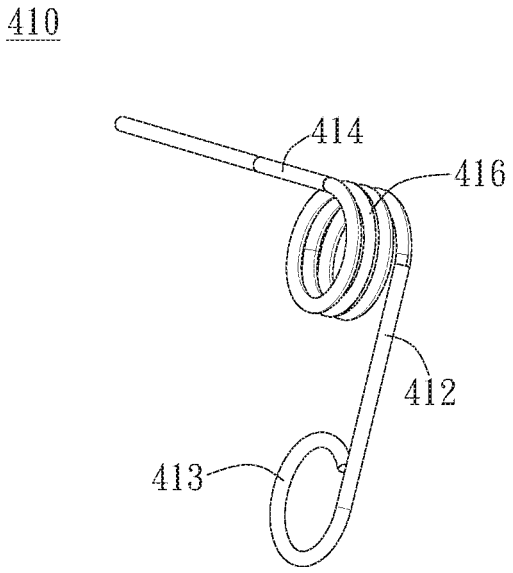
FIGS. 15A to 15C are schematic views of another embodiment of the tactile feedback member and the casing and an assembly schematic view thereof.
Figure 15B:
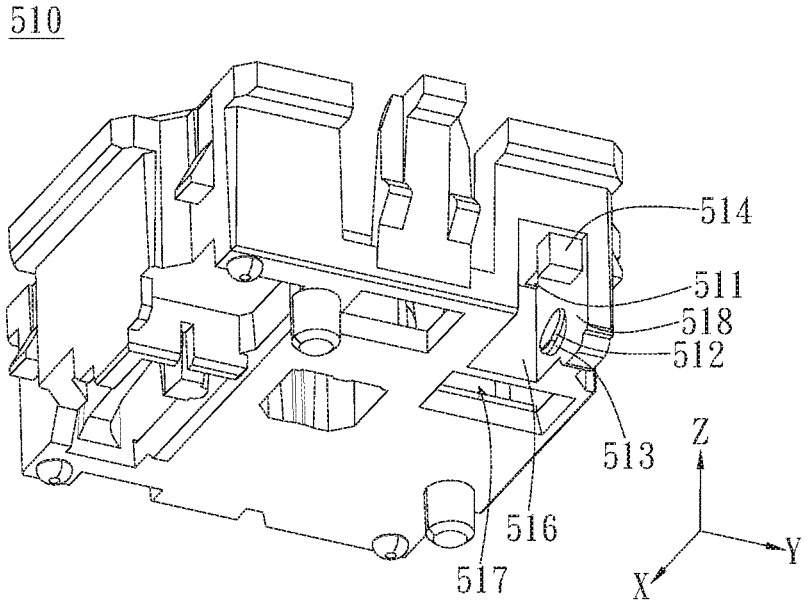
Figure 15C:
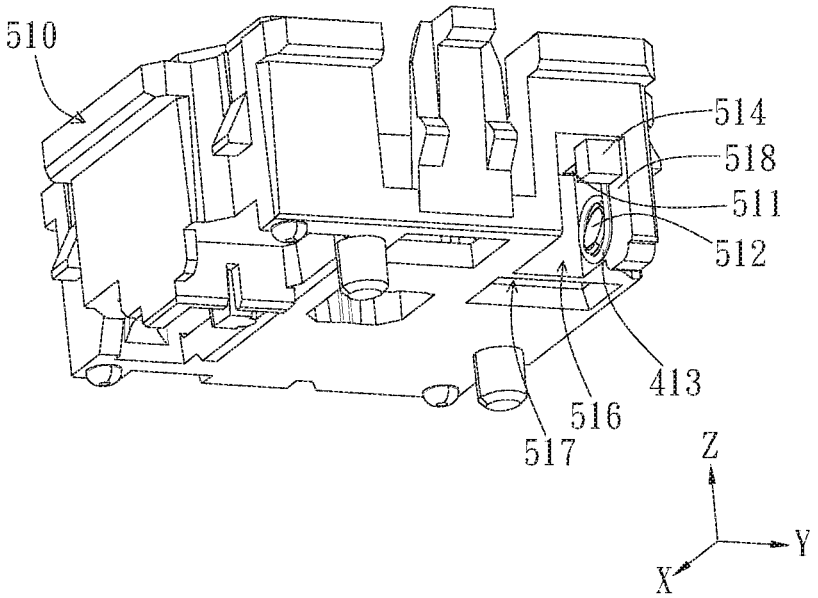
Figure 15D:
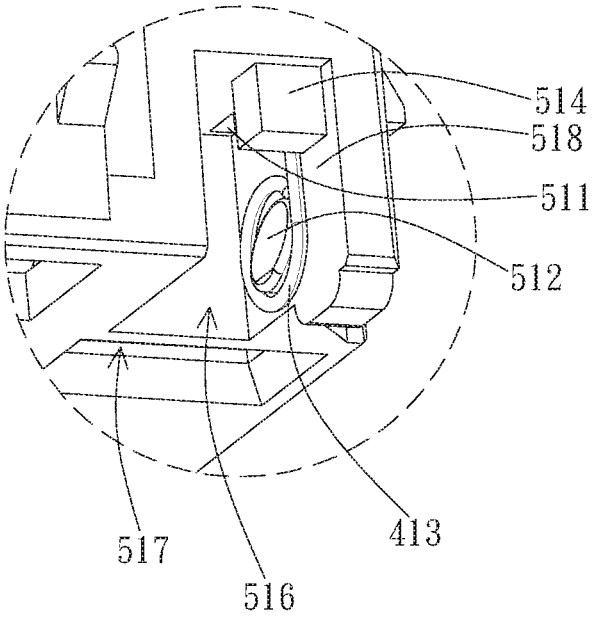
FIG. 15D is a partially enlarged view of FIG. 15C.

Moreover, by modifying the design of the positioning portion and the base, the positioning of the tactile feedback member and the base can be enhanced. In an embodiment, as shown in FIGS. 15A to 15C, the tactile feedback member 410 is implemented as a torsion spring and includes a positioning portion 412, an extending arm 414, and a spring portion 416. The positioning portion 412 and the extending arm 414 respectively extend from two opposite ends of the spring portion 416, and an angle between the extending direction of the positioning portion 412 and the extending direction of the extending arm 414 is preferably equal to or less than 120 degrees. It is noted that the tactile feedback member 410 and the base 510 are similar to the tactile feedback member 150 and the base 110 in the embodiment of FIG. 1A, and the structures thereof and the connections and arrangements with other components of the keyswitch structure can be referred to the related descriptions of the embodiment of FIG. 1A and will not be elaborated again. Hereinafter, the positioning mechanism of the tactile feedback member 410 on the base 510 is described.

In this embodiment, the tactile feedback member 410 is positioned on the base 510 by the positioning portion 412, and the positioning portion 412 has a curved section 413. The curve section 413 preferably abuts against the base 510 to limit the movement of the positioning portion 412 and to improve the assembly efficiency and the accuracy of restoring position during operation. Specifically, the base has a surface 518, and the curved section 413 preferably abuts against the surface 518. In an embodiment, the base 510 preferably has a positioning means 511, an engaging portion 512, and a receiving portion 516. The positioning means 511 can be a positioning hole and the receiving portion 516 can be a notch or an opening communicating with the positioning portion 511, as mentioned in the previous embodiments. The surface 518 is a wall surface in the receiving portion 516 and preferably parallel to the curve path of the curved section 413. As such, when the curved section 413 abuts against the surface 518, the curved section 413 and the surface 518 can have a plane of action, which is a surface area covered by the vertical projection of the curved section 413 on the surface 518. The surface 518 extends in two directions, and one of the directions is preferably parallel to the extending direction of the extending arm 414, such as X-axis direction. For example, in this embodiment, the surface 518 of the base 510 preferably extends along the X-Z plane, and the curved section 413 also extends along the X-Z plane, so that the plane of action is defined by the vertical projection of the curved section 413 on the surface 518. The X-Z plane is parallel to the X-axis and the Z axis, and the X axis, the Y axis, and the Z axis are perpendicular to one another. The engaging portion 512 is disposed in the receiving portion 516 corresponding to the positioning means 511 and configured to engage with the curved section 413. That is, the curved section 413 extends into the positioning means 511 of the base 510 and interferes with the base 510, so as to prevent the positioning portion 412 from escaping from the positioning means 511. For example, the engaging portion 512 is preferably a bolt protruding in the receiving portion 516 from the sidewall of the base 510 (i.e. from the surface 518), which defines the receiving portion 516. The engaging portion 512 preferably has a groove 513 at least partially recessed radially into the engaging portion 512 near the surface 518 of the base 510. The groove 513 is configured to accommodate at least a portion of the curved section 413. In other words, the engaging portion 512 preferably has a profile of a wider head and a narrower neck, wherein the neck is closer to the surface 518 of the base 510 than the head, so that the groove 513 is the recessed space of the neck relative to the head. In an embodiment, the base 510 preferably has a block 514 disposed corresponding to the positioning portion 412, so that the positioning portion 412 can be partially abuts against the block 514. For example, the block 514 is disposed adjacent to the positioning means 511 and preferably disposed on the surface 510 to be located on a side of the engaging portion 512. When the positioning portion 412 is positioned by the positioning means 511, the positioning portion 412 extends in the receiving portion 416 and abuts against the block 514, so that the displacement of the positioning portion 412 is limited by the block 514.

In this embodiment, the curved section 413 preferably has a ring shape, so the curved section 413 can be engaged with the engaging portion 512 to enhance the positioning of the base 510 and the tactile feedback member 410. For example, the positioning portion 412 is a rod body, which extends downward from one end of the spring portion 416 and then is bent to form a ring as the curved section 413. The curved section 413 is preferably an opened ring to provide the deformation flexibility when the curved section 413 is engaged with the engaging portion 512. That is, the distal end of the curved section 413 away from the spring body 416 is preferably a free end. The ring size of the curved section 413 is preferably substantially equal to or smaller than the size of the engaging portion 512. When the curved section 413 is engaged with the engaging portion 512, the curved section 413 can elastically deform to be at least partially received in the groove 513 and abut against the surface 518, so the positioning portion 412 is engaged with the engaging portion 512 of the base 510. As such, the positioning of the tactile feedback member 410 and the base 510 is enhanced, and during the assembly process, the chance of the tactile feedback member 410 detaching from the base 510 is reduced to promote the assembly efficiency. Moreover, during the operation of using the Y-axis adjusting member (e.g. 262), which protrudes upward from the channel portion 517 of the base 510, to adjust the position of the extending arm 414 relative to the moving path of the cam portion 131 along the Y direction, by the engagement of the curved section 413 with the engaging portion 512 to enable the curved section 413 to abut against the surface 518 so as to prevent the positioning portion 412 from rotating about the Z axis, and by the movement limitation of the positioning portion 412 (e.g. the linear section connected to the curved section 413) abutting against the block 514, the displacement of the extending arm 414 relative to the moving path of the cam portion 131 can be effectively controlled, and the accuracy of the tactile feedback member 410 returning to a desired position is increased to provide a desirable tactile feedback.

Figure 16A:
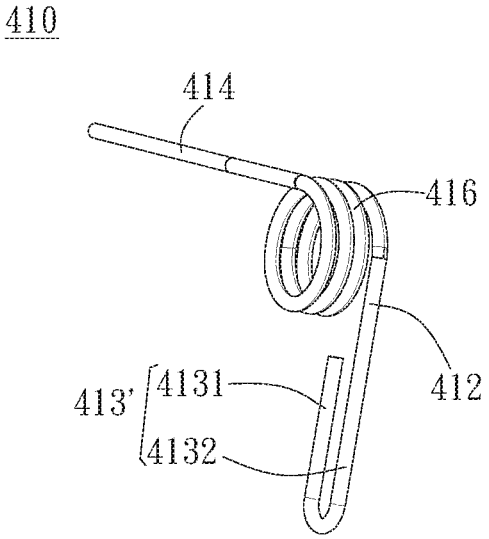
FIGS. 16A and 16B are a schematic view of yet another embodiment of the tactile feedback member and an assembly schematic view of the tactile feedback member and the base.
Figure 16B:
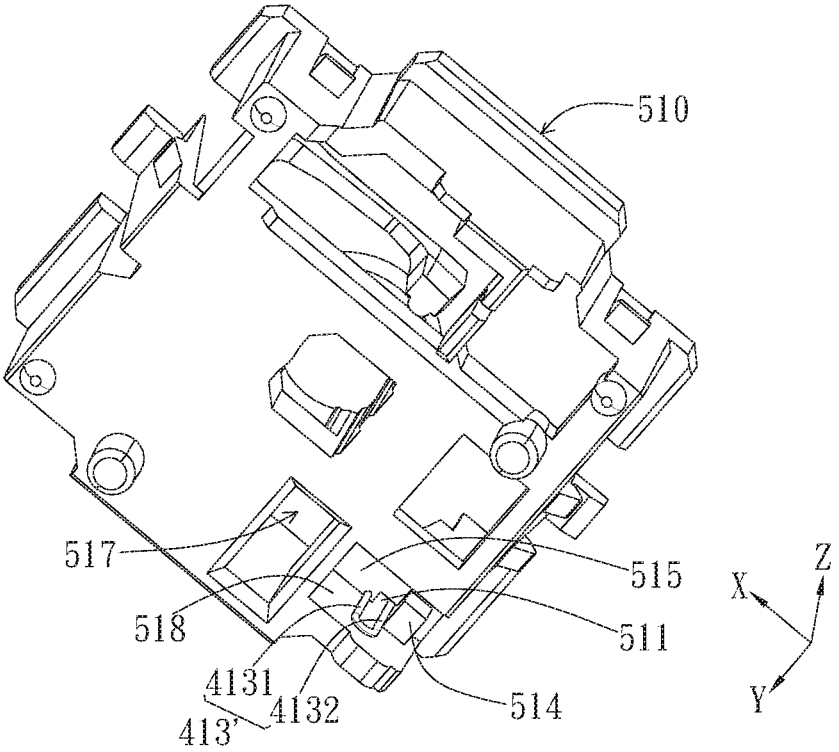
Figure 16C:
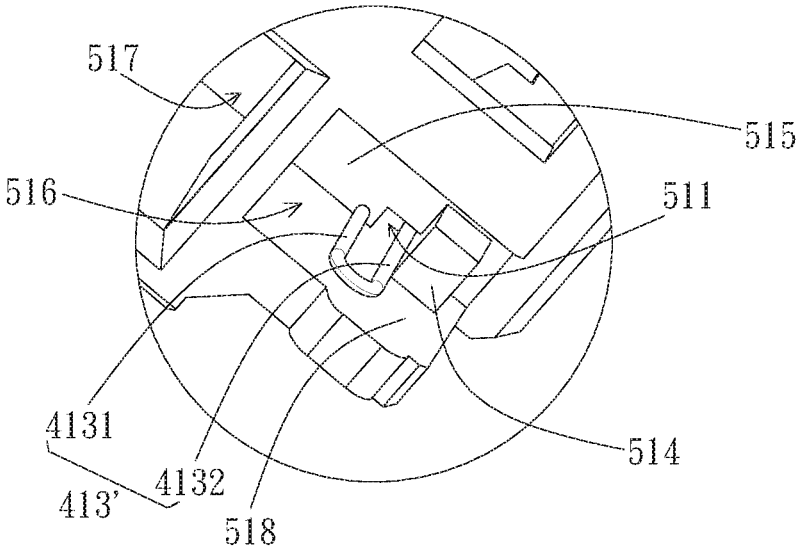
FIG. 16C is a partially enlarged view of FIG. 16B.

In other embodiments, the curved section can have different configurations to enhance the positioning of the tactile feedback member and the base. As shown in FIGS. 16A and 16B, in another embodiment, the curved portion 413' has a U shape. One end (e.g. 4132) of the curved section 413' abuts against the block 514, and the other end of the curved section 413' is a freed end 4131. The free end 4131 contacts a lower surface 515 of the base 510 adjacent to the positioning means 511. In an embodiment, the lower surface 515 can be the top surface of the receiving portion 516. Specifically, the positioning portion 412 is a rod body, which extends downward from one end of the spring portion 416 and is then bent along the extending direction of the extending arm 414 (e.g. the X axis direction) upward to form a U-shaped section as the curved section 413', wherein the opening of the U-shaped section opens toward the Z-axis direction, e.g. upward. In other words, one end 4132 of the curved section 413' is connected to the spring portion 416, and the other end of the curved section 413' is a free end 4131. When the positioning portion 412 extends to the positioning means 511 of the base 510, the end 4132 of the curved section 413' connected to the spring portion 416 abuts against the block 514, and the free end 4131 of the curved section 413' is bent upward to touch against the lower surface 515 of the base 510. As such, since the curve path of the curved section 413' is parallel to the surface 518, the positioning portion 412 and the base 510 have a plane limitation (e.g. in X-Z plane) with respect to the linear positioning portion 151 of FIG. 1A. During the assembly process and the operation, the chance of tactile feedback member 410 detaching from the base 510 is reduced to promote the assembly efficiency, and the accuracy of the tactile feedback member 410 returning to a desired position is increased to provide a desirable tactile feedback.

Figure 17A:
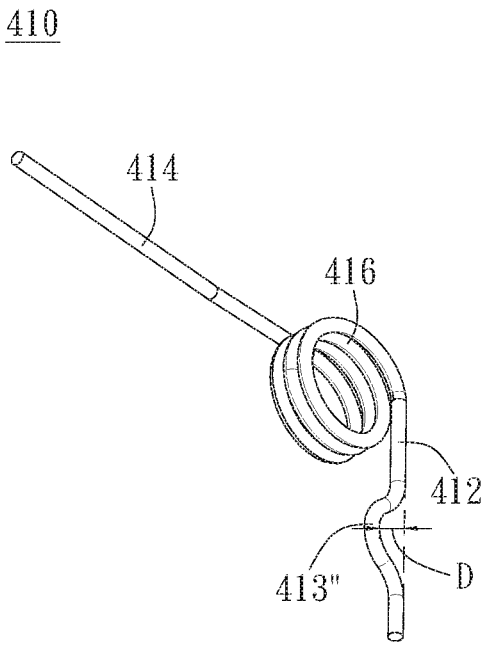
FIGS. 17A and 17B are a schematic view of a further embodiment of the tactile feedback member and an assembly schematic view of the tactile feedback member and the base.
Figure 17B:
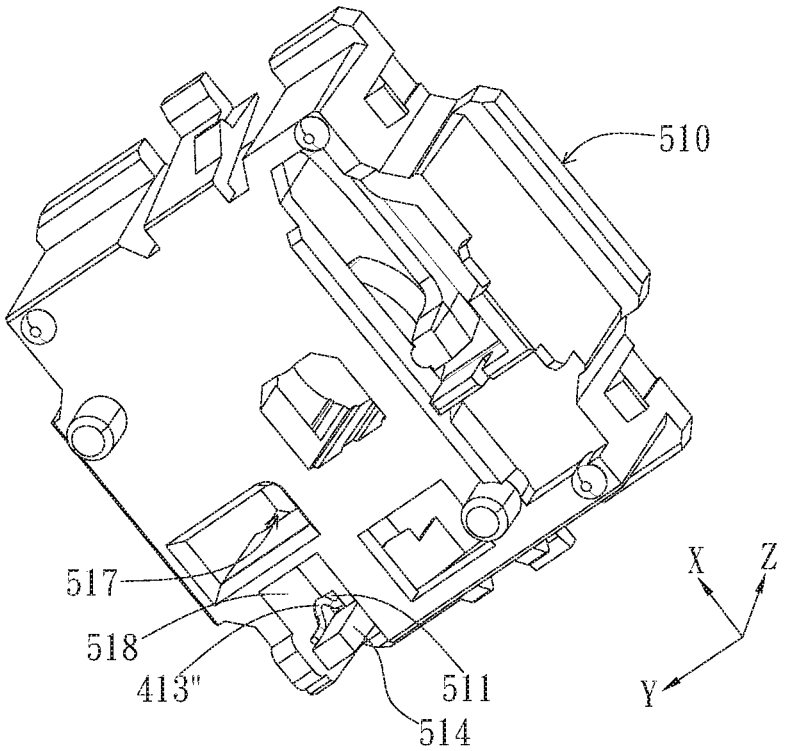
Figure 17C:
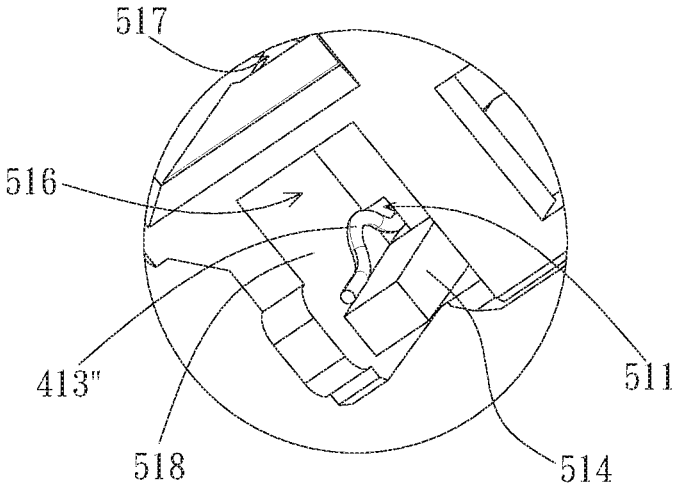
FIG. 17C is a partially enlarged view of FIG. 17B.

In another embodiment, as shown in FIGS. 17A and 17B, the curved section 413" has a U shape, wherein the opening of the U-shaped section opens laterally, e.g. toward the X-axis direction or the Y-axis direction. In this embodiment, the opening of the curved section 413" preferably opens toward the X-axis direction. Specifically, compared to the embodiment of FIG. 16A, one end of the curved section 413" is connected to the spring portion 416, and the other end of the curved section 413" is a free end extending away from the positioning means 511. In this embodiment, the curved section 413" has a curve depth D, and the curve depth D is preferably larger than the width of the positioning means 511 in the opening direction of the U-shape section, e.g. the X-axis direction or the Y-axis direction. In other words, the lateral size of the curved section 413" is larger than the width of the positioning means 511, so when the positioning portion 412 is positioned by the positioning means 511, the linear section of the positioning portion 412, which is connected to the curved section 413", abuts against the block 514 of the base 510, and the curved section 413" abuts against the surface 518, so that the curved section 413" interferes with the base 510 adjacent to the positioning means 511 to prevent the positioning portion 412 from escaping from the positioning means 511 since the curve depth D is larger than the width of the positioning means 511. As such, the positioning portion 412 and the base 510 have a plane limitation (e.g. in X-Z plane) with respect to the linear positioning portion 151 of FIG. 1A. During the assembly process and the operation, the chance of the tactile feedback member 410 detaching from the base 510 is reduced to promote the assembly efficiency, and the accuracy of the tactile feedback member 410 returning to a desired position is increased to provide a desirable tactile feedback.

It is noted that the design of the curved section to enhance the positioning of the positioning portion and the base can be applied not only to the keyswitch structure (e.g. 10) with the adjusting unit in the previous embodiment, but also to a keyswitch structure without the adjusting unit in other embodiments (not shown). Therefore, during the assembly process, the positioning portion can be inserted into the positioning hole, which serves as the positioning means, by elastically deforming the curved section. By the positioning enhancement of the positioning portion and the base, e.g. the curved section interfering with the base or the width of the positioning means 511 (e.g. hole) being smaller than the size of the curved section 413, 313', or 413" in the X-axis direction, the chance of the tactile feedback member detaching from the base can be reduced to facilitate the assembly efficiency.

Figure 18:
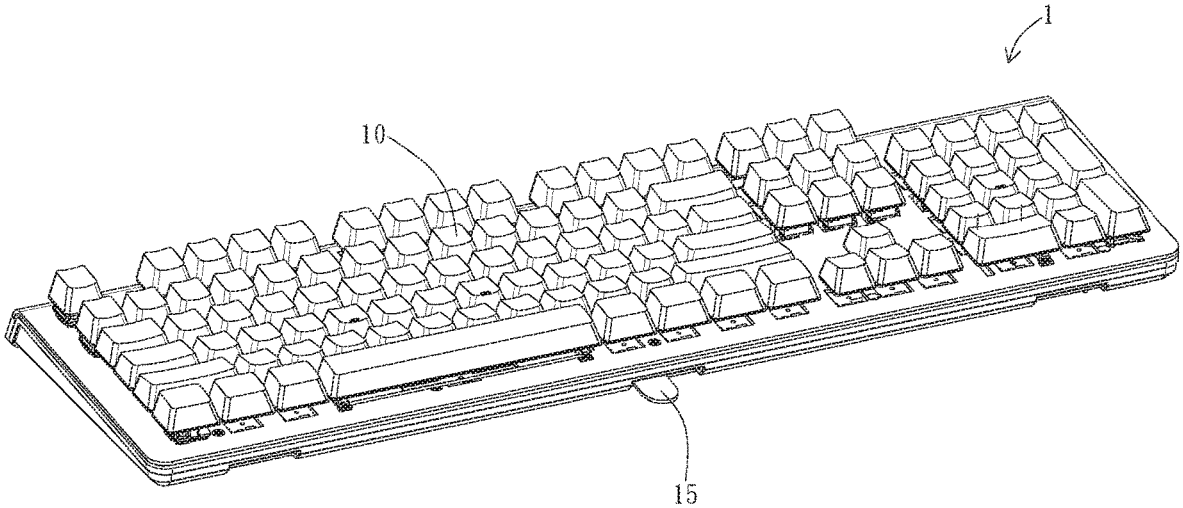
FIG. 18 is a schematic view of an embodiment of the keyboard.

In addition, when a plurality of keyswitch structures such as 10, 20 are integrated into a keyboard, the adjusting units of the keyswitch structures can be integrated into a single component by connecting the connection portions of the keyswitch structures. As shown in FIG. 18, in an embodiment, when a plurality of keyswitch structures 10 are integrated into a keyboard 1, the connection portions 162 of the adjusting units 160 can be connected to each other to form a sheet-like or net-like connection portion. The keyboard 1 can further include a control member 15, which is configured to control the movement of the sheet-like or net-like connection portion, so that the adjusting bar 161 can be controlled to adjust the tactile feedback of the multiple keyswitch structures 10 at the same time. In this embodiment, the control member 15 can be a control bar connected to the connection portion and can be controlled manually or automatically.

It is noted when a plurality of keyswitch structures 20 are integrated into a keyboard, the connection portion 2612 of the X-axis adjusting member 261 of each keyswitch structure 20 can be connected together to form a sheet-like or net-like connection portion, and the connection portion 2622 of the Y-axis adjusting member 262 of each keyswitch structure 20 can be connected together to form another sheet-like or net-like connection portion. The keyboard may further include an X-axis control member and a Y-axis control member to control the X-axis adjusting members 261 and the Y-axis adjusting member 262, separately, but not limited thereto. In another embodiment, according to practical applications, when the plurality of keyswitch structures 20 including merely one of the X-axis adjusting members 261 and the Y-axis adjusting member 262 are integrated into a keyboard, the keyboard can include only one of the X-axis control member and the Y-axis control member to control a corresponding one of the X-axis adjusting members 261 and the Y-axis adjusting member 262.

Figure 19A:
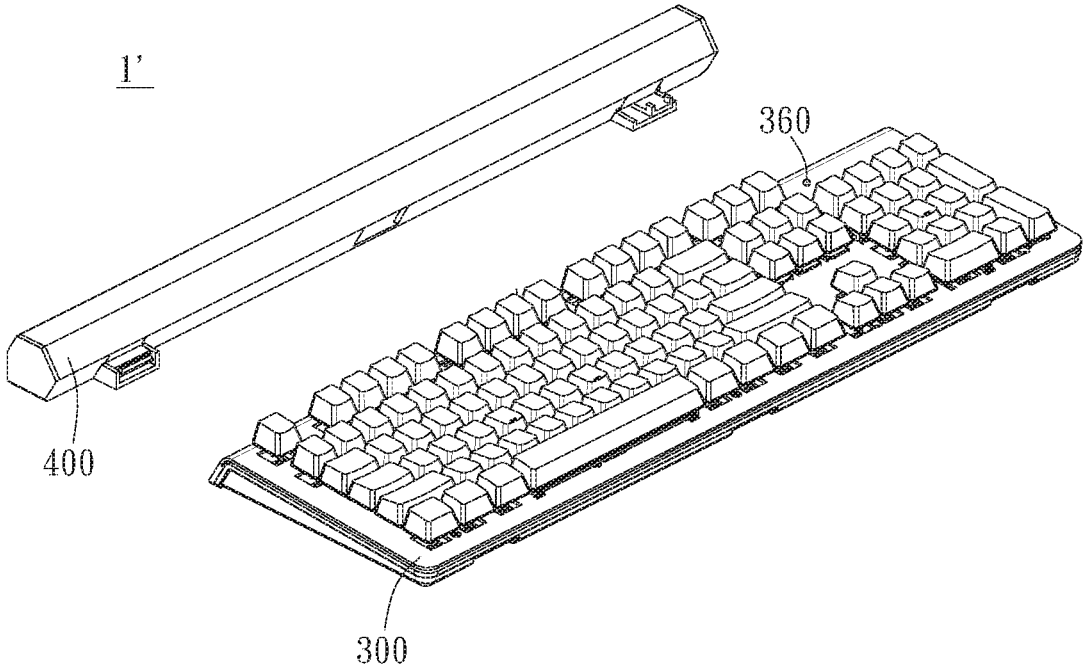
FIGS. 19A and 19C are an exploded view and assembly views from top and bottom of another embodiment of the keyboard, respectively.
Figure 19B:
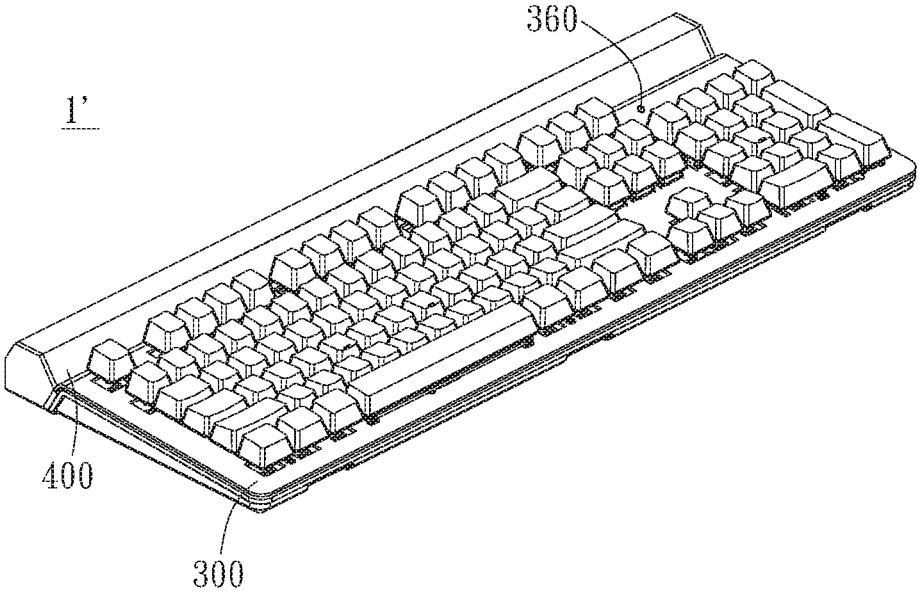
Figure 19C:
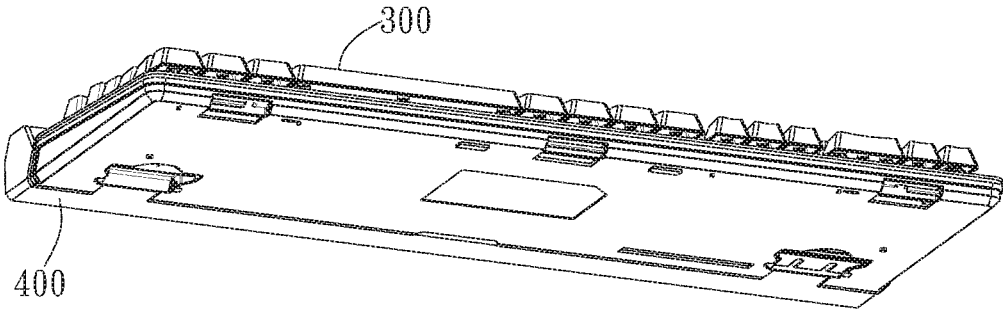

As shown in FIGS. 19A to 19C, in another embodiment, the keyboard 1' of the disclosure includes a keyswitch module 300 and an auxiliary module 400. In this embodiment, the keyswitch module 300 can be an independent keyboard device, and the auxiliary module 400 is a functional auxiliary module, which is preferably detachably connected to the keyswitch module 300, but not limited thereto. In another embodiment, the keyswitch module 300 and the auxiliary module 400 can be integrated into an integral keyboard or to an electronic product, such as a portable information processing device. With reference to the drawings, the keyswitch module 300 and the auxiliary module 400 of the keyboard 1' will be described in detail.

Figure 20A:
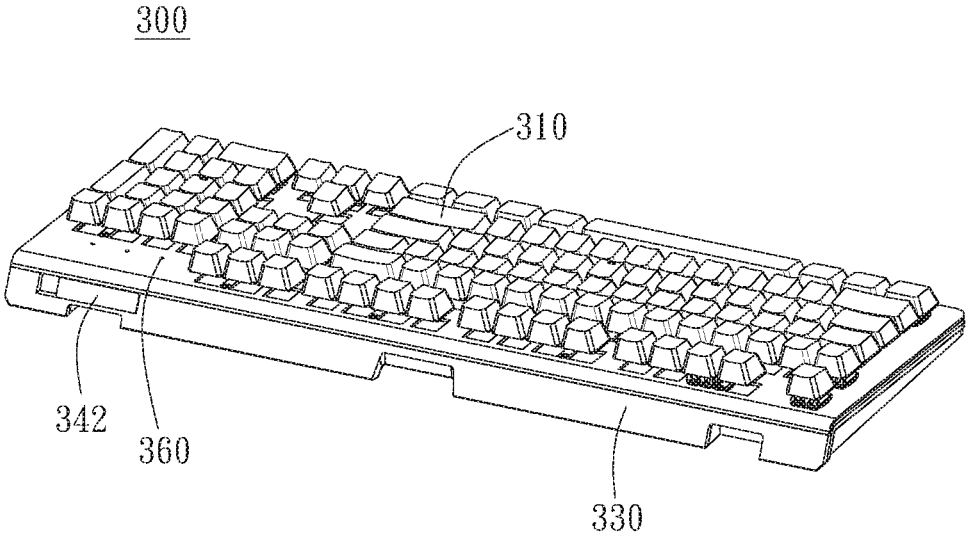
FIGS. 20A and 20B are a perspective view and an exploded view of the keyswitch module of FIG. 19A, respectively.
Figure 20B:
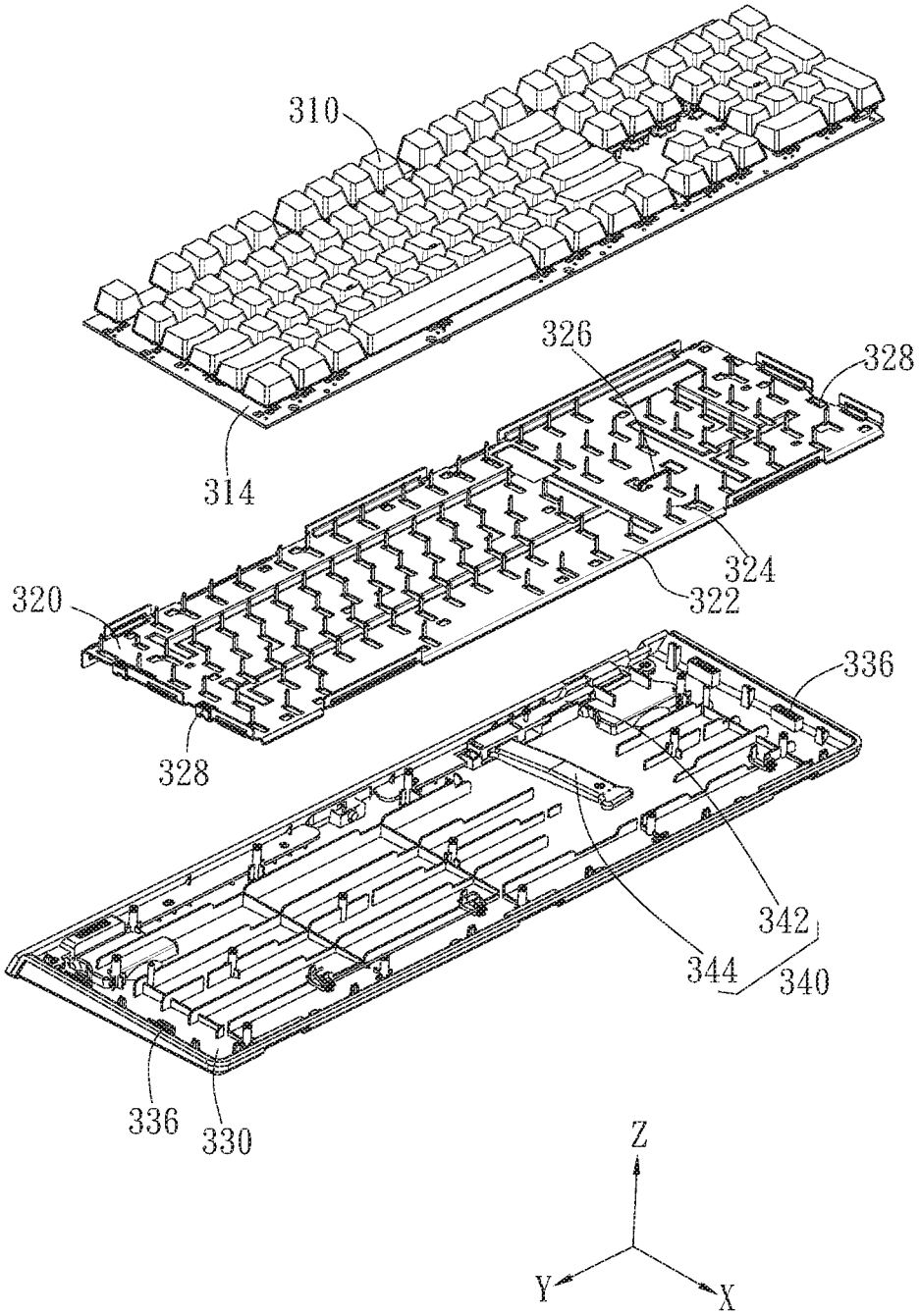

As shown in FIGS. 20A and 20B, in an embodiment, the keyswitch module 300 includes a plurality of keyswitch structures 310, an adjusting plate 320, a bottom housing 330, and a linking mechanism 340. Each of the keyswitch structures 310 includes a tactile feedback member 312. The adjusting plate 320 is disposed under the keyswitch structures 310. The adjusting plate 320 includes a plate body 322 and a plurality of adjusting bars 324. The adjusting bars 324 protrude from the plate body 322 toward the keyswitch structures 310 to respectively correspond to the tactile feedback members 312 (shown in FIG. 21) of the keyswitch structures 310. The bottom housing 330 is disposed under the adjusting plate 320. The linking mechanism 340 is movably disposed on the bottom housing 330 and couples with the adjusting plate 320. When the linking mechanism 340 moves relative to the bottom housing 330, the adjusting plate 320 moves along with the linking mechanism 340, so the adjusting bars 324 drive the tactile feedback members 312 to shift to change the tactile feedback of the keyswitch structures 310 at the same time.

Specifically, the keyswitch structure 310 can be a keyswitch structure similar to those described above, such as the keyswitch structure 10 or 20, and the plurality of keyswitch structures 310 are disposed on a same circuit board 314 or baseplate. That is, the circuit board 190 or 290 (or baseplate) of the keyswitch structures 10 or 20 are preferably integrated into a single circuit board to decrease the number of components and simplify the assembly process. When the keyswitch structure 310 has a structure similar to the keyswitch structure 10, the tactile feedback member 312 can be identical in structure to the tactile feedback member 150. In other words, the positioning portion and the extending arm of the tactile feedback member 312 are the positioning portion 151 and the extending arm 152 extending from the spring body 153. When the keyswitch structure 310 has a structure similar to the keyswitch structure 20, the positioning portion and the extending arm of the tactile feedback member 312 can be identical in structure to the positioning portion 241 and the extending arm 242 of the resilient member 240 of FIG. 8A or the positioning portion 412 and the extending arm 414 of the tactile feedback member 410 of FIG. 15A, 16A, or 17A. The detail of the keyswitch structure 310 can refer to related descriptions of the keyswitch structure 10 or 20 in the previous embodiments, and will not be elaborated again.

In an embodiment, the adjusting plate 320 can be a metal plate, and the adjusting bars 324 are plungers bent upward from the plate body 322, but not limited thereto. In another embodiment, the adjusting plate 320 can be a plastic plate made by molding. That is, the adjusting plate 320 is a single component with the plurality of adjusting bars 324 connected to each other by the plate body 322. In this embodiment, the plate body 322 is preferably a sheet-like body extending in the XY plane and has a size substantially corresponding to the circuit board 314 (or baseplate) of the keyswitch structures 310, but not limited thereto. In another embodiment, the plate body 322 can be a net-like or grid-like body. Moreover, according to the adjusting operation of the keyswitch structure 310, the adjusting bar 324 may have a structure similar to the adjusting bar 161, the X-axis adjusting bar 2611, or the Y-axis adjusting bar 2621 and is disposed corresponding to the positioning portion or the extending arm of the tactile feedback member 312. For example, when the keyswitch structure 310 is similar to the keyswitch structure 10, the adjusting bar 324 is disposed corresponding to the positioning portion and has the connection and operation similar to those of the adjusting bar 161. When the keyswitch structure 310 is similar to the keyswitch structure 20, the adjusting bar 324 can be disposed correspond to the positioning portion and have the connection and operation similar to those of the X-axis adjusting bar 2611 and the positioning portion 241. Alternatively, the adjusting bar 324 can be disposed correspond to the extending arm and have the connection and operation similar to those of the Y-axis adjusting bar 2621 and the extending arm 242. That is, the tactile feedback of the keyswitch structure 310 may be adjusted in a manner similar to the keyswitch structure 10 in FIGS. 4A to 7B or the keyswitch structure 20 in FIGS. 11A to 14B. In sum, the adjusting bar 324 of the adjusting plate 320 can be disposed corresponding to the positioning portion or the extending arm to change the tactile feedback of the keyswitch structure 310, such as different required pressing forces, dome-collapse-like tactile feedback, linear feedback, by controlling the movement of the adjusting bar to change the deformation of the tactile feedback member or the position of the extending arm relative to the moving path of the cam portion.

Figure 21:
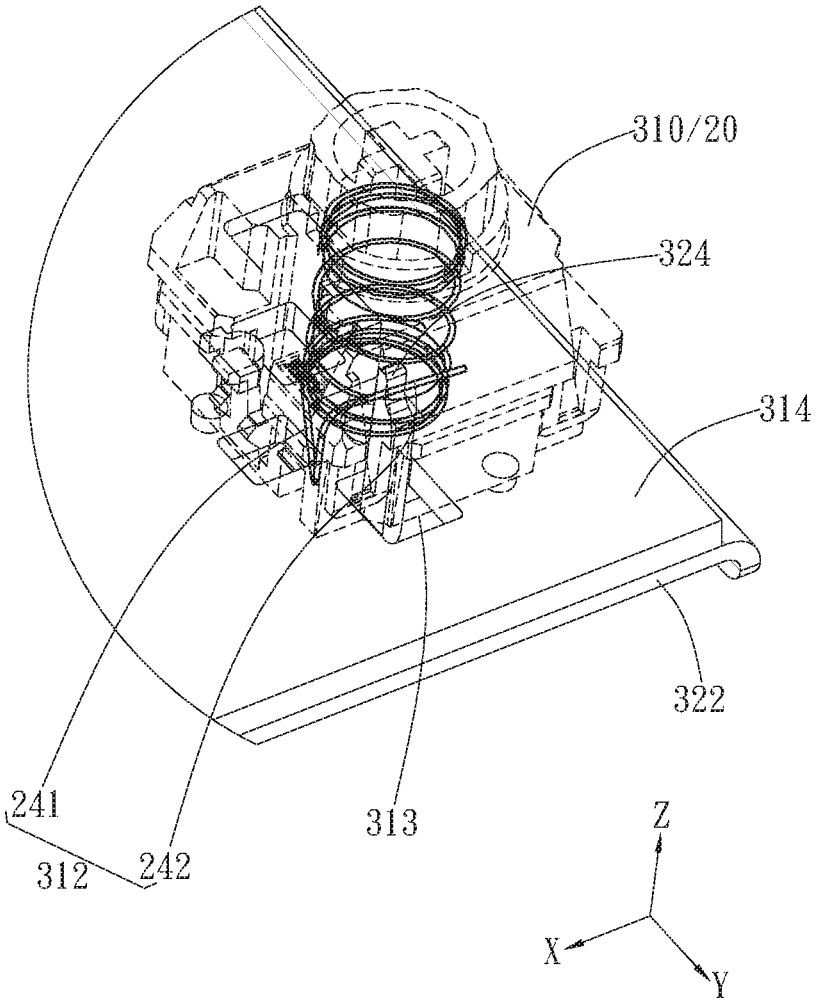
FIG. 21 is a partially enlarged view of the keyswitch module.

As shown in FIG. 21, in this embodiment, the keyswitch structure 310 is similar to the keyswitch structure 20. The adjusting bar 324 is inserted into the Y-axis slot 313 and protrudes upward corresponding to the extending arm 242. That is, the adjusting bar 324 functions as the Y-axis adjusting bar 2621 in the previous embodiment, but not limited thereto. In another embodiment (not shown), by modifying the relative position of the adjusting bar 324 to the tactile feedback member 312, the adjusting bar 324 can function as the adjusting bar 161 or the X-axis adjusting bar 2611. In another embodiment (not shown), the keyboard 1' can include two adjusting plates and corresponding linking mechanism, wherein one adjusting plate has the adjusting bars functioning as the Y-axis adjusting bar 2621, and the other adjusting plate has the adjusting bars functioning as the X-axis adjusting bar 2611, so that the tactile feedback of the keyswitch structure 310 can be adjusted in two directions, such as the X-axis direction and the Y-axis direction.

As shown in FIG. 20B, the linking mechanism 340 preferably includes a first linking bar 342 and a second linking bar 344. The first linking bar 342 is movably disposed on the bottom housing 330, and the second linking bar 344 is rotatably disposed on the bottom housing 330. A first end 3441 of the second linking bar 344 couples with the first linking bar 342, and a second end 3442 of the second linking bar 344 couples with the plate body 322. Referring to FIGS. 22A-22B and FIGS. 23A-23B, in an embodiment, the first linking bar 342 has an accommodation portion 3421, and the first end 3441 of the second linking bar 344 is accommodated in the accommodation portion 3421. Specifically, the first linking bar 342 extends along the Y-axis direction and is disposed at one side of the bottom housing 330 along the Y-axis direction. For example, the first linking bar 342 is disposed on the side of the bottom housing 330 near the auxiliary module 400. The bottom housing 330 preferably has a positioning portion 331, which is configured to position the first linking bar 342. For example, the positioning portion 331 is preferably a blocking wall or post, which can be disposed along the Y-axis direction and spaced apart from the outer wall of the bottom housing 330. As such, the disposing location of the first linking bar 342 on the bottom housing 330 is defined, and the movement of the first linking bar 342 in the X-axis direction is restricted. In other words, the distance between the positioning portion 331 and the corresponding outer wall of the bottom housing 330 in the X-axis direction is preferably substantially equal to or larger than the width of the first linking bar 342 in the X-axis direction. As such, the first lining bar 342 is allowed to move along the Y-axis direction relative to the bottom housing 330, and the displacement of the first linking bar 342 in the X-axis direction is limited. In this embodiment, the positioning portion 331 is implemented as the blocking wall, but not limited thereto. In another embodiment, in response to the design of the first linking bar 342, the positioning portion 331 can be a groove or a rail.

The first linking bar 342 further has a protrusion 3423 protruding downward to define the accommodation portion 3421. For example, the first linking bar 342 has a plurality of protrusions 3423. When the first linking bar 342 is movably disposed on the bottom housing 330 corresponding to the positioning portion 331, the space defined by two adjacent protrusions 3423 and the surface of the bottom housing 330 serves as the accommodation portion 3421 to allow the first end 3441 of the second linking bar 344 to be accommodated therein, but not limited thereto. In another embodiment, the accommodation portion 3421 can be an opening opened into or a recessed space recessed from the surface of the first linking bar 342.

The first linking bar 342 preferably further has a control member 3422, and the base has a notch 332 corresponding to the control member 3422. As such, similar to the keyboard 1, the keyswitch module 300 can adjust the relative position of the adjusting plate 320 (e.g. the adjusting bars 324) to the tactile feedback members 312 by controlling the control member 3422, so as to manually change the tactile feedback. For example, when the first linking bar 342 is disposed on the bottom housing 330, the control member 3422 of the first linking bar 342 preferably extends outside the bottom housing 330 from the notch 332, so the user can move the first linking bar 342 by the control member 3422, but not limited thereto. In another embodiment, the first linking bar 342 can have a coupling portion 3426, which is coupled to a driving device, so the tactile feedback of the keyswitch module 300 can be changed by electric or signal control (will be described later). In this embodiment, the coupling portion 3426 can be a coupling slot formed in the bottom of the first linking bar 342, but not limited thereto.

Figure 22A:
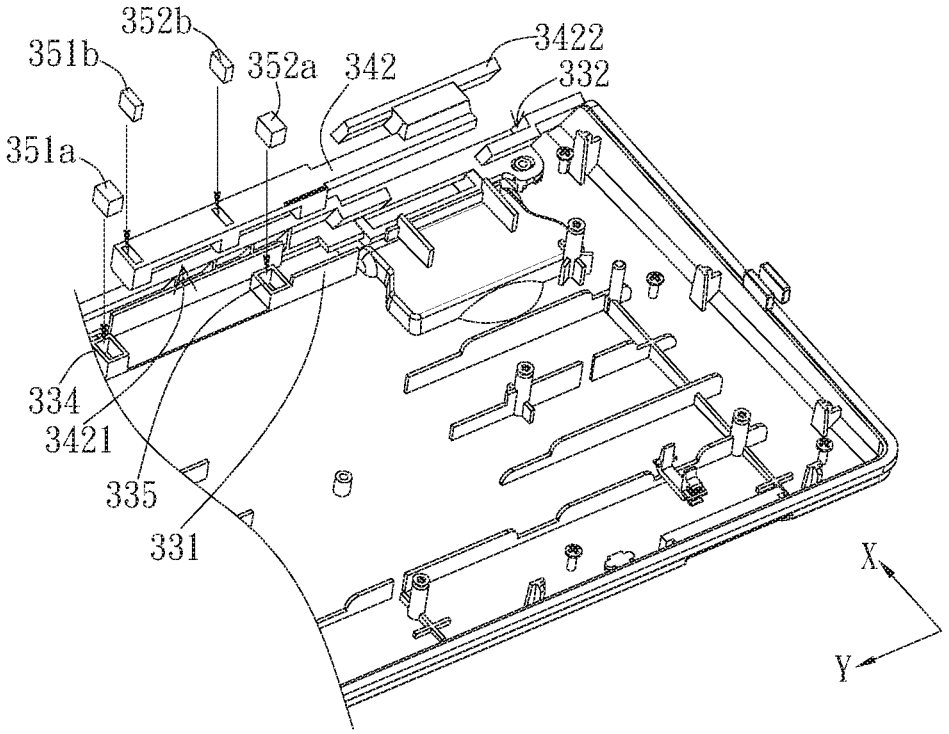
FIGS. 22A and 22B are an exploded view and an assembly view of the first linking bar and the base, respectively.
Figure 22B:
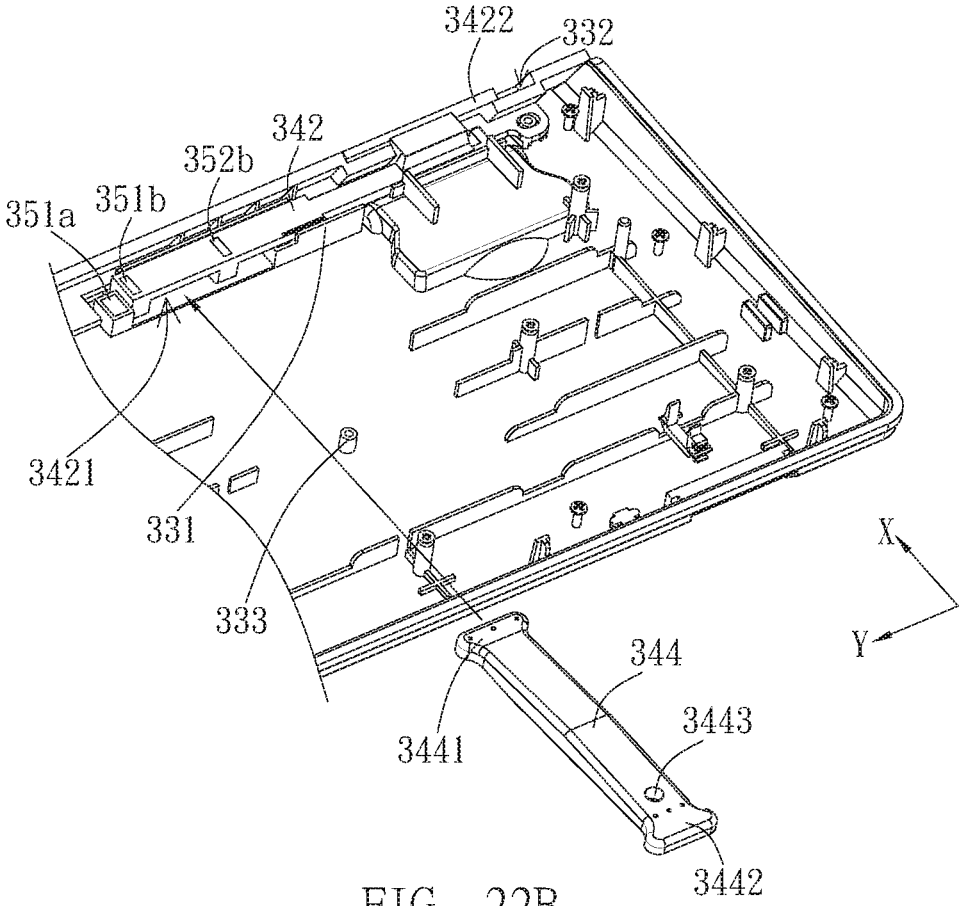
Figure 23A:
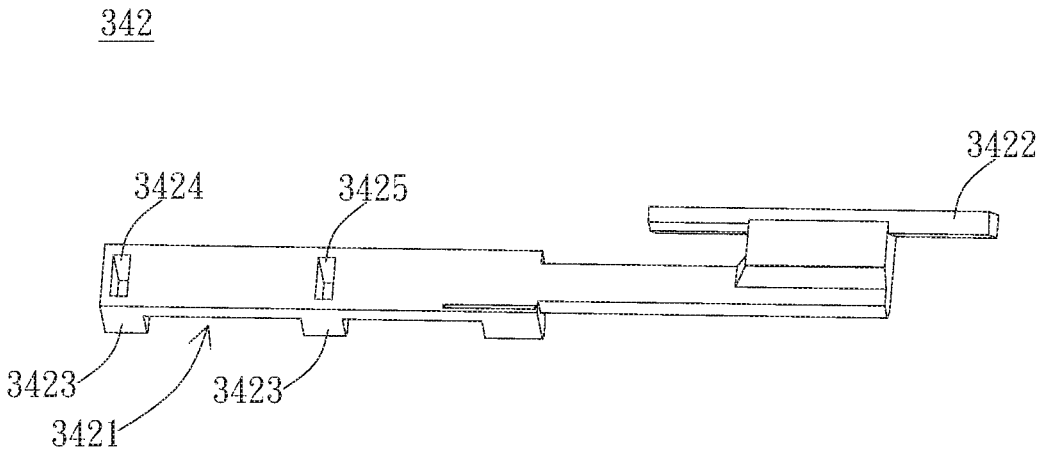
FIGS. 23A and 23B are schematic views of the first linking bar from different viewing angles.
Figure 23B:
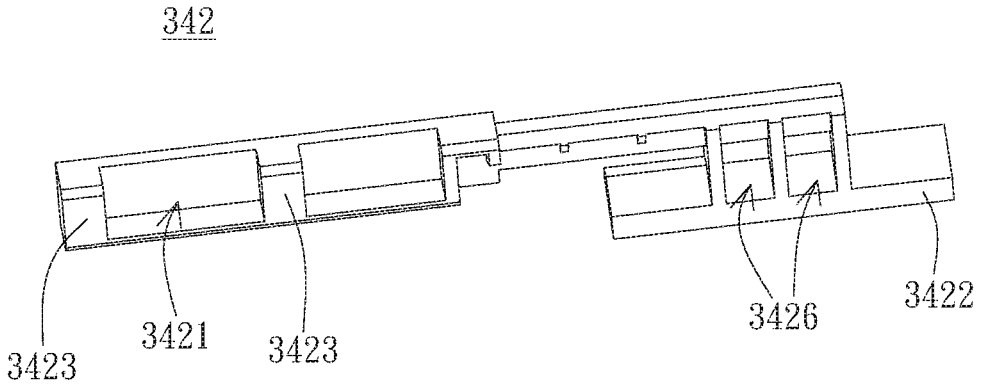

As shown in FIGS. 22A and 22B, the keyboard 1' preferably further includes a pair of magnetic members 351*a*, 351*b*. The pair of magnetic members 351*a*, 351*b* are disposed corresponding to the bottom housing 330 and the first linking bar 342. When the linking mechanism 340 moves, the pair of magnetic members 351*a*, 351*b* are selectively close to or away from each other. In this embodiment, the keyboard 1' preferably has two pair of magnetic members, such as one pair of magnetic members 351*a*, 351*b* and the other pair of magnetic members 352*a*, 352*b*, which are disposed along the moving direction of the first linking bar 342, such as the Y-axis direction. When the linking mechanism 340 moves, for example, the first linking bar 342 moving to the left side, one pair of the magnetic members 351*a*, 351*b* are getting close to each other, and the other pair of the magnetic members 352*a*, 352*b* are getting away from each other. Alternatively, when the first linking bar 342 moves to the right side, one pair of the magnetic members 352*a*, 352*b* are getting close to each other, and the other pair of the magnetic members 351*a*, 351*b* are getting away from each other. Each pair of the magnetic members preferably has magnetic attractive force therebetween. Therefore, the pair of magnetic members 351*a*, 351*b* can enhance the positioning effect toward the left side, and the pair of magnetic members 352*a*, 352*b* can enhance the positioning effect toward the right side.

Corresponding to the deposition of the magnetic members 351*b*, 352*b*, the first linking bar 342 preferably has slots 3424, 3425, which are configured to accommodate the magnetic members 351*b*, 352*b*. For example, the slots 3424, 3425 are disposed corresponding to the protrusions 3423. In this embodiment, the slots 3424, 3425 are holes formed in the protrusions 3423 from the surface of the first linking bar 342, i.e. the protrusion 3423 can be a hollow column, and the magnetic members 351*b*, 352*b* are disposed in the slots 3424, 3425, respectively, but not limited thereto. In another embodiment, the slots 3424, 3425 can be holes recessing from the bottom of the protrusions 3423 toward the first linking bar 342. The bottom housing 330 preferably has corresponding slots 334, 335, which are configured to accommodate the magnetic members 351*a*, 352*a*, but not limited thereto. In another embodiment, the magnetic members 351*a*, 352*a* and 351*b*, 352*b* can be respectively adhered to the bottom housing 330 and the first linking bar 342 to eliminate the formation of the slots 334, 335 or 3424, 3425.

The second linking bar 344 is preferably disposed along the X-axis direction, so that the first end 3441 of the second linking bar 344 is accommodated in the accommodation portion 3421, and the second end 3442 of the second linking bar 344 is pivotally connected to the bottom housing 330. For example, the bottom housing 330 has pivotal portion 333, and the second linking bar 344 has a pivotal hole 3443 near the second end 3442. When the second linking bar 344 is disposed on the bottom housing 330, the first end 3441 of the second linking bar 344 extends into the accommodation portion 3421, and the pivotal portion 333 couples with the pivotal hole 3443 at the second end 3442 of the second linking bar 344 by a pin or a bolt to form a pivot, so that the second linking bar 344 is rotatable relative to the bottom housing 330. When the first linking bar 342 moves along the Y-axis direction, the first linking bar 342 drives the first end 3441 of the second linking bar 344 to rotate in the same direction along the Y-axis, and the second end 3442 of the second linking bar 344 correspondingly moves oppositely in the Y-axis direction. The end portion of the second lining bar 344, such as the first end 3441, preferably has a curved profile, so the protrusion 3423 of the first linking bar 342 is contacted with the curved surface to enhance the linkage of the first linking bar 342 and the second linking bar 344.

Figure 24A:
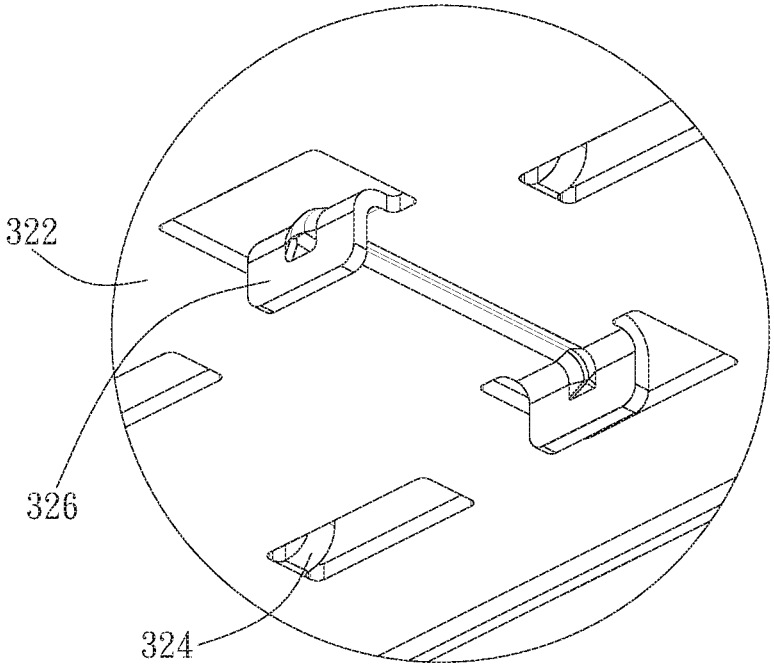
FIGS. 24A and 24B are a schematic view of the coupling portion of the adjusting plate and a cross-sectional view of the connection with the second linking bar.
Figure 24B:
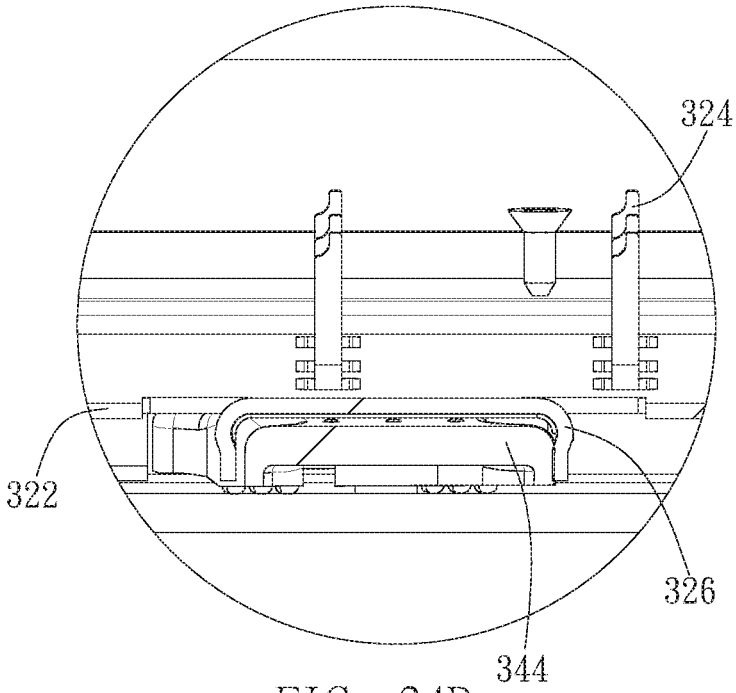
Figure 25A:
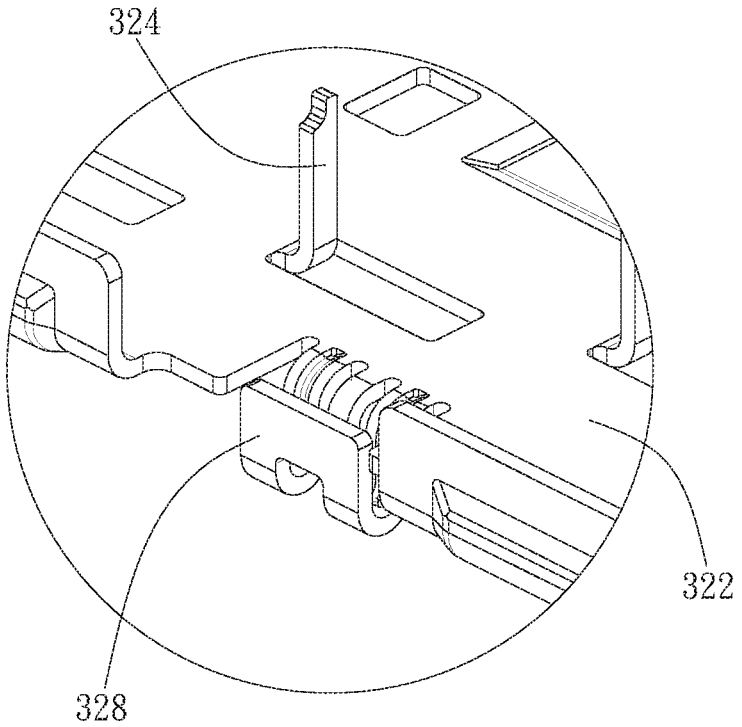
FIGS. 25A and 25B are schematic views of the receiving portion of the adjusting plate from different viewing angles.
Figure 25B:
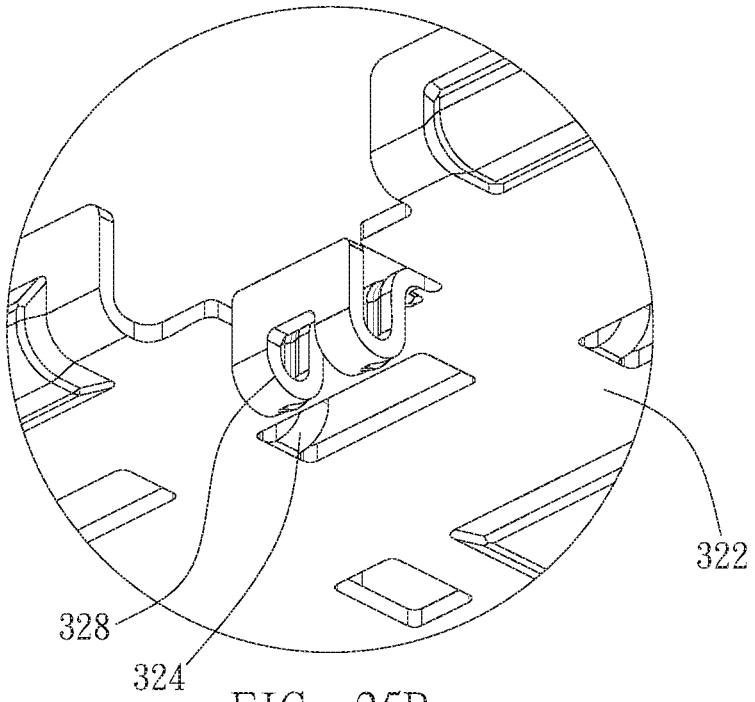
Figure 26:
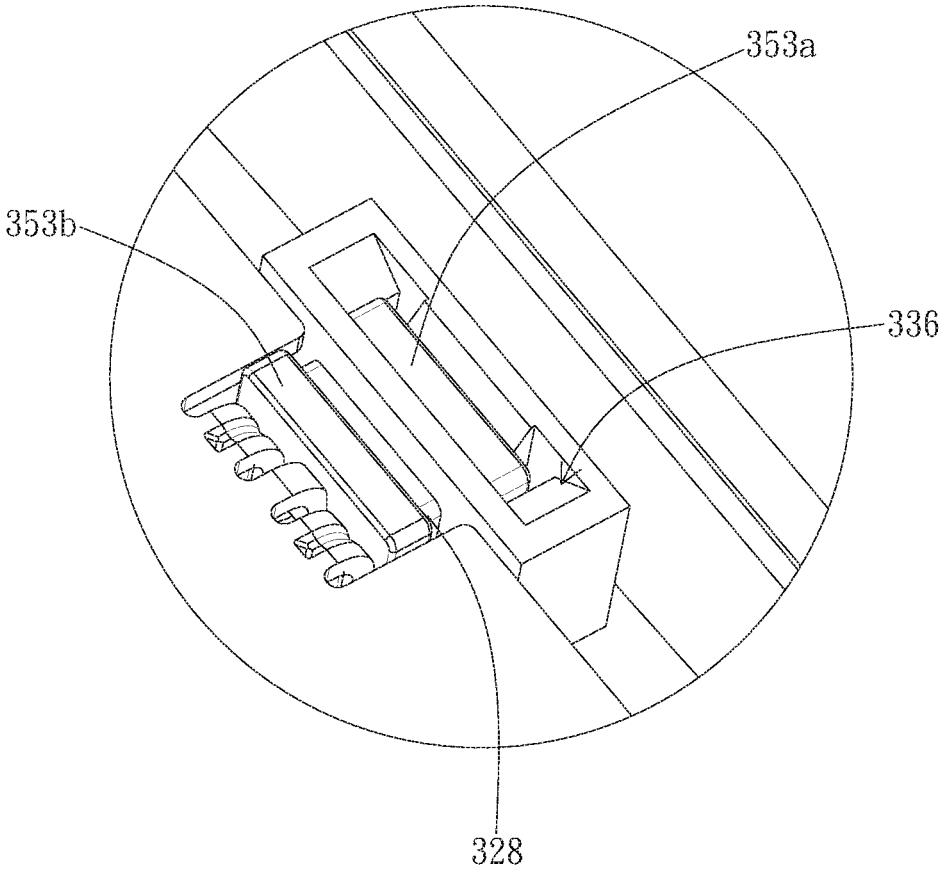
FIG. 26 is a schematic view of the magnetic members in the adjusting plate and the base.

As shown in FIG. 20B and FIG. 24A-24B, the plate body 322 of the adjusting plate 320 has a coupling portion 326, which is configured to couple with the second end 3442 of the second linking bar 344. The coupling portion 326 is preferably bent downward from the plate body 322 to couple with the second end 3442 of the second linking bar 344. For example, the coupling portion 326 and the adjusting bars 324 protrude away from the plate body 322 toward opposite directions, e.g. downward and upward, respectively. The coupling portion 326 can be a structure with an engaging groove, so that the coupling portion 326 can engage with the second end 3442 of the second linking bar 344. When the first linking bar 342 moves along the Y-axis direction, the first linking bar 342 drives the first end 3441 of the second linking bar 344 to rotate in the same direction along the Y-axis direction, and the second end 3442 of the second linking bar 344 correspondingly moves oppositely in the Y-axis direction, so that the adjusting bars 324 drive the corresponding tactile feedback members 312 to shift. It is noted that the adjusting plate 320 can be connected to the second end 3442 of the second linking bar 344 by other methods, such as screwing, adhering, and not limited to the embodiments.

As shown in FIG. 20B and FIGS. 25A-25B and 26, the keyboard 1' further includes a pair of magnetic members 353*a*, 353*b*, which are disposed corresponding to the bottom housing 330 and the adjusting plate 320. When the linking mechanism 340 moves, the pair of magnetic members 353*a*, 353*b* are selectively close to or away from each other. In this embodiment, the keyboard 1' preferably has two pairs of magnetic members 353*a*, 353*b*, which are disposed along the moving direction of the adjusting plate 320, such as the Y-axis direction, at two opposite sides of the bottom housing 330. When the linking mechanism 340 moves, for example, the first linking bar 342 moving to the left side, one pair of the magnetic members 353*a*, 353*b* at the left side are getting close to each other, and the other pair of the magnetic members 353*a*, 353*b* at the right side are getting away from each other. Alternatively, when the first linking bar 342 moves to the right side, one pair of the magnetic members 353*a*, 353*b* at the right side are getting close to each other, and the other pair of the magnetic members 353*a*, 353*b* at the left side are getting away from each other. Each pair of the magnetic members 353*a*, 353*b* preferably has magnetic attractive force therebetween. Therefore, the pair of magnetic members 353*a*, 353*b* can enhance the positioning effect from left to right, or from right to left.

Corresponding to the deposition of the magnetic members 353*a*, 353*b*, the adjusting plate 320 preferably has a receiving portion 328, which is configured to receive the magnetic member 353*b*. In this embodiment, the receiving portion 328 is preferably a bearing structure with a groove formed by bending the plate body 322 from the side of the plate body 322, and the magnetic member 353*b* can be disposed in the groove. The bottom housing 330 preferably has a corresponding slot 336, which is configured to accommodate the magnetic members 353*a*, but not limited thereto. In another embodiment, the magnetic members 353*a*, 353*b* can be respectively adhered to the bottom housing 330 and the adjusting plate 320 to eliminate the use of the receiving portion 328 or the slot 336.

It is noted that the pair of magnetic members 351*a* and 351*b*, 352*a* and 352*b*, or 353*a* and 353*b* can be implemented as magnets, or a combination of magnet and magnetic material. The magnetic members are disposed in pair in the above embodiment to enhance the positioning effect of the adjusting plate (or the first linking bar) and the base, but not limited thereto. When one of the adjusting plate (or the first linking bar) and the base is made of magnetic material, such as iron, one magnetic member (such as magnet) can be used to correspondingly enhance the positioning effect.

Figure 27A:
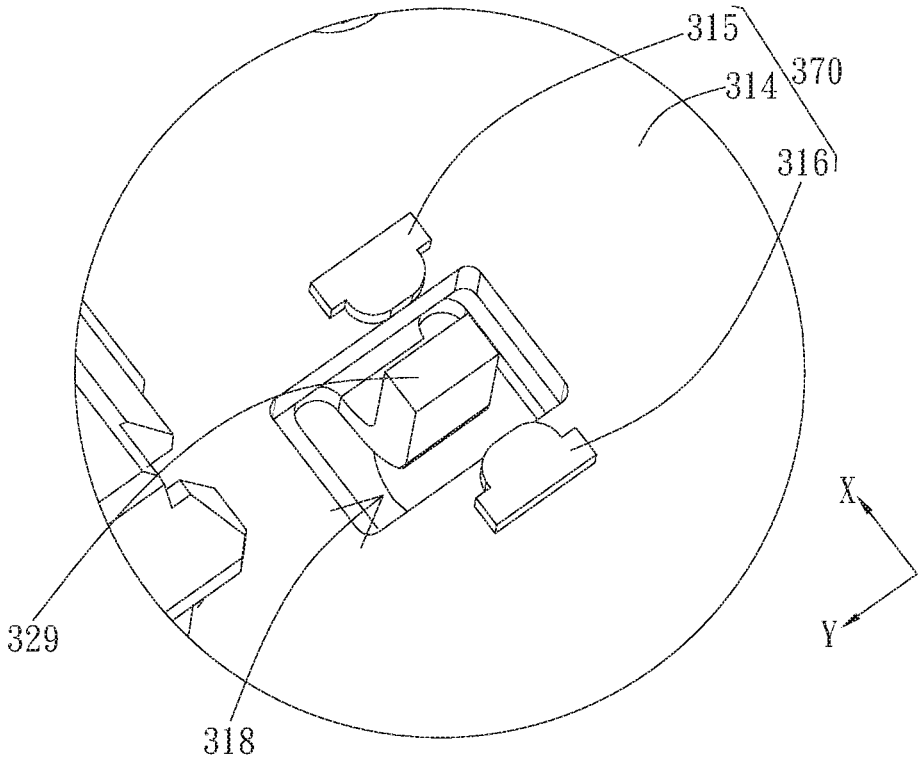
FIGS. 27A and 27B are schematic views of the switch unit and the indicator bar at different relative positions.
Figure 27B:
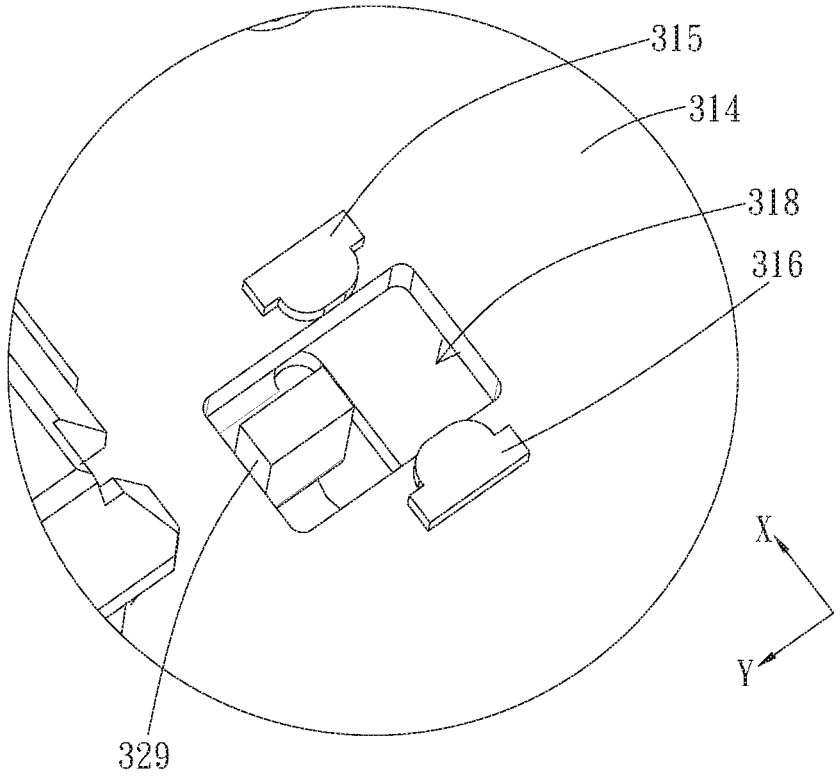

As shown in FIGS. 27A and 27B, the keyboard 1' further includes a switch unit 370 and an indicator 360 (shown in FIG. 19). The indicator 360 is electrically connected to the switch unit 370. The adjusting plate 320 further includes an indicator bar 329 disposed corresponding to the switch unit 370. When the linking mechanism 340 moves, the indicator bar 329 selectively triggers the switch unit 370 to change an indicating status of the indicator 360 to indicate whether the tactile feedback of the keyswitch structures 310 is changed. Specifically, the indicator bar 329 is a bar or rod, which extends from the plate body 322 toward the circuit board 314 and passes the opening 318 of the circuit board 314 from the bottom to protrude upward corresponding to the switch unit 370. In this embodiment, the switch unit 370 can be an optical switch and include an emitter 315 and a receiver 316, which are disposed on the circuit board 314. The circuit board 314 includes a switch circuit. The emitter 315 and the receiver 316 are electrically connected to the switch circuit of the circuit board 314 and located at two sides of the opening 318. The indicator 360 can be a light source and electrically connected to the switch circuit of the circuit board 314. The indicator 360 can change the indicating status in response to the triggering status of the switch unit 370, such as lighting or not lighting. For example, as shown in FIG. 27A, when the linking mechanism 340 drives the adjusting plate 320 to move to the first position relative to the bottom housing 330, e.g. the adjusting plate 320 moving to the right side relative to the bottom housing 330, the indicator bar 329 moves to the light path between the emitter 315 and the receiver 316 to at least partially block or substantially completely block the light signal from the emitter 315 to the receiver 316, and the indicator 360 is at the first indicating status, such as not lighting. As shown in FIG. 27B, when the linking mechanism 340 drives the adjusting plate 320 to move to the second position relative to the bottom housing 330, e.g. the adjusting plate 320 moving to the left side relative to the bottom housing 330, the indicator bar 329 moves away from the light path between the emitter 315 and the receiver 316 without blocking the light signal or less blocking the light signal from the emitter 315 to the receiver 316, and the indicator 360 is at the second indicating status, such as lighting. As such, the user can identify the tactile feedback provided by the keyswitch structures 310 by identifying the indicating status of the indicator 360, but not limited thereto. In another embodiment, the indicator 360 can be a sound-generating device, which provides an audio signal based on whether the switch unit 370 is triggered to notify the user of the current tactile feedback provided by the keyswitch structures 310. It is noted that the switch unit 370 is implemented as an optical switch, but not limited thereto. In another embodiment, the switch unit 370 can be a mechanical switch. When the linking mechanism 340 drives the adjusting plate 320 to move, the indicator bar 329 moves to selectively trigger the mechanical switch, so that the indicator 360 can indicate the current tactile feedback provided by the keyswitch structures 310.

Figure 28A:
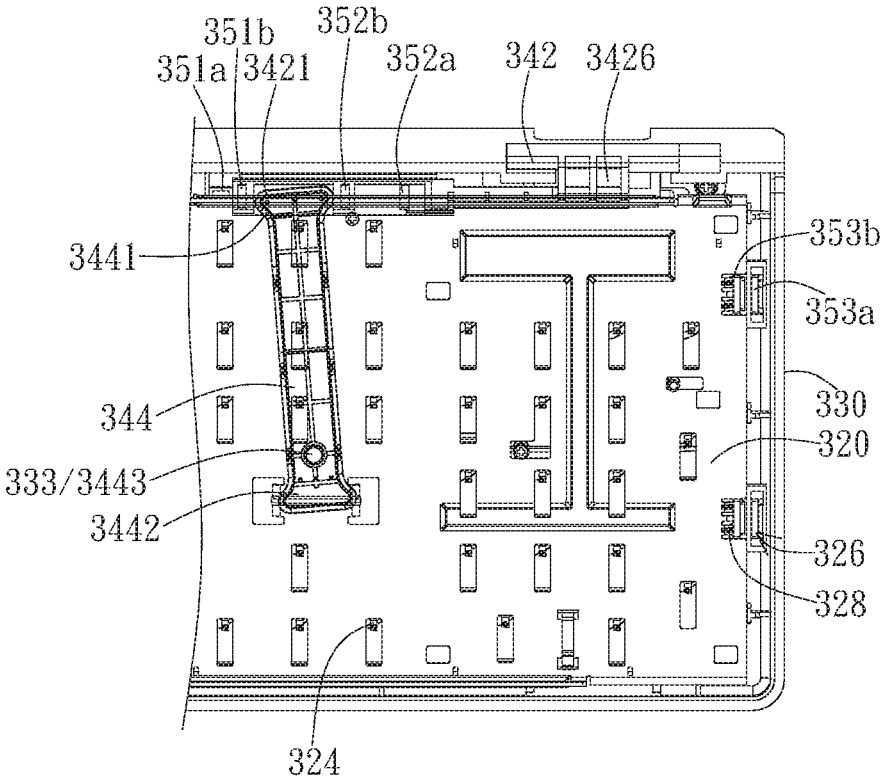
FIGS. 28A and 28B are schematic operation views of the keyboard of the invention.
Figure 28B:
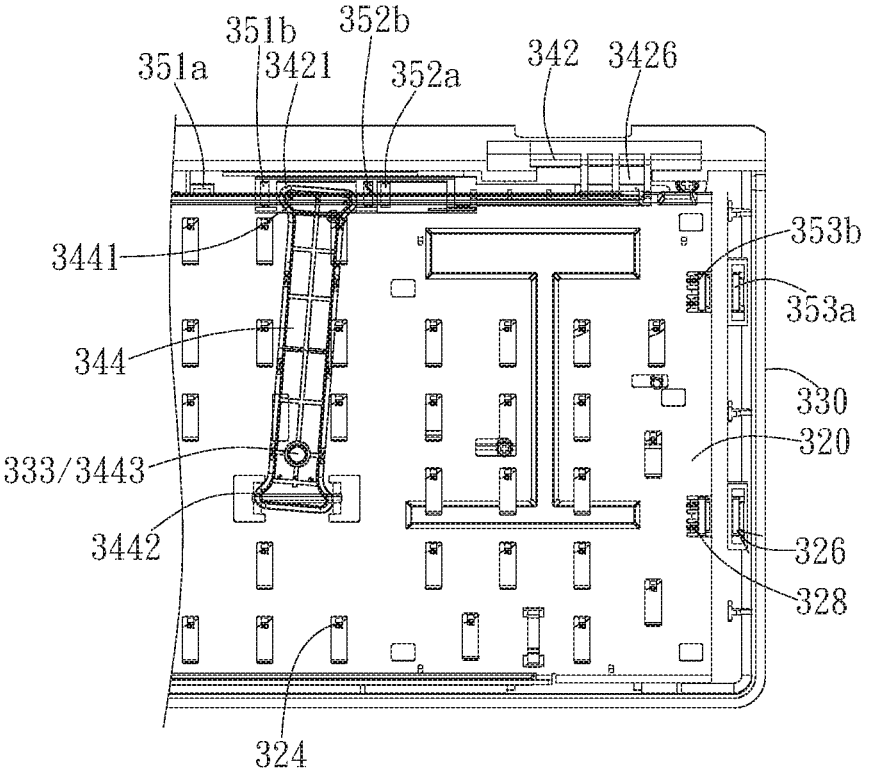

Referring to FIGS. 28A and 28B, the operation of the linking mechanism 340 and the adjusting plate 320 will be described. The keyboard 1' (or the keyswitch module 300) can change the tactile feedback of the keyswitch structures 310 at the same time by controlling the movement of the linking mechanism 340 to drive the adjusting plate 320 to move, so the operation of changing the tactile feedback of the keyswitch structures 310 is convenient and simple. As shown in FIG. 28A, when the linking mechanism 340 and the adjusting plate 320 are located at the first position relative to the bottom housing 330, the adjusting bar 324 is located at a position relative to the extending arm of the tactile feedback member 312 similar to that in FIG. 11B, 12B, or 13B, e.g. the position of FIG. 11B in this embodiment, so the plurality of keyswitch structures 310 provide a first tactile feedback. In this configuration, the adjusting plate 320 is closer to the right side of the bottom housing 330, wherein the magnetic member 353*a* at the right side of the bottom housing 330 and the magnetic member 353*b* at the right side of the adjusting plate 320 are close to each other due to attraction force, and the magnetic member 351*a* of the bottom housing 330 and the magnetic member 351*b* of the adjusting plate 320 are close to each other due to attraction force, so as to enhance the positioning effect of the adjusting plate 320 at the first position.

As shown in FIG. 28B, when the linking mechanism 340 drives the adjusting plate 320 to move to the second position relative to the bottom housing 330, the adjusting bar 324 is located at a position relative to the extending arm of the tactile feedback member 312 similar to that in FIG. 12B, 13B, or 14B, e.g. the position of FIG. 12B in this embodiment, so the plurality of keyswitch structures 310 provide a tactile feedback different the first tactile feedback. Specifically, when the first linking bar 342 moves along the Y-axis direction to the right side, the first linking bar 342 drives the first end 3441 of the first linking bar 344 rotates clockwise along the Y-axis direction, and the second end 3442 of the second linking bar 344 correspondingly drives the adjusting plate 340 to move in the Y-axis direction toward the left side.

As such, the plurality of adjusting bars 324 drive the corresponding extending arms of the tactile feedback members 312 to move along the Y-axis direction toward the left side, e.g. moving in a direction away from the moving path of the cam portion 131, so as to change the tactile provided by the keyswitch structures 310, such as a different pressing force, a dome-collapse-like tactile feedback, or a linear feedback. In this configuration, the adjusting plate 320 is closer to the left side of the bottom housing 330, wherein the magnetic member 353*a* at the left side of the bottom housing 330 and the magnetic member 353*b* at the left side of the adjusting plate 320 are close to each other due to attraction force, and the magnetic member 352*a* of the bottom housing 330 and the magnetic member 352*b* of the adjusting plate 320 are close to each other due to attraction force, so as to enhance the positioning effect of the adjusting plate 320 at the second position.

Figure 29A:
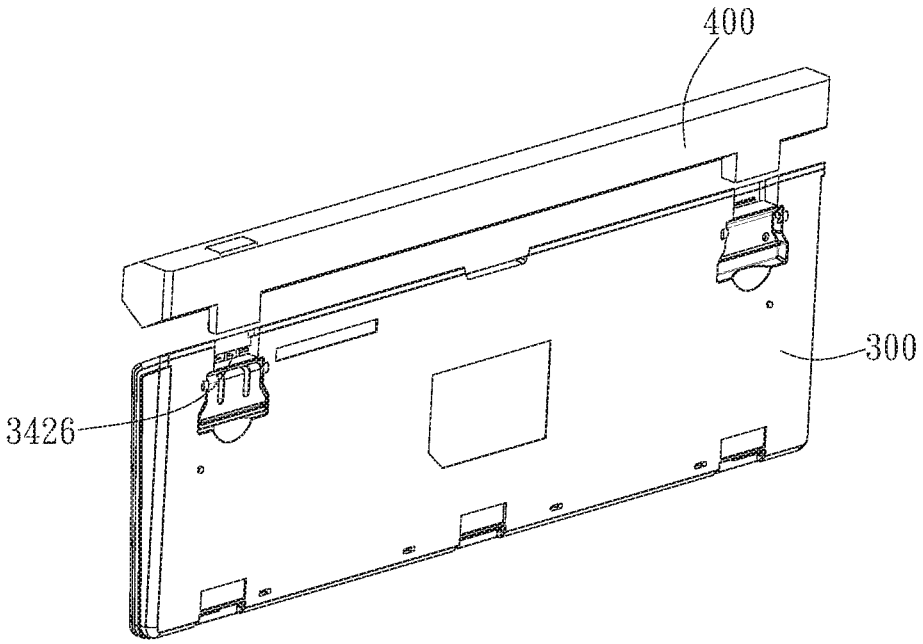
FIGS. 29A and 29B are a schematic view of the auxiliary module and the keyswitch module and a partial enlarged view showing the connection thereof.
Figure 29B:
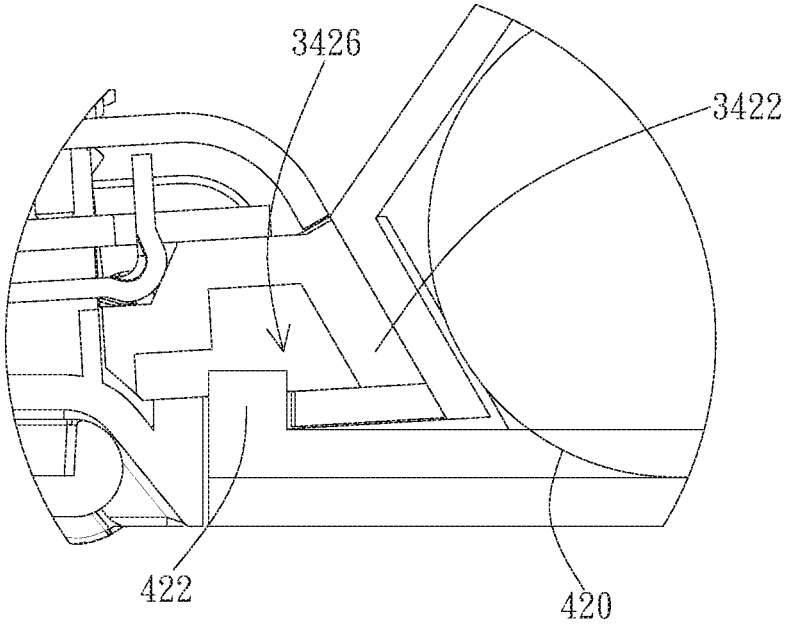
Figure 30:
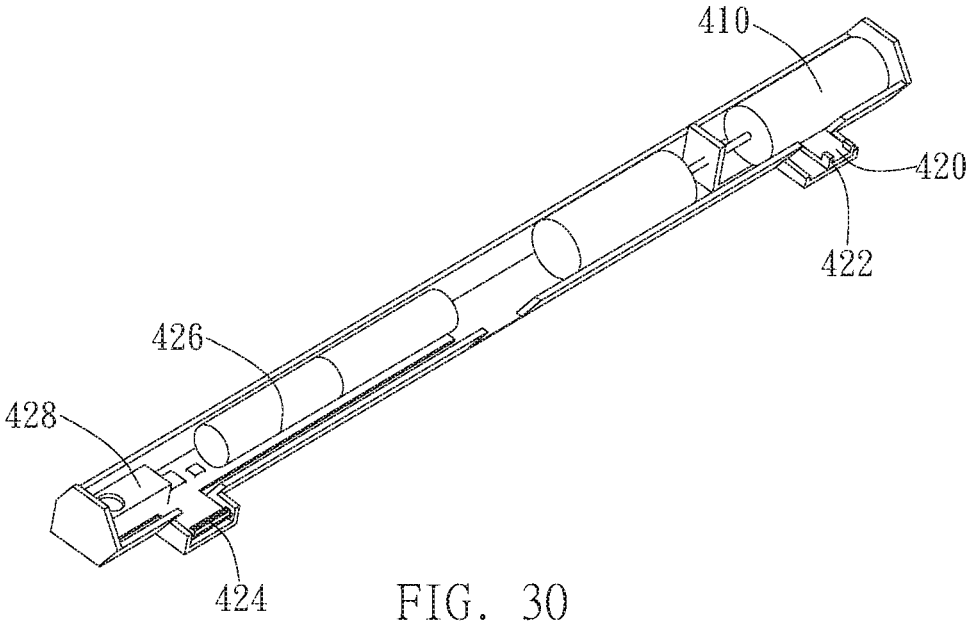
FIG. 30 is a schematic view showing the internal arrangement of the auxiliary module of FIG. 19A.

As shown in FIGS. 29A-29B and FIG. 30, in an embodiment, the auxiliary module 400 includes a driving device 410 and a coupling member 420. The coupling member 420 couples the driving device 410 and the linking mechanism 340. The driving device 410 drives the coupling member 420 to move to drive the linking mechanism 340 to move relative to the bottom housing 330, so that the adjusting plate 320 moves along with the linking mechanism 340, and the adjusting bars 324 drive the tactile feedback members 312 to change tactile feedback of the keyswitch structures 310. Specifically, the driving unit 410 can include a step motor or an electromagnetic driver. When the keyswitch structures 310 are intended to provide more than two kinds of tactile feedback, the driving device 410 is preferably implemented as the step motor. By controlling the step motor with the electrical signal, the moving distance of the coupling portion 420 and the adjusting plate 320 can be controlled, so that the relative position of the adjusting bars 324 and the corresponding extending arms of the tactile feedback members is similar to one of the positions in FIGS. 11B, 12B, 13B, and 14B, to achieve the adjustment of the tactile feedback, such as different required pressing forces, dome-collapse-like tactile feedback, linear feedback. When the keyswitch structures 310 are intended to provide only two kinds of tactile feedback, the driving device 410 can be implemented as the electromagnetic driver. By controlling the electromagnetic driver with the electrical signal, the coupling portion 420 switches between the first position and the second position, so that the relative position of the adjusting bars 324 and the corresponding extending arms of the tactile feedback members is similar to one of any two positions in FIGS. 11B, 12B, 13B, and 14B, to achieve the adjustment between two kinds of tactile feedbacks including different required pressing forces, dome-collapse-like tactile feedback, linear feedback.

As shown in FIGS. 29A and 29B, the coupling portion 420 preferably has a hook portion 422 corresponding to the coupling portion 3426 of the first linking bar 342. When the auxiliary module 400 is connected to the keyswitch module 300, the hook portion 422 extends into the slot of the coupling portion 3426 to couple with the first linking bar 342, but not limited thereto. In another embodiment, the coupling portion 3426 of the first linking bar 324 can have a hook shape, and the coupling portion 420 is a corresponding slot, so the coupling portion 420 can be coupled to the first linking bar 342 by a combination of hook and slot. Moreover, when the auxiliary module 400 and the keyswitch module 300 are combined together, the coupling portion 420 and the first linking bar 342 can be coupled as an integral component in outer appearance. In addition, the auxiliary module 400 and the keyswitch module 300 are preferably electrically connected through pogo pins. As shown in the drawings, the auxiliary module 400 (or the keyswitch module 300) is preferably disposed with pogo pin connector 424 to promote the reliability and convenience of electrical connection of the auxiliary module 400 and the keyswitch module 300. In this embodiment, the pogo pin connector 424 and the coupling portion 420 are preferably disposed on two sides of the auxiliary module 400, but not limited thereto.

Figure 31:
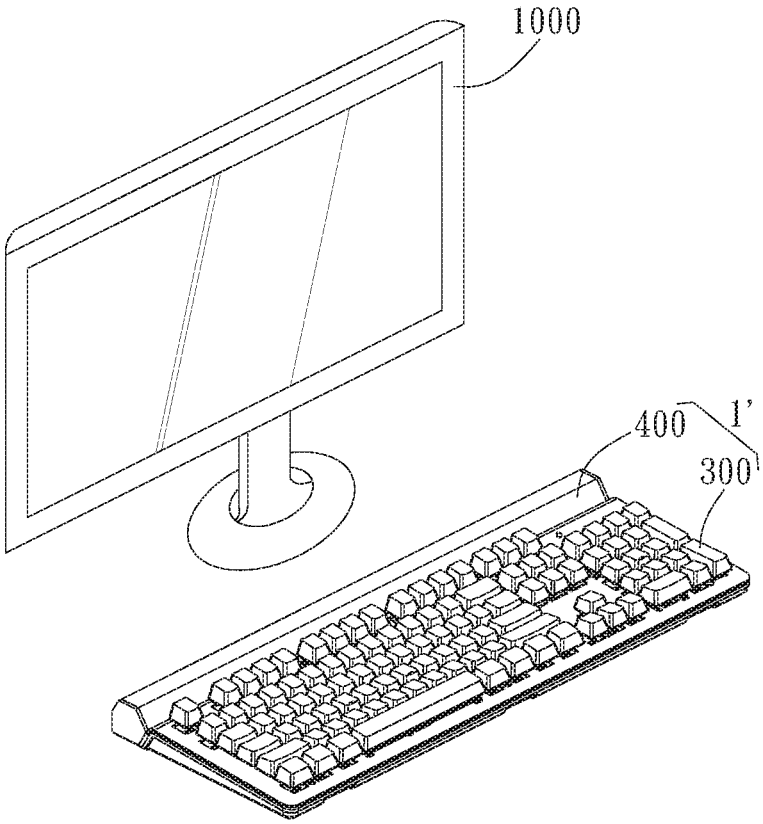
FIG. 31 is a schematic view of the keyboard of FIG. 19B applied to the information processing device.

As shown in FIGS. 30 and 31, the auxiliary module 400 further includes a wireless module 426. The keyswitch module 300 can be wirelessly connected to an information processing device 1000 by the wireless module 426 to promote the functionality of the keyswitch module 300. The wireless module 426 can be a Bluetooth communication module, but not limited thereto. In another embodiment, the keyswitch module 300 can be electrically connected to the information processing device 1000 by the auxiliary module 400 in a wireless manner or a wired manner. The information processing device 100 can be any suitable electronic devices, for example but not limited to, computer, tablet computer. The auxiliary module 400 can further include a speaker 428, and the information processing device 1000 provides an audio signal by the speaker 428 to improve the functionality of the keyswitch module 300. The keyboard 1' of the disclosure can improve the functionality of the keyswitch module 300 by the auxiliary module 400, such as automatically changing the tactile feedback of the keyswitch structures, providing wireless connection with other electronic devices, or providing the audio signal.

Although the preferred embodiments of the present disclosure have been described herein, the above description is merely illustrative. The preferred embodiments disclosed will not limit the scope of the present disclosure. Further modification of the disclosure herein disclosed will occur to those skilled in the respective arts and all such modifications are deemed to be within the scope of the disclosure as defined by the appended claims.

What is claimed is:

1. A keyswitch structure, comprising:

a base having a positioning means;

a cover combined with the base;

a plunger movably coupling with the cover relative to the base, the plunger having a cam portion;

a restoring unit disposed between the base and the plunger to provide a restoring force to enable the plunger to move along a direction away from the base;

a tactile feedback member having a positioning portion positioned by the positioning means and an extending arm extending across a moving path of the cam portion; and an adjusting unit disposed corresponding to the tactile feedback member, wherein the adjusting unit is movable to change a position of the extending arm, wherein the positioning portion has a curved section, and the tactile feedback member is positioned on the base by coupling the positioning portion and the positioning means and the curved section interfering with the base, so as to prevent the positioning portion from escaping from the positioning means.

2. The keyswitch structure of claim 1, wherein the curved section has a ring shape, the base further has an engaging portion, and the curved section engages with the engaging portion.

3. The keyswitch structure of claim 1, wherein the base has a block disposed adjacent to the positioning means, and the positioning portion positioned by the positioning means and abuts against the block.

4. The keyswitch structure of claim 3, wherein the curved section has a U shape; one end of the curved section abuts against the block; the other end of the curved section is a free end, and the free end touches against a lower surface of the base adjacent to the positioning means.

5. A keyswitch structure, comprising:

a base having a positioning means;

a cover combined with the base;

a plunger movably received within the cover and capable of moving relative to the base, the plunger having a cam portion;

a restoring unit disposed between the base and the plunger to provide a restoring force to enable the plunger to move along a direction away from the base;

a tactile feedback member having a positioning portion positioned by the positioning means and an extending arm extending corresponding to a moving path of the cam portion; and an adjusting unit disposed corresponding to the tactile feedback member, wherein the adjusting unit is movable to change a position of the extending arm relative to the moving path.

6. The keyswitch structure of claim 5, wherein the base has a surface extending along an X-Z plane defined by an X axis and a Z axis; the positioning portion has a curved section extending along the X-Z plane, and the curved section abuts against the surface to define a plane of action between the curved section and the surface.

7. The keyswitch structure of claim 5, wherein the positioning means is a positioning hole; the positioning portion has a curved section extending into the positioning hole to interfere with the base, so as to prevent the positioning portion from escaping from the positioning hole.

8. The keyswitch structure of claim 5, wherein:

the adjusting unit being movable in a Y-axis direction to a first position or a second position, when the adjusting unit switches between the first position and the second position, the adjusting unit drives the extending arm to move along the Y-axis direction, so that the tactile feedback member has a first deformation or a second deformation; and the cam portion has a bump with a lower surface, an upper surface, and a protrudent point between the lower surface and the upper surface;

when a pressing force is exerted to move the plunger toward the base and drive the cam portion to move, (a) when the tactile feedback member has the first deformation, the extending arm moves along the lower surface for a first distance to the protrudent point, and then passes the protrudent point to move upward away from the bump;

(b) when the tactile feedback member has the second deformation, the extending arm moves along the lower surface for a second distance to the protrudent point, and then passes the protrudent point to move upward away from the bump; the first distance is larger than the second distance.

9. The keyswitch structure of claim 8, wherein:

when the adjusting unit is at the first position and the extending arm reaches the protrudent point, the extending arm has a first sound distance from an impact surface, and then the extending arm hits the impact surface to generate a first sound; and when the adjusting unit is at the second position and the extending arm reaches the protrudent point, the extending arm has a second sound distance from the impact surface, and then the extending arm hits the impact surface to generate a second sound; the first sound distance is larger than the second distance, and the first sound is louder than the second sound.

10. The keyswitch structure of claim 5, wherein the adjusting unit is movable to drive the extending arm to move to a third position or a fourth position relative to the moving path, so when the plunger moves toward the base, the cam portion moving along the moving path selectively interferes with the extending arm.

11. The keyswitch structure of claim 10, wherein when the extending arm is at the third position and the plunger moves toward the base, the cam portion pushes the extending arm to move along a Y-axis direction away from the moving path.

12. The keyswitch structure of claim 10, wherein when the extending arm is at the fourth position, the plunger is located outside the moving path, so when the plunger moves toward the base, the cam portion moves along the moving path without interfering with the extending arm.

13. A keyswitch structure, comprising:

a base having a positioning means;

a cover combined with the base;

a plunger movably received within the cover and capable of moving relative to the base, the plunger having a cam portion;

a restoring unit disposed between the base and the plunger to provide a restoring force to enable the plunger to move along a direction away from the base;

a tactile feedback member having a positioning portion positioned by the positioning means and an extending arm extending across a moving path of the cam portion; and an adjusting unit coupled to the positioning portion, being selectively positioned at one of a first position and a second position;

wherein when the adjusting unit is positioned at the first position, the positioning portion is driven by the adjusting unit to make the tactile feedback member have a first deformation, so that the extending arm applies a first resistant force against the cam portion;

wherein when the adjusting unit is positioned at the second position, the positioning portion is driven by the adjusting unit to make the tactile feedback member have a second deformation, so that the extending arm applies a second resistant force against the cam portion, and the first resistant force is different from the second resistant force.

14. The keyswitch structure of claim 13, wherein the cam portion includes a bump with a lower surface, an upper surface, and a protrudent point between the lower surface and the upper surface; when the pressing force is exerted to enable the plunger along with the cam portion to move toward the base, the extending arm firstly moves downward along the lower surface to the protrudent point, and then passes the protrudent point to move upward and hit the base or the cover to generate a sound.

15. The keyswitch structure of claim 13, wherein the tactile feedback member is a torsion spring; the positioning portion and the extending arm respectively extend from two opposite ends of the torsion spring; an angle between an extending direction of the positioning portion and an extending direction of the extending arm is equal to or smaller than 120 degrees.

16. The keyswitch structure of claim 13, wherein the base has a surface extending along an X-Z plane defined by an X axis and a Z axis; the positioning portion has a curved section extending along the X-Z plane, and the curved section abuts against the surface to define a plane of action between the curved section and the surface.

17. The keyswitch structure of claim 13, wherein the positioning means is a positioning hole; the positioning portion has a curved section extending into the positioning hole to interfere with the base, so as to prevent the positioning portion from escaping from the positioning hole.

18. The keyswitch structure of claim 13, wherein:

the adjusting unit comprises an X-axis adjusting member disposed corresponding to the positioning portion and a Y-axis adjusting member disposed corresponding to the extending arm;

the X-axis adjusting member is movable along an X-axis direction to the first position or the second position;

when the X-axis adjusting unit is positioned at the first position, the positioning portion is driven by the X-axis adjusting member to make the tactile feedback member have the first deformation, so that the extending arm applies a first resistant force against the cam portion;

when the X-axis adjusting unit is positioned at the second position, the positioning portion is driven by the X-axis adjusting member to make the tactile feedback member have the second deformation, so that the extending arm applies a second resistant force against the cam portion, and the first resistant force is different from the second resistant force; and the Y-axis adjusting member is movable along a Y-axis direction to drive the extending arm to shift, so that a position of the extending arm relative to the moving path of the cam portion is changed.

19. The keyswitch structure of claim 18, wherein the cam portion is a bump; when the X-axis adjusting member is at the first position or the second position, the pressing force is exerted to enable the plunger along with the cam portion to move toward the base, so that the extending arm moves along the bump and hits the base or the cover to generate a sound.

20. The keyswitch structure of claim 18, wherein the Y-axis adjusting member is movable along the Y-axis direction to drive the extending arm to move to a third position or a fourth position relative to the moving path, so when the plunger moves toward the base, the cam portion moving along the moving path selectively interferes with the extending arm.

21. The keyswitch structure of claim 20, wherein when the extending arm is at the third position and the plunger moves toward the base, the cam portion pushes the extending arm to move along the Y-axis direction away from the moving path to generate a tactile feedback.

22. The keyswitch structure of claim 20, wherein when the extending arm is at the fourth position, the extending arm is located outside the moving path, so when the plunger moves toward the base, the cam portion moves along the moving path without interfering with the extending arm.

* * * * *